US005884125A

United States Patent [19]

Taniguchi et al.

[11] Patent Number: 5,884,125

[45] Date of Patent: Mar. 16, 1999

[54] LIGHT EMITTING ELEMENT CONTROL DEVICE, OPTICAL SENSOR CONTROL DEVICE AND BLANK LAMP CONTROL DEVICE

[75] Inventors: Hideo Taniguchi, Nara; Akihiko Taniguchi, Yamatokoriyama; Tamaki Mashiba, Nara; Masanori Mori, Ayama-gun, all of Japan

[73] Assignee: Sharp Kabushiki Kaisha, Osaka, Japan

[21] Appl. No.: 822,784

[22] Filed: Mar. 21, 1997

[30] Foreign Application Priority Data

Mar. 25, 1996 [JP] Japan ..... 8-068118

[51] Int. Cl.[6] ..... G03G 21/00

[52] U.S. Cl. ..... 399/128; 399/186; 399/187

[58] Field of Search ..... 399/13, 128, 186, 399/187; 355/67, 69

[56] References Cited

FOREIGN PATENT DOCUMENTS 1-167139 6/1989 Japan .

4-1674 1/1992 Japan .

4-271025 9/1992 Japan .

*Primary Examiner*—William Royer

*Attorney, Agent, or Firm*—Dike, Bronstein, Roberts & Cushman. LLP; David G. Conlin

[57] ABSTRACT

A control circuit for outputting a signal for controlling an amount of light emitted from a plurality of light emitting elements. The control circuit includes a controller or CPU, and a D/A converter outputting a signal for setting a voltage in multiple gradation in accordance with a lighting state of the light emitting element. An amplifying circuit amplifies an output of the D/A converter and outputs an amplified output as a control signal. A reference voltage generating circuit generates a reference voltage and a comparator compares the control signal with the reference voltage. The controller varies an output of the D/A converter based on the result of comparison by the comparator, to adjust the output of the D/A converter so that the control signal is equivalent to the reference voltage. Accordingly each voltage is reset in the multiple gradation to allow the light emitting element to appropriately emit light based on the adjusted output. As a result, a plurality of light emitting elements can be controlled stably without using a high precision circuit element.

20 Claims, 39 Drawing Sheets

MULTIPLIER A=1.000 R1=7.5kΩ R3=7.5kΩ
a=18[V] R2=2.4kΩ R4=1.5kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 18.000 | 18.000 | 175 | 3.000 | G1~G15 OFF |
| | a= 18.00 | | | | | |
| R26=1000 | | 17.471 | 17.471 | 170 | 2.912 | G1~G15 OFF |
| | V16= 16.94 | | | | | |
| R25=1000 | | 16.412 | 16.412 | 160 | 2.735 | G1~G15 ON |
| | V15= 15.88 | | | | | |
| R24=1000 | | 15.353 | 15.353 | 150 | 2.559 | G1~G14 ON |
| | V14= 14.82 | | | | | |
| R23=1000 | | 14.294 | 14.294 | 139 | 2.382 | G1~G13 ON |
| | V13= 13.76 | | | | | |
| R22=1000 | | 13.235 | 13.235 | 129 | 2.206 | G1~G12 ON |
| | V12= 12.71 | | | | | |
| R21=1000 | | 12.176 | 12.176 | 119 | 2.029 | G1~G11 ON |
| | V11= 11.65 | | | | | |
| R20=1000 | | 11.118 | 11.118 | 108 | 1.853 | G1~G10 ON |
| | V10= 10.59 | | | | | |
| R19=1000 | | 10.059 | 10.059 | 98 | 1.676 | G1~G9 ON |
| | V9= 9.53 | | | | | |
| R18=1000 | | 9.000 | 9.000 | 88 | 1.500 | G1~G8 ON |
| | V8= 8.47 | | | | | |
| R17=1000 | | 7.941 | 7.941 | 77 | 1.324 | G1~G7 ON |
| | V7= 7.41 | | | | | |
| R16=1000 | | 6.882 | 6.882 | 67 | 1.147 | G1~G6 ON |
| | V6= 6.35 | | | | | |
| R15=1000 | | 5.824 | 5.824 | 57 | 0.971 | G1~G5 ON |
| | V5= 5.29 | | | | | |
| R14=1000 | | 4.765 | 4.765 | 46 | 0.794 | G1~G4 ON |
| | V4= 4.24 | | | | | |
| R13=1000 | | 3.706 | 3.706 | 36 | 0.618 | G1~G3 ON |
| | V3= 3.18 | | | | | |
| R12=1000 | | 2.647 | 2.647 | 26 | 0.441 | G1~G2 ON |
| | V2= 2.12 | | | | | |
| R11=1000 | | 1.588 | 1.588 | 15 | 0.265 | G1 ON |
| | V1= 1.06 | | | | | |
| R10=1000 | | 0.529 | 0.529 | 5 | 0.088 | G1~G15 OFF |
| | 0.00 | | | | | |

FIG. 5 a=18[V] R1=7.5kΩ R3=7.5kΩ
n=18[V] R2=2.4kΩ R4=1.5kΩ

| | VOLTAGE b | | | ma | | | REFERENCE VOLTAGE ra | | |
|---|---|---|---|---|---|---|---|---|---|
| TOLERANCE OF RESISTOR | MIN | TYP | MAX | MIN | TYP | MAX | MIN | TYP | MAX |
| 0% | 4.364 | 4.364 | 4.364 | 175.3 | 175.3 | 175.3 | 3.000 | 3.000 | 3.000 |
| ± 1% | 4.298 | 4.364 | 4.430 | 169.8 | 175.3 | 181.0 | 2.950 | 3.000 | 3.050 |
| ± 5% | 4.041 | 4.364 | 4.703 | 149.5 | 175.3 | 205.6 | 2.758 | 3.000 | 3.259 |
| ±10% | 3.735 | 4.364 | 5.061 | 127.5 | 175.3 | 241.4 | 2.531 | 3.000 | 3.536 |

FIG. 6

MULTIPLIER A=0.928 R1= 7.5kΩ-5% R1= 7.125kΩ R3= 7.5kΩ
a=18[V] R2= 2.4kΩ+5% R2= 2.52kΩ R4= 1.5kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 18.000 | 18.000 | 163 | 3.000 | G1~G15 OFF |
| | a= 18.00 | | | | | |
| R26=1000 | | 17.471 | 17.471 | 158 | 2.912 | G1~G15 OFF |
| | V16= 16.94 | | | | | |
| R25=1000 | | 16.412 | 16.412 | 148 | 2.735 | G1~G15 ON |
| | V15= 15.88 | | | | | |
| R24=1000 | | 15.353 | 15.353 | 139 | 2.559 | G1~G14 ON |
| | V14= 14.82 | | | | | |
| R23=1000 | | 14.294 | 14.294 | 129 | 2.382 | G1~G13 ON |
| | V13= 13.76 | | | | | |
| R22=1000 | | 13.235 | 13.235 | 120 | 2.206 | G1~G12 ON |
| | V12= 12.71 | | | | | |
| R21=1000 | | 12.176 | 12.176 | 110 | 2.029 | G1~G11 ON |
| | V11= 11.65 | | | | | |
| R20=1000 | | 11.118 | 11.118 | 100 | 1.853 | G1~G10 ON |
| | V10= 10.59 | | | | | |
| R19=1000 | | 10.059 | 10.059 | 91 | 1.676 | G1~G9 ON |
| | V9= 9.53 | | | | | |
| R18=1000 | | 9.000 | 9.000 | 81 | 1.500 | G1~G8 ON |
| | V8= 8.47 | | | | | |
| R17=1000 | | 7.941 | 7.941 | 72 | 1.324 | G1~G7 ON |
| | V7= 7.41 | | | | | |
| R16=1000 | | 6.882 | 6.882 | 62 | 1.147 | G1~G6 ON |
| | V6= 6.35 | | | | | |
| R15=1000 | | 5.824 | 5.824 | 53 | 0.971 | G1~G5 ON |
| | V5= 5.29 | | | | | |
| R14=1000 | | 4.765 | 4.765 | 43 | 0.794 | G1~G4 ON |
| | V4= 4.24 | | | | | |
| R13=1000 | | 3.706 | 3.706 | 33 | 0.618 | G1~G3 ON |
| | V3= 3.18 | | | | | |
| R12=1000 | | 2.647 | 2.647 | 24 | 0.441 | G1~G2 ON |
| | V2= 2.12 | | | | | |
| R11=1000 | | 1.588 | 1.588 | 14 | 0.265 | G1 ON |
| | V1= 1.06 | | | | | |
| R10=1000 | | 0.529 | 0.529 | 5 | 0.088 | G1~G15 OFF |
| | 0.00 | | | | | |

FIG. 9

MULTIPLIER A=1.080 R1= 7.5kΩ+5% R1=7.875kΩ R3=7.5kΩ
a=18[V] R2= 2.4kΩ-5% R2= 2.28kΩ R4=1.5kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 18.000 | 18.000 | 189 | 3.000 | G1~G15 OFF |
| | a= 18.00 | | | | | |
| R26=1000 | | 17.471 | 17.471 | 184 | 2.912 | G1~G15 OFF |
| | V16= 16.94 | | | | | |
| R25=1000 | | 16.412 | 16.412 | 173 | 2.735 | G1~G15 ON |
| | V15= 15.88 | | | | | |
| R24=1000 | | 15.353 | 15.353 | 161 | 2.559 | G1~G14 ON |
| | V14= 14.82 | | | | | |
| R23=1000 | | 14.294 | 14.294 | 150 | 2.382 | G1~G13 ON |
| | V13= 13.76 | | | | | |
| R22=1000 | | 13.235 | 13.235 | 139 | 2.206 | G1~G12 ON |
| | V12= 12.71 | | | | | |
| R21=1000 | | 12.176 | 12.176 | 128 | 2.029 | G1~G11 ON |
| | V11= 11.65 | | | | | |
| R20=1000 | | 11.118 | 11.118 | 117 | 1.853 | G1~G10 ON |
| | V10= 10.59 | | | | | |
| R19=1000 | | 10.059 | 10.059 | 106 | 1.676 | G1~G9 ON |
| | V9= 9.53 | | | | | |
| R18=1000 | | 9.000 | 9.000 | 95 | 1.500 | G1~G8 ON |
| | V8= 8.47 | | | | | |
| R17=1000 | | 7.941 | 7.941 | 84 | 1.324 | G1~G7 ON |
| | V7= 7.41 | | | | | |
| R16=1000 | | 6.882 | 6.882 | 72 | 1.147 | G1~G6 ON |
| | V6= 6.35 | | | | | |
| R15=1000 | | 5.824 | 5.824 | 61 | 0.971 | G1~G5 ON |
| | V5= 5.29 | | | | | |
| R14=1000 | | 4.765 | 4.765 | 50 | 0.794 | G1~G4 ON |
| | V4= 4.24 | | | | | |
| R13=1000 | | 3.706 | 3.706 | 39 | 0.618 | G1~G3 ON |
| | V3= 3.18 | | | | | |
| R12=1000 | | 2.647 | 2.647 | 28 | 0.441 | G1~G2 ON |
| | V2= 2.12 | | | | | |
| R11=1000 | | 1.588 | 1.588 | 17 | 0.265 | G1 ON |
| | V1= 1.06 | | | | | |
| R10=1000 | | 0.529 | 0.529 | 6 | 0.088 | G1~G15 OFF |
| | 0.00 | | | | | |

FIG. 10

MULTIPLIER A=0.919 R3=7.5kΩ+5% R1= 7.5kΩ R3= 7.75kΩ
a=18[V] R4=1.5kΩ-5% R2= 2.4kΩ R4=1.425kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 18.000 | 18.000 | 161 | 2.758 | G1~G15 OFF |
| | a= 18.00 | | | | | |
| R26=1000 | | 17.471 | 17.471 | 156 | 2.677 | G1~G15 OFF |
| | V16= 16.94 | | | | | |
| R25=1000 | | 16.412 | 16.412 | 147 | 2.515 | G1~G15 ON |
| | V15= 15.88 | | | | | |
| R24=1000 | | 15.353 | 15.353 | 137 | 2.352 | G1~G14 ON |
| | V14= 14.82 | | | | | |
| R23=1000 | | 14.294 | 14.294 | 128 | 2.190 | G1~G13 ON |
| | V13= 13.76 | | | | | |
| R22=1000 | | 13.235 | 13.235 | 119 | 2.028 | G1~G12 ON |
| | V12= 12.71 | | | | | |
| R21=1000 | | 12.176 | 12.176 | 109 | 1.866 | G1~G11 ON |
| | V11= 11.65 | | | | | |
| R20=1000 | | 11.118 | 11.118 | 100 | 1.704 | G1~G10 ON |
| | V10= 10.59 | | | | | |
| R19=1000 | | 10.059 | 10.059 | 90 | 1.541 | G1~G9 ON |
| | V9= 9.53 | | | | | |
| R18=1000 | | 9.000 | 9.000 | 81 | 1.379 | G1~G8 ON |
| | V8= 8.47 | | | | | |
| R17=1000 | | 7.941 | 7.941 | 71 | 1.217 | G1~G7 ON |
| | V7= 7.41 | | | | | |
| R16=1000 | | 6.882 | 6.882 | 62 | 1.055 | G1~G6 ON |
| | V6= 6.35 | | | | | |
| R15=1000 | | 5.824 | 5.824 | 52 | 0.892 | G1~G5 ON |
| | V5= 5.29 | | | | | |
| R14=1000 | | 4.765 | 4.765 | 43 | 0.730 | G1~G4 ON |
| | V4= 4.24 | | | | | |
| R13=1000 | | 3.706 | 3.706 | 33 | 0.568 | G1~G3 ON |
| | V3= 3.18 | | | | | |
| R12=1000 | | 2.647 | 2.647 | 24 | 0.406 | G1~G2 ON |
| | V2= 2.12 | | | | | |
| R11=1000 | | 1.588 | 1.588 | 14 | 0.243 | G1 ON |
| | V1= 1.06 | | | | | |
| R10=1000 | | 0.529 | 0.529 | 5 | 0.081 | G1~G15 OFF |
| | 0.00 | | | | | |

FIG. 11

MULTIPLIER A=1.086 R3= 7.5kΩ-5% R1=7.5kΩ R3= 7.125kΩ
a=18[V] R4= 1.5kΩ+5% R2=2.4kΩ R4= 1.575kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 18.000 | 18.000 | 190 | 3.259 | G1~G15 OFF |
| | a= 18.00 | | | | | |
| R26=1000 | | 17.471 | 17.471 | 185 | 3.163 | G1~G15 OFF |
| | V16= 16.94 | | | | | |
| R25=1000 | | 16.412 | 16.412 | 174 | 2.971 | G1~G15 ON |
| | V15= 15.88 | | | | | |
| R24=1000 | | 15.353 | 15.353 | 162 | 2.779 | G1~G14 ON |
| | V14= 14.82 | | | | | |
| R23=1000 | | 14.294 | 14.294 | 151 | 2.588 | G1~G13 ON |
| | V13= 13.76 | | | | | |
| R22=1000 | | 13.235 | 13.235 | 140 | 2.396 | G1~G12 ON |
| | V12= 12.71 | | | | | |
| R21=1000 | | 12.176 | 12.176 | 129 | 2.204 | G1~G11 ON |
| | V11= 11.65 | | | | | |
| R20=1000 | | 11.118 | 11.118 | 118 | 2.013 | G1~G10 ON |
| | V10= 10.59 | | | | | |
| R19=1000 | | 10.059 | 10.059 | 106 | 1.821 | G1~G9 ON |
| | V9= 9.53 | | | | | |
| R18=1000 | | 9.000 | 9.000 | 95 | 1.629 | G1~G8 ON |
| | V8= 8.47 | | | | | |
| R17=1000 | | 7.941 | 7.941 | 84 | 1.438 | G1~G7 ON |
| | V7= 7.41 | | | | | |
| R16=1000 | | 6.882 | 6.882 | 73 | 1.246 | G1~G6 ON |
| | V6= 6.35 | | | | | |
| R15=1000 | | 5.824 | 5.824 | 62 | 1.054 | G1~G5 ON |
| | V5= 5.29 | | | | | |
| R14=1000 | | 4.765 | 4.765 | 50 | 0.863 | G1~G4 ON |
| | V4= 4.24 | | | | | |
| R13=1000 | | 3.706 | 3.706 | 39 | 0.671 | G1~G3 ON |
| | V3= 3.18 | | | | | |
| R12=1000 | | 2.647 | 2.647 | 28 | 0.479 | G1~G2 ON |
| | V2= 2.12 | | | | | |
| R11=1000 | | 1.588 | 1.588 | 17 | 0.288 | G1 ON |
| | V1= 1.06 | | | | | |
| R10=1000 | | 0.529 | 0.529 | 6 | 0.096 | G1~G15 OFF |
| | 0.00 | | | | | |

FIG. 12

MULTIPLIER A=1.000 R1=7.5kΩ R3=7.5kΩ
a=19.8[V] ( a=18V+10% ) R2=2.4kΩ R4=1.5kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 19.800 | 19.800 | 175 | 3.300 | G1~G15 OFF |
| | a= 19.80 | | | | | |
| R26=1000 | | 19.218 | 19.218 | 170 | 3.203 | G1~G15 OFF |
| | V16= 18.64 | | | | | |
| R25=1000 | | 18.053 | 18.053 | 160 | 3.009 | G1~G15 ON |
| | V15= 17.47 | | | | | |
| R24=1000 | | 16.888 | 16.888 | 150 | 2.815 | G1~G14 ON |
| | V14= 16.31 | | | | | |
| R23=1000 | | 15.724 | 15.724 | 139 | 2.621 | G1~G13 ON |
| | V13= 15.14 | | | | | |
| R22=1000 | | 14.559 | 14.559 | 129 | 2.426 | G1~G12 ON |
| | V12= 13.98 | | | | | |
| R21=1000 | | 13.394 | 13.394 | 119 | 2.232 | G1~G11 ON |
| | V11= 12.81 | | | | | |
| R20=1000 | | 12.229 | 12.229 | 108 | 2.038 | G1~G10 ON |
| | V10= 11.65 | | | | | |
| R19=1000 | | 11.065 | 11.065 | 98 | 1.844 | G1~G9 ON |
| | V9= 10.48 | | | | | |
| R18=1000 | | 9.900 | 9.900 | 88 | 1.650 | G1~G8 ON |
| | V8= 9.32 | | | | | |
| R17=1000 | | 8.735 | 8.735 | 77 | 1.456 | G1~G7 ON |
| | V7= 8.15 | | | | | |
| R16=1000 | | 7.571 | 7.571 | 67 | 1.262 | G1~G6 ON |
| | V6= 6.99 | | | | | |
| R15=1000 | | 6.406 | 6.406 | 57 | 1.068 | G1~G5 ON |
| | V5= 5.82 | | | | | |
| R14=1000 | | 5.241 | 5.241 | 46 | 0.874 | G1~G4 ON |
| | V4= 4.66 | | | | | |
| R13=1000 | | 4.076 | 4.076 | 36 | 0.679 | G1~G3 ON |
| | V3= 3.49 | | | | | |
| R12=1000 | | 2.912 | 2.912 | 26 | 0.485 | G1~G2 ON |
| | V2= 2.33 | | | | | |
| R11=1000 | | 1.747 | 1.747 | 15 | 0.291 | G1 ON |
| | V1= 1.16 | | | | | |
| R10=1000 | | 0.582 | 0.582 | 6 | 0.097 | G1~G15 OFF |
| | 0.00 | | | | | |

FIG. 13

MULTIPLIER A=1.000 R1=7.5kΩ R3=7.5kΩ
a=16.2[V] ( a=18V −10% ) R2=2.4kΩ R4=1.5kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 16.200 | 16.200 | 175 | 2.700 | G1~G15 OFF |
| | a= 16.20 | | | | | |
| R26=1000 | | 15.724 | 15.724 | 170 | 2.621 | G1~G15 OFF |
| | V16= 15.25 | | | | | |
| R25=1000 | | 14.771 | 14.771 | 160 | 2.462 | G1~G15 ON |
| | V15= 14.29 | | | | | |
| R24=1000 | | 13.818 | 13.818 | 150 | 2.303 | G1~G14 ON |
| | V14= 13.34 | | | | | |
| R23=1000 | | 12.865 | 12.865 | 139 | 2.144 | G1~G13 ON |
| | V13= 12.39 | | | | | |
| R22=1000 | | 11.912 | 11.912 | 129 | 1.985 | G1~G12 ON |
| | V12= 11.44 | | | | | |
| R21=1000 | | 10.959 | 10.959 | 119 | 1.826 | G1~G11 ON |
| | V11= 10.48 | | | | | |
| R20=1000 | | 10.006 | 10.006 | 108 | 1.668 | G1~G10 ON |
| | V10= 9.53 | | | | | |
| R19=1000 | | 9.053 | 9.053 | 98 | 1.509 | G1~G9 ON |
| | V9= 8.58 | | | | | |
| R18=1000 | | 8.100 | 8.100 | 88 | 1.350 | G1~G8 ON |
| | V8= 7.62 | | | | | |
| R17=1000 | | 7.147 | 7.147 | 77 | 1.191 | G1~G7 ON |
| | V7= 6.67 | | | | | |
| R16=1000 | | 6.194 | 6.194 | 67 | 1.032 | G1~G6 ON |
| | V6= 5.72 | | | | | |
| R15=1000 | | 5.241 | 5.241 | 57 | 0.874 | G1~G5 ON |
| | V5= 4.76 | | | | | |
| R14=1000 | | 4.288 | 4.288 | 46 | 0.715 | G1~G4 ON |
| | V4= 3.81 | | | | | |
| R13=1000 | | 3.335 | 3.335 | 36 | 0.556 | G1~G3 ON |
| | V3= 2.86 | | | | | |
| R12=1000 | | 2.382 | 2.382 | 26 | 0.397 | G1~G2 ON |
| | V2= 1.91 | | | | | |
| R11=1000 | | 1.429 | 1.429 | 15 | 0.238 | G1 ON |
| | V1= 0.95 | | | | | |
| R10=1000 | | 0.476 | 0.476 | 6 | 0.079 | G1~G15 OFF |
| | 0.00 | | | | | |

FIG. 14

MULTIPLIER A=0.853
a=19.8[V] ( a=18V+10% )

R1=7.125kΩ R3=7.875kΩ
R2= 2.52kΩ R4=1.425kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 19.800 | 19.800 | 150 | 3.034 | G1~G15 OFF |
| | a= 19.80 | | | | | |
| R26=1000 | | 19.218 | 19.218 | 145 | 2.945 | G1~G15 OFF |
| | V16= 18.64 | | | | | |
| R25=1000 | | 18.053 | 18.053 | 136 | 2.766 | G1~G15 ON |
| | V15= 17.47 | | | | | |
| R24=1000 | | 16.888 | 16.888 | 128 | 2.588 | G1~G14 ON |
| | V14= 16.31 | | | | | |
| R23=1000 | | 15.724 | 15.724 | 119 | 2.409 | G1~G13 ON |
| | V13= 15.14 | | | | | |
| R22=1000 | | 14.559 | 14.559 | 110 | 2.231 | G1~G12 ON |
| | V12= 13.98 | | | | | |
| R21=1000 | | 13.394 | 13.394 | 101 | 2.052 | G1~G11 ON |
| | V11= 12.81 | | | | | |
| R20=1000 | | 12.229 | 12.229 | 92 | 1.874 | G1~G10 ON |
| | V10= 11.65 | | | | | |
| R19=1000 | | 11.065 | 11.065 | 84 | 1.695 | G1~G9 ON |
| | V9= 10.48 | | | | | |
| R18=1000 | | 9.900 | 9.900 | 75 | 1.517 | G1~G8 ON |
| | V8= 9.32 | | | | | |
| R17=1000 | | 8.735 | 8.735 | 66 | 1.338 | G1~G7 ON |
| | V7= 8.15 | | | | | |
| R16=1000 | | 7.571 | 7.571 | 57 | 1.160 | G1~G6 ON |
| | V6= 6.99 | | | | | |
| R15=1000 | | 6.406 | 6.406 | 48 | 0.982 | G1~G5 ON |
| | V5= 5.82 | | | | | |
| R14=1000 | | 5.241 | 5.241 | 40 | 0.803 | G1~G4 ON |
| | V4= 4.66 | | | | | |
| R13=1000 | | 4.076 | 4.076 | 31 | 0.625 | G1~G3 ON |
| | V3= 3.49 | | | | | |
| R12=1000 | | 2.912 | 2.912 | 22 | 0.446 | G1~G2 ON |
| | V2= 2.33 | | | | | |
| R11=1000 | | 1.747 | 1.747 | 13 | 0.268 | G1 ON |
| | V1= 1.16 | | | | | |
| R10=1000 | | 0.582 | 0.582 | 4 | 0.089 | G1~G15 OFF |
| | 0.00 | | | | | |

FIG. 15

MULTIPLIER A=1.173
a=16.2[V] ( a=18V−10% )

R1= 7.875kΩ R3= 7.125kΩ
R2=2.28kΩ R4= 1.575kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 16.200 | 16.200 | 206 | 2.933 | G1~G15 OFF |
| | a= 16.20 | | | | | |
| R26=1000 | | 15.724 | 15.724 | 200 | 2.847 | G1~G15 OFF |
| | V16= 15.25 | | | | | |
| R25=1000 | | 14.771 | 14.771 | 187 | 2.674 | G1~G15 ON |
| | V15= 14.29 | | | | | |
| R24=1000 | | 13.818 | 13.818 | 175 | 2.501 | G1~G14 ON |
| | V14= 13.34 | | | | | |
| R23=1000 | | 12.865 | 12.865 | 163 | 2.329 | G1~G13 ON |
| | V13= 12.39 | | | | | |
| R22=1000 | | 11.912 | 11.912 | 151 | 2.156 | G1~G12 ON |
| | V12= 11.44 | | | | | |
| R21=1000 | | 10.959 | 10.959 | 139 | 1.984 | G1~G11 ON |
| | V11= 10.48 | | | | | |
| R20=1000 | | 10.006 | 10.006 | 127 | 1.811 | G1~G10 ON |
| | V10= 9.53 | | | | | |
| R19=1000 | | 9.053 | 9.053 | 115 | 1.639 | G1~G9 ON |
| | V9= 8.58 | | | | | |
| R18=1000 | | 8.100 | 8.100 | 103 | 1.466 | G1~G8 ON |
| | V8= 7.62 | | | | | |
| R17=1000 | | 7.147 | 7.147 | 91 | 1.294 | G1~G7 ON |
| | V7= 6.67 | | | | | |
| R16=1000 | | 6.194 | 6.194 | 79 | 1.121 | G1~G6 ON |
| | V6= 5.72 | | | | | |
| R15=1000 | | 5.241 | 5.241 | 67 | 0.949 | G1~G5 ON |
| | V5= 4.76 | | | | | |
| R14=1000 | | 4.288 | 4.288 | 54 | 0.776 | G1~G4 ON |
| | V4= 3.81 | | | | | |
| R13=1000 | | 3.335 | 3.335 | 42 | 0.604 | G1~G3 ON |
| | V3= 2.86 | | | | | |
| R12=1000 | | 2.382 | 2.382 | 30 | 0.431 | G1~G2 ON |
| | V2= 1.91 | | | | | |
| R11=1000 | | 1.429 | 1.429 | 18 | 0.259 | G1 ON |
| | V1= 0.95 | | | | | |
| R10=1000 | | 0.476 | 0.476 | 6 | 0.086 | G1~G15 OFF |
| | 0.00 | | | | | |

FIG. 16

MULTIPLIER A=1.000 R1= 7.5kΩ R3= 7.5kΩ
a=18[V] b=4.363 [V] R2= 2.4kΩ R4= 1.5kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 18.000 | 18.000 | 175 | 3.000 | G1~G15 OFF |
| | a= 18.00 | | | | | |
| R26=1000 | | 17.471 | 17.471 | 170 | 2.912 | G1~G15 OFF |
| | V16= 16.94 | | | | | |
| R25=1000 | | 16.412 | 16.412 | 160 | 2.735 | G1~G15 ON |
| | V15= 15.88 | | | | | |
| R24=1000 | | 15.353 | 15.353 | 150 | 2.559 | G1~G14 ON |
| | V14= 14.82 | | | | | |
| R23=1000 | | 14.294 | 14.294 | 139 | 2.382 | G1~G13 ON |
| | V13= 13.76 | | | | | |
| R22=1000 | | 13.235 | 13.235 | 129 | 2.206 | G1~G12 ON |
| | V12= 12.71 | | | | | |
| R21=1000 | | 12.176 | 12.176 | 119 | 2.029 | G1~G11 ON |
| | V11= 11.65 | | | | | |
| R20=1000 | | 11.118 | 11.118 | 108 | 1.853 | G1~G10 ON |
| | V10= 10.59 | | | | | |
| R19=1000 | | 10.059 | 10.059 | 98 | 1.676 | G1~G9 ON |
| | V9= 9.53 | | | | | |
| R18=1000 | | 9.000 | 9.000 | 88 | 1.500 | G1~G8 ON |
| | V8= 8.47 | | | | | |
| R17=1000 | | 7.941 | 7.941 | 77 | 1.324 | G1~G7 ON |
| | V7= 7.41 | | | | | |
| R16=1000 | | 6.882 | 6.882 | 67 | 1.147 | G1~G6 ON |
| | V6= 6.35 | | | | | |
| R15=1000 | | 5.824 | 5.824 | 57 | 0.971 | G1~G5 ON |
| | V5= 5.29 | | | | | |
| R14=1000 | | 4.765 | 4.765 | 46 | 0.794 | G1~G4 ON |
| | V4= 4.24 | | | | | |
| R13=1000 | | 3.706 | 3.706 | 36 | 0.618 | G1~G3 ON |
| | V3= 3.18 | | | | | |
| R12=1000 | | 2.647 | 2.647 | 26 | 0.441 | G1~G2 ON |
| | V2= 2.12 | | | | | |
| R11=1000 | | 1.588 | 1.588 | 15 | 0.265 | G1 ON |
| | V1= 1.06 | | | | | |
| R10=1000 | | 0.529 | 0.529 | 5 | 0.088 | G1~G15 OFF |
| | 0.00 | | | | | |

FIG. 17

MULTIPLIER A=1.100 R1= kΩ R3=7.5kΩ
a=19.8[V] ( a=18V+10% ) b=4.363[V] R2= kΩ R4=1.5kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 19.800 | 19.800 | 193 | 3.300 | G1~G15 OFF |
| | a= 19.80 | | | | | |
| R26=1000 | | 19.218 | 19.218 | 187 | 3.203 | G1~G15 OFF |
| | V16= 18.64 | | | | | |
| R25=1000 | | 18.053 | 18.053 | 176 | 3.009 | G1~G15 ON |
| | V15= 17.47 | | | | | |
| R24=1000 | | 16.888 | 16.888 | 165 | 2.815 | G1~G14 ON |
| | V14= 16.31 | | | | | |
| R23=1000 | | 15.724 | 15.724 | 153 | 2.621 | G1~G13 ON |
| | V13= 15.14 | | | | | |
| R22=1000 | | 14.559 | 14.559 | 142 | 2.426 | G1~G12 ON |
| | V12= 13.98 | | | | | |
| R21=1000 | | 13.394 | 13.394 | 130 | 2.232 | G1~G11 ON |
| | V11= 12.81 | | | | | |
| R20=1000 | | 12.229 | 12.229 | 119 | 2.038 | G1~G10 ON |
| | V10= 11.65 | | | | | |
| R19=1000 | | 11.065 | 11.065 | 108 | 1.844 | G1~G9 ON |
| | V9= 10.48 | | | | | |
| R18=1000 | | 9.900 | 9.900 | 96 | 1.650 | G1~G8 ON |
| | V8= 9.32 | | | | | |
| R17=1000 | | 8.735 | 8.735 | 85 | 1.456 | G1~G7 ON |
| | V7= 8.15 | | | | | |
| R16=1000 | | 7.571 | 7.571 | 74 | 1.262 | G1~G6 ON |
| | V6= 6.99 | | | | | |
| R15=1000 | | 6.406 | 6.406 | 62 | 1.068 | G1~G5 ON |
| | V5= 5.82 | | | | | |
| R14=1000 | | 5.241 | 5.241 | 51 | 0.874 | G1~G4 ON |
| | V4= 4.66 | | | | | |
| R13=1000 | | 4.076 | 4.076 | 40 | 0.679 | G1~G3 ON |
| | V3= 3.49 | | | | | |
| R12=1000 | | 2.912 | 2.912 | 28 | 0.485 | G1~G2 ON |
| | V2= 2.33 | | | | | |
| R11=1000 | | 1.747 | 1.747 | 17 | 0.291 | G1 ON |
| | V1= 1.16 | | | | | |
| R10=1000 | | 0.582 | 0.582 | 6 | 0.097 | G1~G15 OFF |
| | 0.00 | | | | | |

FIG. 18

MULTIPLIER A=0.900 R1= kΩ R3=7.5kΩ
a=16.2[V] ( a=18V−10% ) b=4.363[V] R2= kΩ R4=1.5kΩ

| RESISTANCE VALUE | REFERENCE VOLTAGE | TARGET VALUE | OUTPUT VALUE | OUTPUT VALUE | OUTPUT VALUE | BLANK LAMP LIGHTING STATE |
|---|---|---|---|---|---|---|
| Ω | | n = | n = | m = | r = | |
| | | 16.200 | 16.200 | 158 | 2.700 | G1~G15 OFF |
| | a= 16.20 | | | | | |
| R26=1000 | | 15.724 | 15.724 | 153 | 2.621 | G1~G15 OFF |
| | V16= 15.25 | | | | | |
| R25=1000 | | 14.771 | 14.771 | 144 | 2.462 | G1~G15 ON |
| | V15= 14.29 | | | | | |
| R24=1000 | | 13.818 | 13.818 | 135 | 2.303 | G1~G14 ON |
| | V14= 13.34 | | | | | |
| R23=1000 | | 12.865 | 12.865 | 125 | 2.144 | G1~G13 ON |
| | V13= 12.39 | | | | | |
| R22=1000 | | 11.912 | 11.912 | 116 | 1.985 | G1~G12 ON |
| | V12= 11.44 | | | | | |
| R21=1000 | | 10.959 | 10.959 | 107 | 1.826 | G1~G11 ON |
| | V11= 10.48 | | | | | |
| R20=1000 | | 10.006 | 10.006 | 97 | 1.668 | G1~G10 ON |
| | V10= 9.53 | | | | | |
| R19=1000 | | 9.053 | 9.053 | 88 | 1.509 | G1~G9 ON |
| | V9= 8.58 | | | | | |
| R18=1000 | | 8.100 | 8.100 | 79 | 1.350 | G1~G8 ON |
| | V8= 7.62 | | | | | |
| R17=1000 | | 7.147 | 7.147 | 70 | 1.191 | G1~G7 ON |
| | V7= 6.67 | | | | | |
| R16=1000 | | 6.194 | 6.194 | 60 | 1.032 | G1~G6 ON |
| | V6= 5.72 | | | | | |
| R15=1000 | | 5.241 | 5.241 | 51 | 0.874 | G1~G5 ON |
| | V5= 4.76 | | | | | |
| R14=1000 | | 4.288 | 4.288 | 42 | 0.715 | G1~G4 ON |
| | V4= 3.81 | | | | | |
| R13=1000 | | 3.335 | 3.335 | 32 | 0.556 | G1~G3 ON |
| | V3= 2.86 | | | | | |
| R12=1000 | | 2.382 | 2.382 | 23 | 0.397 | G1~G2 ON |
| | V2= 1.91 | | | | | |
| R11=1000 | | 1.429 | 1.429 | 14 | 0.238 | G1 ON |
| | V1= 0.95 | | | | | |
| R10=1000 | | 0.476 | 0.476 | 5 | 0.079 | G1~G15 OFF |
| | 0.00 | | | | | |

FIG. 19

FIG. 25

TOLERANCE 1.01(+1%) 0.99(-1%) a=18[V] R1=7.5kΩ R2=2.4kΩ R3=7.5kΩ R4=1.5kΩ

| | MIN | TYP | MAX |
|---|---|---|---|
| REDUCED PRESSURE | 4.146 | 4.125 | 4.063 |
| AMPLIFICATION FACTOR | 5.901 | 6.000 | 6.101 |

| Ω | | MIN | TYP | MAX | DIFFERENCE | n=SET VALUE | m=TYP | n=MIN | n=TYP | n=MAX | WIDTH OF n | BLANK LAMP LIGHTING STATE |
|---|---|---|---|---|---|---|---|---|---|---|---|---|
| | | | 18.00 | | | | | | | | | |
| R26=1000 | | | | | 1.04 | 17.471 | 170 | 16.923 | 17.471 | 18.035 | 0.938 | G1~G15 OFF |
| | V16= | 16.92 | 16.94 | 16.96 | | | | | | | | |
| R25=1000 | | | | | 1.00 | 16.412 | 160 | 15.898 | 16.412 | 16.942 | 0.882 | G1~G15 ON |
| | V15= | 15.84 | 15.88 | 15.92 | | | | | | | | |
| R24=1000 | | | | | 0.97 | 15.353 | 150 | 14.827 | 15.353 | 15.849 | 0.825 | G1~G14 ON |
| | V14= | 14.77 | 14.82 | 14.88 | | | | | | | | |
| R23=1000 | | | | | 0.94 | 14.294 | 139 | 13.846 | 14.294 | 14.756 | 0.768 | G1~G13 ON |
| | V13= | 13.70 | 13.76 | 13.83 | | | | | | | | |
| R22=1000 | | | | | 0.92 | 13.235 | 129 | 12.821 | 13.235 | 13.663 | 0.711 | G1~G12 ON |
| | V12= | 12.63 | 12.71 | 12.78 | | | | | | | | |
| R21=1000 | | | | | 0.90 | 12.176 | 119 | 11.795 | 12.176 | 12.570 | 0.654 | G1~G11 ON |
| | V11= | 11.56 | 11.65 | 11.73 | | | | | | | | |
| R20=1000 | | | | | 0.89 | 11.118 | 108 | 10.769 | 11.118 | 11.477 | 0.597 | G1~G10 ON |
| | V10= | 10.50 | 10.59 | 10.68 | | | | | | | | |
| R19=1000 | | | | | 0.88 | 10.059 | 98 | 9.744 | 10.059 | 10.384 | 0.540 | G1~G9 ON |
| | V9= | 9.44 | 9.53 | 9.62 | | | | | | | | |
| R18=1000 | | | | | 0.88 | 9.000 | 88 | 8.718 | 9.000 | 9.291 | 0.483 | G1~G8 ON |
| | V8= | 8.38 | 8.47 | 8.56 | | | | | | | | |
| R17=1000 | | | | | 0.88 | 7.941 | 77 | 7.692 | 7.941 | 8.198 | 0.427 | G1~G7 ON |
| | V7= | 7.32 | 7.41 | 7.50 | | | | | | | | |
| R16=1000 | | | | | 0.89 | 6.882 | 67 | 6.667 | 6.882 | 7.105 | 0.370 | G1~G6 ON |
| | V6= | 6.27 | 6.35 | 6.44 | | | | | | | | |
| R15=1000 | | | | | 0.90 | 5.824 | 57 | 5.641 | 5.824 | 6.012 | 0.313 | G1~G5 ON |
| | V5= | 5.22 | 5.29 | 5.37 | | | | | | | | |
| R14=1000 | | | | | 0.92 | 4.765 | 46 | 4.615 | 4.765 | 4.919 | 0.256 | G1~G4 ON |
| | V4= | 4.17 | 4.24 | 4.30 | | | | | | | | |
| R13=1000 | | | | | 0.94 | 3.706 | 36 | 3.590 | 3.706 | 3.826 | 0.199 | G1~G3 ON |
| | V3= | 3.12 | 3.18 | 3.23 | | | | | | | | |
| R12=1000 | | | | | 0.97 | 2.647 | 26 | 2.564 | 2.647 | 2.733 | 0.142 | G1~G2 ON |
| | V2= | 2.08 | 2.12 | 2.16 | | | | | | | | |
| R11=1000 | | | | | 1.00 | 1.588 | 15 | 1.538 | 1.588 | 1.640 | 0.085 | G1 ON |
| | V1= | 1.04 | 1.06 | 1.08 | | | | | | | | |
| R10=1000 | | | | | 1.04 | 0.529 | 5 | 0.513 | 0.529 | 0.547 | 0.028 | G1~G15 OFF |
| | | | 0.00 | | | | | | | | | |

FIG. 26

TOLERANCE 1.01(+1%) 0.99(-1%) a=18[V] R1=7.5kΩ R2=2.4kΩ R3=7.5kΩ R4=1.5kΩ

| | MIN | TYP | MAX |
|---|---|---|---|
| REDUCED PRESSURE | 4.146 | 4.125 | 4.063 |
| AMPLIFICATION FACTOR | 5.901 | 6.000 | 6.101 |

| Ω | | MIN | TYP | MAX | DIFFERENCE | n=SET VALUE | m=TYP | n=MIN | n=TYP | n=MAX | WIDTH OF n | BLANK LAMP LIGHTING STATE |
|---|---|---|---|---|---|---|---|---|---|---|---|---|
| | | | 18.00 | | | | | | | | | |
| R26=4700 | | | | | 2.00 | 16.983 | 165 | 16.451 | 16.983 | 17.532 | 0.912 | G1~G15 OFF |
| | V16= | 15.93 | 15.97 | 16.00 | | | | | | | | |
| R25=4300 | | | | | 1.76 | 15.036 | 146 | 14.565 | 15.036 | 15.522 | 0.808 | G1~G15 ON |
| | V15= | 14.04 | 14.11 | 14.17 | | | | | | | | |
| R24=3900 | | | | | 1.55 | 13.262 | 129 | 12.847 | 13.262 | 13.691 | 0.712 | G1~G14 ON |
| | V14= | 12.34 | 12.42 | 12.49 | | | | | | | | |
| R23=3600 | | | | | 1.39 | 11.639 | 113 | 11.275 | 11.639 | 12.016 | 0.625 | G1~G13 ON |
| | V13= | 10.77 | 10.86 | 10.95 | | | | | | | | |
| R22=3300 | | | | | 1.25 | 10.147 | 99 | 9.829 | 10.147 | 10.475 | 0.545 | G1~G12 ON |
| | V12= | 9.34 | 9.43 | 9.52 | | | | | | | | |
| R21=3000 | | | | | 1.12 | 8.784 | 86 | 8.508 | 8.784 | 9.068 | 0.472 | G1~G11 ON |
| | V11= | 8.05 | 8.13 | 8.22 | | | | | | | | |
| R20=2700 | | | | | 0.99 | 7.550 | 74 | 7.314 | 7.550 | 7.795 | 0.406 | G1~G10 ON |
| | V10= | 6.88 | 6.97 | 7.05 | | | | | | | | |
| R19=2400 | | | | | 0.87 | 6.447 | 63 | 6.245 | 6.447 | 6.655 | 0.346 | G1~G9 ON |
| | V9= | 5.85 | 5.93 | 6.01 | | | | | | | | |
| R18=2200 | | | | | 0.80 | 5.452 | 53 | 5.281 | 5.452 | 5.628 | 0.293 | G1~G8 ON |
| | V8= | 4.90 | 4.98 | 5.05 | | | | | | | | |
| R17=2000 | | | | | 0.73 | 4.543 | 44 | 4.401 | 4.543 | 4.690 | 0.244 | G1~G7 ON |
| | V7= | 4.05 | 4.11 | 4.17 | | | | | | | | |
| R16=1800 | | | | | 0.66 | 3.721 | 36 | 3.605 | 3.721 | 3.841 | 0.200 | G1~G6 ON |
| | V6= | 3.28 | 3.33 | 3.39 | | | | | | | | |
| R15=1600 | | | | | 0.59 | 2.986 | 29 | 2.892 | 2.986 | 3.082 | 0.160 | G1~G5 ON |
| | V5= | 2.59 | 2.64 | 2.68 | | | | | | | | |
| R14=1500 | | | | | 0.57 | 2.315 | 23 | 2.242 | 2.315 | 2.390 | 0.124 | G1~G4 ON |
| | V4= | 1.96 | 1.99 | 2.03 | | | | | | | | |
| R13=1300 | | | | | 0.50 | 1.709 | 17 | 1.656 | 1.709 | 1.764 | 0.092 | G1~G3 ON |
| | V3= | 1.40 | 1.43 | 1.45 | | | | | | | | |
| R12=1200 | | | | | 0.48 | 1.168 | 11 | 1.132 | 1.168 | 1.206 | 0.063 | G1~G2 ON |
| | V2= | 0.89 | 0.91 | 0.93 | | | | | | | | |
| R11=1100 | | | | | 0.45 | 0.671 | 7 | 0.650 | 0.671 | 0.692 | 0.036 | G1 ON |
| | V1= | 0.42 | 0.43 | 0.44 | | | | | | | | |
| R10=1000 | | | | | 0.42 | 0.216 | 2 | 0.210 | 0.216 | 0.223 | 0.012 | G1~G15 OFF |
| | | | 0.00 | | | | | | | | | |

| [Ω] | TYP[V] | [V] | [Ω] | TYP[V] | [V] |
|---|---|---|---|---|---|
| | 18.000 | | | 18.000 | |
| R20' =1000 | | 1.636 | R26' =1000 | | 1.059 |
| | $v_{10}$ = 16.364 | | | $v_{16}$ = 16.941 | |
| R19' =1000 | | 1.636 | R25' =1000 | | 1.059 |
| | $v_9$ = 14.727 | | | $v_{15}$ = 15.882 | |
| R18' =1000 | | 1.636 | R24' =1000 | | 1.059 |
| | $v_8$ = 13.091 | | | $v_{14}$ = 14.824 | |
| R17' =1000 | | 1.636 | R23' =1000 | | 1.059 |
| | $v_7$ = 11.455 | | | $v_{13}$ = 13.765 | |
| R16' =1000 | | 1.636 | R22' =1000 | | 1.059 |
| | $v_6$ = 9.818 | | | $v_{12}$ = 12.706 | |
| R15' =1000 | | 1.636 | R21' =1000 | | 1.059 |
| | $v_5$ = 8.182 | | | $v_{11}$ = 11.647 | |
| R14' =1000 | | 1.636 | R20' =1000 | | 1.059 |
| | $v_4$ = 6.545 | | | $v_{10}$ = 10.588 | |
| R13' =1000 | | 1.636 | R19' =1000 | | 1.059 |
| | $v_3$ = 4.909 | | | $v_9$ = 9.529 | |
| R12' =1000 | | 1.636 | R18' =1000 | | 1.059 |
| | $v_2$ = 3.273 | | | $v_8$ = 8.471 | |
| R11' =1000 | | 1.636 | R17' =1000 | | 1.059 |
| | $v_1$ = 1.636 | | | $v_7$ = 7.412 | |
| R10' =1000 | | 1.636 | R16' =1000 | | 1.059 |
| | 0.000 | | | $v_6$ = 6.353 | |
| | | | R15' =1000 | | 1.059 |
| | | | | $v_5$ = 5.294 | |
| | | | R14' =1000 | | 1.059 |
| | | | | $v_4$ = 4.235 | |
| | | | R13' =1000 | | 1.059 |
| | | | | $v_3$ = 3.176 | |
| | | | R12' =1000 | | 1.059 |
| | | | | $v_2$ = 2.118 | |
| | | | R11' =1000 | | 1.059 |
| | | | | $v_1$ = 1.059 | |
| | | | R10' =1000 | | 1.059 |
| | | | | 0.000 | |

FIG. 39

(PRIOR ART)

LIGHT EMITTING ELEMENT CONTROL DEVICE, OPTICAL SENSOR CONTROL DEVICE AND BLANK LAMP CONTROL DEVICE

FIELD OF THE INVENTION

The present invention relates to a light emitting element control device, such as an optical sensor control device, a blank lamp control device, etc., for appropriately driving a light emitting element by a D/A conversion output of a CPU (Central Processing Unit).

BACKGROUND OF THE INVENTION

There are below-discussed known light emitting element control devices.

As shown in FIG. 33, a light emitting element control device disclosed by ① Japanese Unexamined Patent Application No. 167139/1989 (Tokukaihei 1-167139) includes an amplifier 50, a light emitting element 51, a light receiving element 52, an A/D converter 53, a CPU 54, and a D/A converter 55. The light emitting element 51 and the light receiving element 52 constitute an optical sensor, and by a control voltage signal to be output through the D/A converter 55 from the CPU 54, an amount of light emitted from the light emitting element 51 is adjusted. On the other hand, the light receiving element 52 detects an amount of light emitted from the light emitting element 51, and after the amount of light is amplified by the amplifier 50, it is inputted to the CPU 54 through the A/D converter 53. The CPU 54 adjusts a control voltage signal value of the D/A converter 55 so that the amount of light falls in a range of from a predetermined upper limit value to a predetermined lower limit value. As a result, the described control device controls the light emitting element.

As shown in FIG. 34, the light emitting element control device disclosed by ② Japanese Unexamined Patent Application No. 271025/1992 (Tokukaihei 4-271025) includes a CPU 56, a laser diode 57, a D/A converter 58, a driving circuit 59 for a laser diode 57, a pin monitor 60, an A/D converter 61 and a variable circuit 62.

The laser diode 57 is arranged so as to emit light in accordance with a light amount indicative value. The light amount indicative value is output from the CPU 56, and is sent to a driving circuit 59 through the D/A converter 58. On the other hand, an amount of light emitted from the laser diode 57 is detected by the pin monitor 60, and a detected amount of light is inputted to the CPU 56 via the A/D converter 61. The CPU 56 calculates a difference between the light amount indicative value and a currently detected amount of light, and the light amount indicative value is adjusted by an APC (auto/power/control) circuit. Here, in order to maintain the control precision of the APC high, an operational amplifier 62*a* included in the variable circuit 62 varies a gain of the detection signal detected by the pin monitor 60, and a value of a signal output from the pin monitor 60 varies in response to a change in gain to be output to the A/D converter 61. As a result, the described control device controls the light emitting element.

③ Japanese Unexamined Patent Application No. 1674/1992 (Tokukaihei 4-1674) discloses a light emitting element control device designed for a blank lamp control device provided in a copying machine. The blank lamp is provided for removing charges from a non-image-forming area on a drum-shaped photoreceptor in the case of carrying out a copying operation in a reduced size or in a frame elimination mode. For example, in a single sided copying machine, as shown in FIG. 35, the blank lamp 63 is provided facing the photoreceptor drum 68 so as to remove only charges of a so-called out of maximum image area (slashed line), i.e., an area obtained by subtracting the maximum image area B to which an image is copied from the drum width A of the photoreceptor drum 68.

The above-mentioned reference ③ discloses a control device for a blank lamp 63, wherein the PWM signal (pulse width modulation signal) output from control means 64 is used as a control voltage signal for the blank lamp 63 in an integrating circuit 65, and 10 blank lamps 63 (63*a*~63*j*) are controlled to be lighted up by the control voltage signal as shown in FIG. 36.

Specifically, as shown in FIG. 37, by setting the pulse width of the PWM signal set in a predetermined interval into 10 levels, a lighting control of 10 lamps is permitted. To be more specific, the PWM signals are set by inputting 10 pulse widths in the register section in the control means 64, and are output from the PWM signal generation port in the control means 64.

The PWM signal transmitted from the control means 64 is sent to the integrating circuit 65 shown in FIG. 36, and by passing through the integrating circuit 65, the PWM signal is converted into the voltage signal which linearly varies in response to the pulse width. Then, the voltage signal is inputted to the lamp driving circuit section 66, and the blank lamps 63 in the same number as the inputted voltage signals light up.

The lamp driving circuit section 66 includes 10 circuits. Each circuit is arranged such that the comparative amplifiers 67 (67*a*–67*j*), and the blank lamps 63 (63*a*–63*j*) composed of LED (Light Emitting Diode), etc., are connected in series respectively. To a positive terminal of each comparative amplifier 67, a control voltage signal converted by the integrating circuit 65 is applied, and to a negative terminal of each comparative amplifier 67, a reference voltage v is applied. The reference voltage v is calculated based on a relationship between a pulse width of the PWM signal (converted into a duty ratio) and an output voltage $V_0$ of the control voltage signal. Then, the power source voltage $V_{cc}$ divided by the resistor in accordance with a level of a required output voltage $V_0$ (from $V_1$ to $V_{10}$) for lighting on 10 blank lamps 63.

In the case of carrying out an equivalent size copying, as the PWM signal is not generated, any of the blank lamps 63 does not light on. However, for example, in the case of outputting the PWM signal of level 1 having a minimum pulse width shown in FIG. 37, a control voltage signal, i.e., an output voltage $V_1$ shown in FIG. 38 is inputted to the lamp driving circuit section 66, and only the blank lamp 63*a* lights on. Thereafter, according to a pulse width level of the PWM signal, blank lamps 63*b* through 63*j* light on accordingly. For example, when carrying out a copying operation with a reduced copy size from B-4 size to B-5 size, the magnification is 70 percent (50 percent in area), and the pulse width of the PWM signal corresponds to the maximum level 10. Therefore, the control voltage signal of the output voltage $V_{10}$ is inputted to the lamp driving circuit section 66, and all of the 10 blank lamps (63*a* through 63*j*) light on.

However, both the optical sensor control device of the reference ① or the APC circuit of the reference ② require an A/D converter in a path for feeding back a detected output of the light receiving element and the pin monitor to the CPU, and the operation voltage of the light receiving element and the pin monitor are set to the power source voltage (5V) of the CPU, or as the amplifier 50 or the operation amplifier 62*a* shown in FIG. 33 and FIG. 34, an amplifying/attenuating circuit, etc., is provided on the light receiving side, and the output voltage is required to be set equivalent to the power source voltage.

On the other hand, in the control device of the blank lamp in the reference ③, the number of blank lamps indicates a number of groups of blank lamps classified in such a manner that lamps in each group light up simultaneously and lamps in different groups light up at different timing. As the number of groups increases, a lighting control cannot be performed stably without adopting resistors of high precision in the previous circuit to the control voltage signal generating circuit.

The described conventional arrangement is designed for controlling the lighting of the blank lamps of at most 10 groups, and thus only 10 kinds of reference voltages $v_1$ through $v_{10}$ are required for the comparative amplifier 67 of the lamp driving circuit section 66 shown in FIG. 36, and a difference in voltage between the reference voltages (between $v_1$ and $v_2$, and between $v_2$ and $v_3$ . . . ) is around 1.6 (V) as shown in Table 39. Here, the power source voltage $V_{cc}$ before being divided by the resistor is 18 (V).

However, when the described conventional arrangement is applied for controlling the lighting of more than 10 groups, for example, 15 groups, and for controlling lighting off of all the lamps in the 15 groups, 16 kinds of the reference voltages $v_1$ through $v_{16}$ are required for the comparative amplifier 67, and a difference between the reference voltages (between $v_1$ and $v_2$, and between $v_2$ and $v_3$, . . . ) becomes smaller (around 1.1 (V)).

As the difference in voltage between the reference voltages becomes smaller, in order to stably control a lighting of the blank lamp 63 with a comparative output from the comparative amplifier 67, an error of the output voltage $V_0$ is required to be set small. This requires a high precision resistor, etc., which causes an increase in cost.

SUMMARY OF THE INVENTION

An object of the present invention is to control a lighting of a plurality of light emitting elements without requiring a high precision circuit element.

In order to achieve the above object, a light emitting element control device in accordance with the present invention is characterized by including a control circuit having a D/A converter stored therein; an amplifier for amplifying an output of the D/A converter to be output as a control signal for emitting each light emitting element; a reference voltage generating circuit for generating a reference voltage; and a comparator for comparing the control signal with the reference voltage, wherein the control circuit adjusts an output of the D/A converter based on a result of comparison by the comparator, and each output of the D/A converter is reset so that each light emitting element appropriately emits light based on the adjusted output.

By preparing a control device for controlling an optical sensor, a blank lamp, etc., using the described arrangement, the above-mentioned problems can be solved in the following manner.

The optical sensor control device outputs from a control circuit having a D/A converter stored therein, a signal for controlling an amount of light emitted from the light emitting element of an optical sensor which includes the light emitting element and a light receiving element for outputting a sensor voltage that varies according to the amount of received light. The optical sensor control device includes a reference voltage generating circuit for generating a reference voltage and a comparator for comparing the sensor voltage with the reference voltage, wherein the control circuit resets a voltage of the output signal so as to emit light with an appropriate amount of light emitted from the light emitting element based on a result of comparison of the comparator.

According to the described arrangement, the comparator compares the sensor voltage with the reference voltage, and, for example, generates a result of comparison in a form of binary value indicative of either low level or high level, to be fed back, for example, to the CPU serving as a control circuit. In the CPU, depending on the binary value indicative of the result of comparison, the output value is increased or decreased to be adjusted repetitively to be set to a voltage value which permits an appropriate amount of light of the light emitting element.

Therefore, by using the binary value indicative of the result of comparison by the comparator, unlike the conventional arrangement, it is not necessary that the A/D converter is provided in a path for feeding back a detection output to the CPU. Additionally, the comparison output from the comparator is not affected by the power source voltage of the CPU (5V), special amplifying/attenuating circuits are not required on the light receiving side, and the comparison output from the comparator can determine the sensor voltage directly.

The blank lamp control device having the described arrangement includes: a control circuit having a D/A converter for outputting a signal for use in setting a voltage in multiple gradation according to the lighting state of the blank lamp based on the reference voltage; an amplifying circuit for amplifying an output from the D/A converter and outputting the control voltage signal; a reference voltage generating circuit for generating the blank lamp reference voltage; and a comparator for comparing the control voltage signal with the blank lamp reference voltage, wherein the control circuit varies an output from the D/A converter based on a comparative output of the comparator, and adjusts a reference voltage that is the output of the D/A converter which makes the control voltage signal with the blank lamp reference voltage by varying an output of the D/A converter based on the comparative output of the comparator so as to reset each voltage in multiple gradation based on the basic voltage.

According to the described arrangement, the comparator compares the voltage value of the control voltage signal obtained by amplifying the output signal, for example, from the CPU serving as the control circuit with the blank lamp reference voltage, and generates a binary comparative output indicative of either low level or high level to be fed back to the CPU. In the CPU, depending on the binary comparative output, the output voltage is increased or decreased repetitively to be adjusted, and the basic voltage of the output signal at which the voltage of the control voltage signal is equivalent to the blank lamp reference voltage, and each voltage value in multiple gradation is reset so as to control the lighting state of the blank lamp.

In the conventional control device of the blank lamp, high-precision voltage dividing resistors are required in the amplifying circuit, in order to stably control the lighting state of the blank lamps in 15 groups. In contrast, the present invention permits each voltage value of the multiple gradation to be adjusted to its resistor even when adopting the low-precision resistors. Therefore, the described arrangement is improved from the conventional arrangement, by enabling the blank lamps in a plurality of groups to be stably controlled with an inexpensive structure adopting low-precision resistors, etc.

For a fuller understanding of the nature and advantages of the invention, reference should be made to the ensuing detailed description taken in conjunction with the accompanying drawings.

BRIEF DESCRIPTION OF THE DRAWINGS

FIG. 3(*b*) is an explanatory view showing a relationship between a blank lamp and an irradiation with light onto a photoreceptor drum;

FIG. 5 is a table which shows a divided reference voltage, a voltage of a control signal, a voltage of a CPU output signal, a number of ranges and the lighting state of the corresponding blank lamps respectively at each point in the circuit of FIG. 1;

FIG. 6 is a table which shows changes in data with regard to, a CPU reference voltage at which a voltage of the control signal=blank lamp reference voltage, a number of ranges, and a basic voltage in the circuit of FIG. 1 due to a change in resistance tolerance;

FIG. 9 is a table which shows a voltage of a control signal, a voltage of the CPU output signal and a number of ranges respectively at each point in the case where the resistance of the attenuating circuit has an error of 5 percent, and a basic voltage of the CPU is increased with respect to the conditions shown in the table of FIG. 5;

FIG. 10 is a table which shows a voltage of a control signal, a voltage of the CPU output signal and a number of ranges respectively at each point in the case where the resistance of the attenuating circuit has an error of 5 percent, and a reference voltage of the CPU is dropped with respect to the conditions shown in the table of FIG. 5;

FIG. 11 is a table which shows a voltage of a control signal, a voltage of the CPU output signal and a number of ranges respectively at each point in the case where the resistance of the amplifying circuit has an error of 5 percent, and a voltage of the control signal is increased with respect to the conditions shown in the table of FIG. 5;

FIG. 12 is a table which shows a voltage of a control signal, a voltage of the CPU output signal and a number of ranges respectively at each point in the case where the resistance of the amplifying circuit has an error of 5 percent, and a voltage of the control signal is dropped with respect to the conditions shown in the table of FIG. 5;

FIG. 13 is a table which shows a voltage of a control signal, a voltage of the CPU output signal and a number of ranges respectively at each point in the case where a reference voltage of the blank lamp output from the reference voltage generating circuit is increased by 10 percent with respect to the conditions shown in the table of FIG. 5;

FIG. 14 is a table which shows a voltage of a control signal, a voltage of the CPU output signal and a number of ranges respectively at each point in the case where a reference voltage of the blank lamp generated from the reference voltage generating circuit is dropped by 10 percent with respect to the conditions shown in the table of FIG. 5;

FIG. 15 is a table which shows a voltage of a control signal, a voltage of the CPU output signal and a number of ranges respectively at each point in the case where a reference voltage of the blank lamp is increased by 10 percent and the attenuating circuit has a resistance having an error of 5 percent, and an amplifying circuit has a resistance having an error of 5 percent, which causes an increase in not only the reference voltage of the CPU but also the voltage of the control signal with respect to the conditions shown in the table of FIG. 5;

FIG. 16 is a table which shows a voltage of a control signal, a voltage of the CPU output signal and a number of ranges respectively at each point in the case where a reference voltage of the blank lamp is dropped by 10 percent and the attenuating circuit has a resistance having an error of 5 percent, and an amplifying circuit has a resistance having an error of 5 percent, which causes a drop in not only the reference voltage of the CPU but also the voltage of the control signal with respect to the conditions shown in the table of FIG. 5;

FIG. 17 is a table which shows a voltage of a control signal, a voltage of the CPU output signal and a number of ranges respectively at each point in the case where a CPU reference voltage is inputted from an external power source with respect to the conditions shown in the Table of FIG. 5;

FIG. 18 is a table which shows a voltage of a control signal, a voltage of the CPU output signal and a number of ranges respectively at each point in the case where a CPU reference voltage is inputted from an external power source with respect to the conditions shown in the Table of FIG. 13;

FIG. 19 is a table which shows a voltage of a control signal, a voltage of the CPU output signal and a number of ranges respectively at each point in the case where a CPU reference voltage is inputted from an external power source with respect to the conditions shown in the Table of FIG. 14;

FIG. 25 is a table which shows a voltage, a number of ranges m, a divided reference voltage and a lighting state of the blank lamps respectively at each point when all the reference voltage dividing resistors are 1 kΩ in the circuit of FIG. 1;

FIG. 26 which shows a still another embodiment of the present invention is a table showing a voltage of a control signal, a number of ranges m, a divided reference voltage and a lighting state of blank lamps respectively at each point when the reference voltage dividing resistance is set according to variations in voltage, resistance variation, etc. in the circuit of FIG. 1;

FIG. 29(*b*) is a circuit diagram of a control device of a light emitting/receiving sensor in accordance with another embodiment of the present invention;

FIG. 39 is a table which shows respective divided reference voltages resulting from dividing a reference voltage (18V) and differences between the divided reference voltages in 10 modes or 16 modes.

DESCRIPTION OF THE PREFERRED EMBODIMENTS

EMBODIMENT 1

The following explanations will explain one embodiment of the present invention in reference to FIG. 1 through FIG. 19. In the present embodiment, explanations will be given through the case where a light emitting element control device of the present invention is applied to a blank lamp control device provided in a copying machine.

First, the structure of an image forming processing section in the copying machine adopting a blank lamp control device and an image forming processing operation will be explained with reference to FIG. 2.

Figure 2:
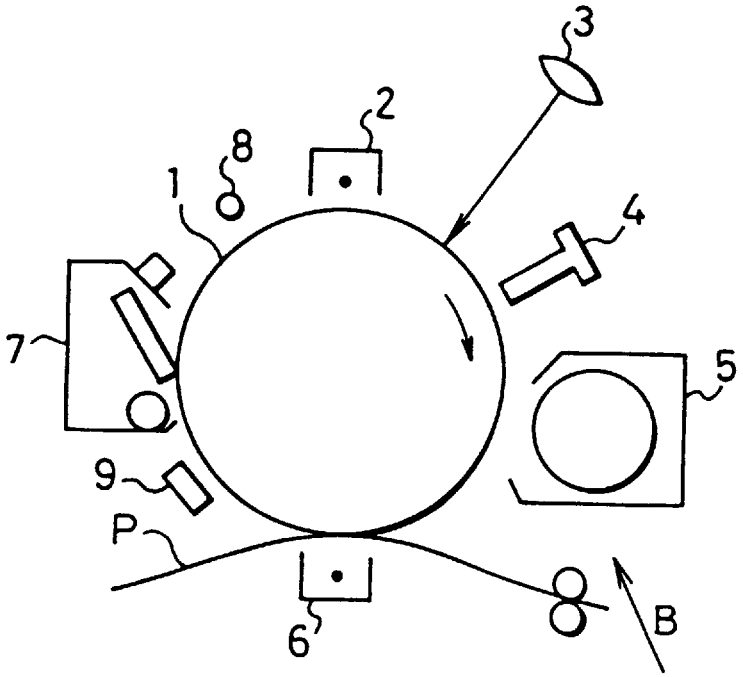
FIG. 2 is a cross-sectional view illustrating a structure of an image processing section around a photoreceptor drum of the copying machine.

As shown in FIG. 2, the copying machine of the present embodiment includes a cylindrical photoreceptor drum 1 serving as a photoreceptor, and a main charger 2, an exposure unit 3, a blank lamp unit 4, a developer unit 5, a transfer charger 6, a light emitting/receiving sensor 9, a cleaning unit 7 and a charge removing lamp 8 which are provided around the outer surface of the photoreceptor drum 1.

The main charger 2 is provided for uniformly charging the surface of the photoreceptor drum 1 by a minus corona discharge. Although not shown, the exposure unit 3 is composed of a copy lamp, a plurality of mirrors, and a lens. The exposure unit 3 is provided for forming an electrostatic latent image on a surface of the photoreceptor drum 1 which is uniformly charged by the main charger 2 by focusing thereon an optical image according to an image pattern of the document. The blank lamp unit 4 includes a plurality of blank lamps (not shown), and is arranged so as to emit light onto the document on the surface of the photoreceptor drum 1 so as to remove the charges on a non-image-forming area. This blank lamp unit 4 will be explained in detail later.

The developer unit 5 supplies toner to the surface of the photoreceptor drum 1, and the toner is attracted to an electrostatic latent image formed on the surface, thereby forming a visible image. The transfer charger 6 is provided for transferring the visible image on the photoreceptor drum 1 onto a transfer sheet P by applying thereto a corona discharge. Here, the transfer charger 6 performs the corona discharge in the same polarity as that of the main charger 2 (minus in this case). The cleaning unit 7 is provided for removing and collecting the residual toner remaining on the surface of the photoreceptor drum 1. The charge removing lamp 8 is provided for erasing a potential remaining on the surface of the photoreceptor drum 1 by projecting thereon light. The light emitting/receiving sensor 9 is provided for detecting a mark (not shown) formed on the surface of the photoreceptor drum 1 and for detecting if the photoreceptor drum 1 is set properly.

In the described arrangement, an image forming operation is carried out in the following processes. First, the copying machine of the present embodiment applies negative charges on an entire surface of the photoreceptor drum 1 by performing a minus corona discharge by the main charger 2. Next, by the exposure unit 3, an optical image is focused on the photoreceptor drum 1 according to an image pattern of the document. Here, as a resistance value of the irradiated portion with light is reduced, negative charges are removed therefrom, thereby forming an electrostatic latent image on the surface of the photoreceptor drum 1. In the case of performing a copying operation in a reduced size, charges in the non-image forming area on the surface of the photoreceptor drum 1 are removed by the blank lamps of the blank lamp unit 4.

Subsequently, the toner is attracted onto the electrostatic latent image formed on the surface of the photoreceptor drum 1 by the developer unit 5 in the copying machine of the present embodiment. As a result, the electrostatic latent image is formed into a visible image, and the resulting visible image on the photoreceptor drum 1 is transferred onto a sheet P being transported in a transfer timing by the transfer charger. The sheet whereon an image has been transferred is transported to a fuser (not shown), where the image is permanently affixed thereto under applied heat and pressure, and is discharged onto a discharge tray (not shown).

On the other hand, after the transfer, the residual toner remaining on the photoreceptor drum 1 is removed by the cleaning unit 7, and charges remaining on the photoreceptor drum 1 are removed by the charge removing lamp 8. As a result, the first image forming process is completed to be ready for the next copying operation.

Next, explanations on the blank lamp unit 4 for removing charges from the non-image forming area on the surface of the photoreceptor drum 1 will be explained.

To begin with, the structure of the blank lamp unit 4, and the lighting operation of the blank lamp will be explained.

Figures 3A, 3B:
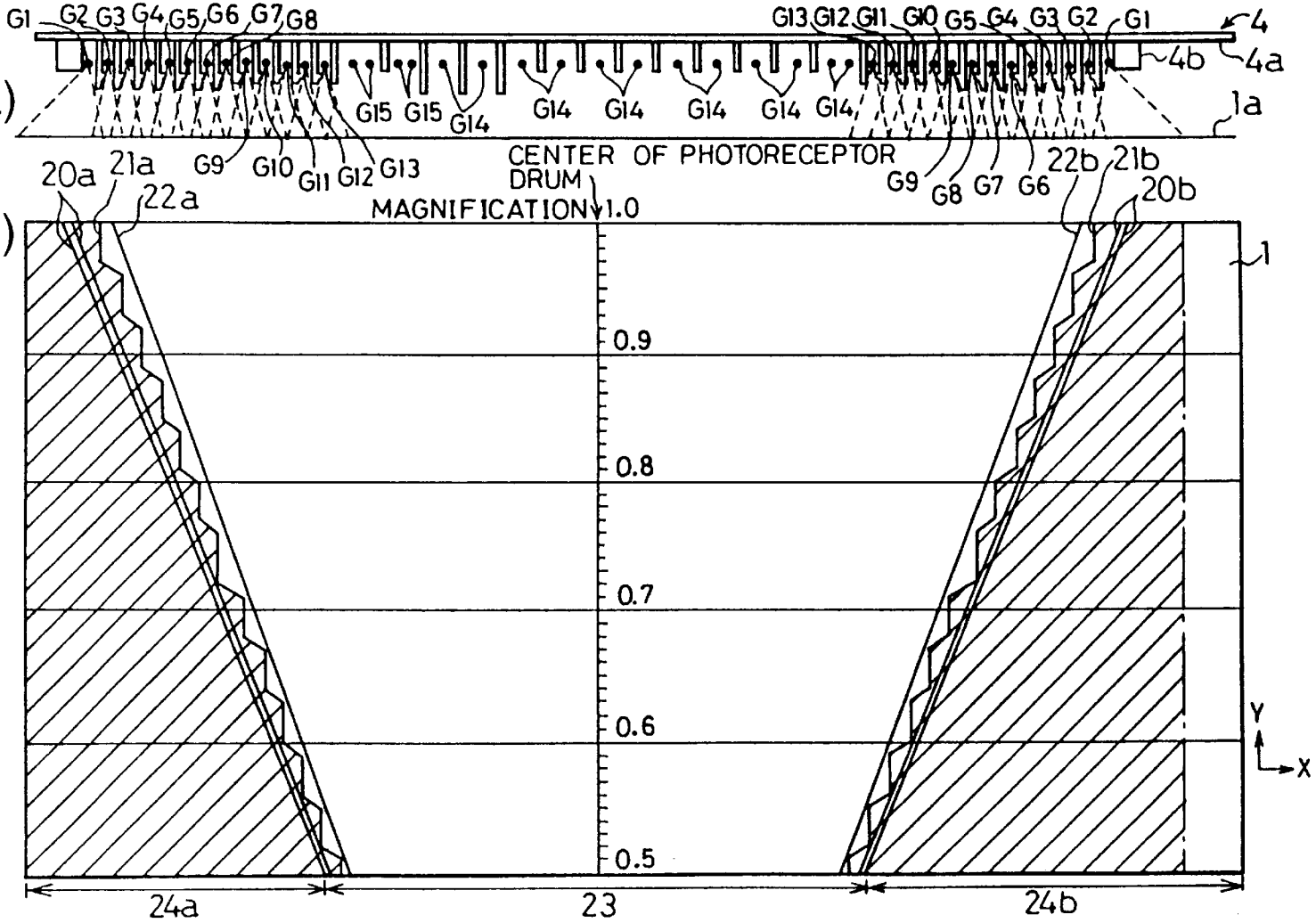
FIG. 3(*a*) is an explanatory view showing a structure of a blank lamp unit equipped with blank lamps.

The blank lamp unit 4 of the copying machine of the present embodiment is composed of a plurality of blank lamps aligned on an entire surface of the photoreceptor drum 1 in an axial direction. The blank lamp unit 4 is arranged so as to project light for removing charges not only onto the maximum non-image-forming area but also onto an entire surface of the photoreceptor drum 1 in its axial direction. FIG. 3(*a*) is a view illustrating the blank lamp unit 4 and the photoreceptor drum 1 taken in the B direction in FIG. 2. In the figure, the light emitting point of the blank lamp G (G1 through G15) is shown by •.

As shown in the figure, the blank lamp unit 4 includes a substrate 4*a* which is provided in such a manner that the lengthwise direction thereof corresponds to the axial direction of the photoreceptor drum 1. To the substrate 4*a,* a plurality of blank lamps G composed of, for example, LEDs (Light Emitting Diodes) are mounted via a lamp holder 4*b* having a teeth-shaped cross section. In the blank lamp unit 4, the blank lamps G are provided in a total number of 42. As the blank lamps G are classified into 15 groups (G1 through G15) in such a manner that the blank lamps G in each group are controlled on/off simultaneously.

The width of the light emitted from the light emitting point from each blank lamp G is adjusted by the lamp holder 4*b*. By a relationship between the width of the emitted light shown by a short dashed line and the drum surface 1*a*, when carrying out a copying operation in a reduced-size, the blank lamp G to be lighted depending on the magnification is determined in the following manner.

In FIG. 3(*b*), Y direction indicates the magnification of copying (1.0 through 0.5 times), and X direction indicates a width of the photoreceptor drum 1 in an axial direction. In the figure, an interval between the line 22*a* and the line 22*b* indicates the width of an image to be formed on the photoreceptor drum 1 when carrying out a reduce-size copy on A4-size document at each magnification, wherein the smaller is the magnification with respect to the equivalent size, the narrower is the interval between the line 22*a* and line 22*b* (a half of the width of A4-size at 0.5 times).

On the other hand, an interval between the lines 20*a* and 20*b* shown in the figure indicates a width of an original cover formed on the photoreceptor drum 1, wherein the lower is the magnification, the narrower is the interval between the lines 20*a* and 20*b*. In this case, in consideration of an error in setting the original cover, two lines are drawn for each of the lines 20*a* and 20*b* respectively.

From the figure, in the case of carrying out a reduced-size copying operation, an image is formed on the photoreceptor drum 1 between the lines 22*a* and 22*b* at each magnification. Then, upon projecting light between the lines 22*a* and 22*b,* the image formed on the photoreceptor drum 1 disappears. On the other hand, when carrying out a reduced-size copying operation on an A4-size document, for example, at the magnification of 50 percent, the image is formed in an area 23 on the photoreceptor drum 1, and thus areas 24*a* and 24*b* which are not exposed are formed in black.

Therefore, it is required to light on the blank lamp G so that the boundary line in the irradiated area by the blank lamp G falls between the lines 20*a* and 22*a,* and lines 20*b* and 22*b*. Specifically, in the blank lamp unit 4, the lighting groups are determined, for example, as: the blank lamp G1 (magnification in a range of from 1.0 to 0.97), the blank lamps G1 and G2 (magnification in a range of from 0.96 to 0.93), and the blank lamps G1, G2 and G3 (magnification in a range of from 0.92 to 0.89). The boundary lines of the light irradiated area (shown by the slashed line) by the blank lamp G are the lines 21*a* and 21*b*.

The blank lamps G1 through G14 light on when preparing a toner patch, while the blank lamps G1 through G15 light on when preparing a top margin void and a bottom margin void.

Next, the circuit structure and the circuit operation of controlling the lighting of the blank lamps G will be explained.

Figure 1:
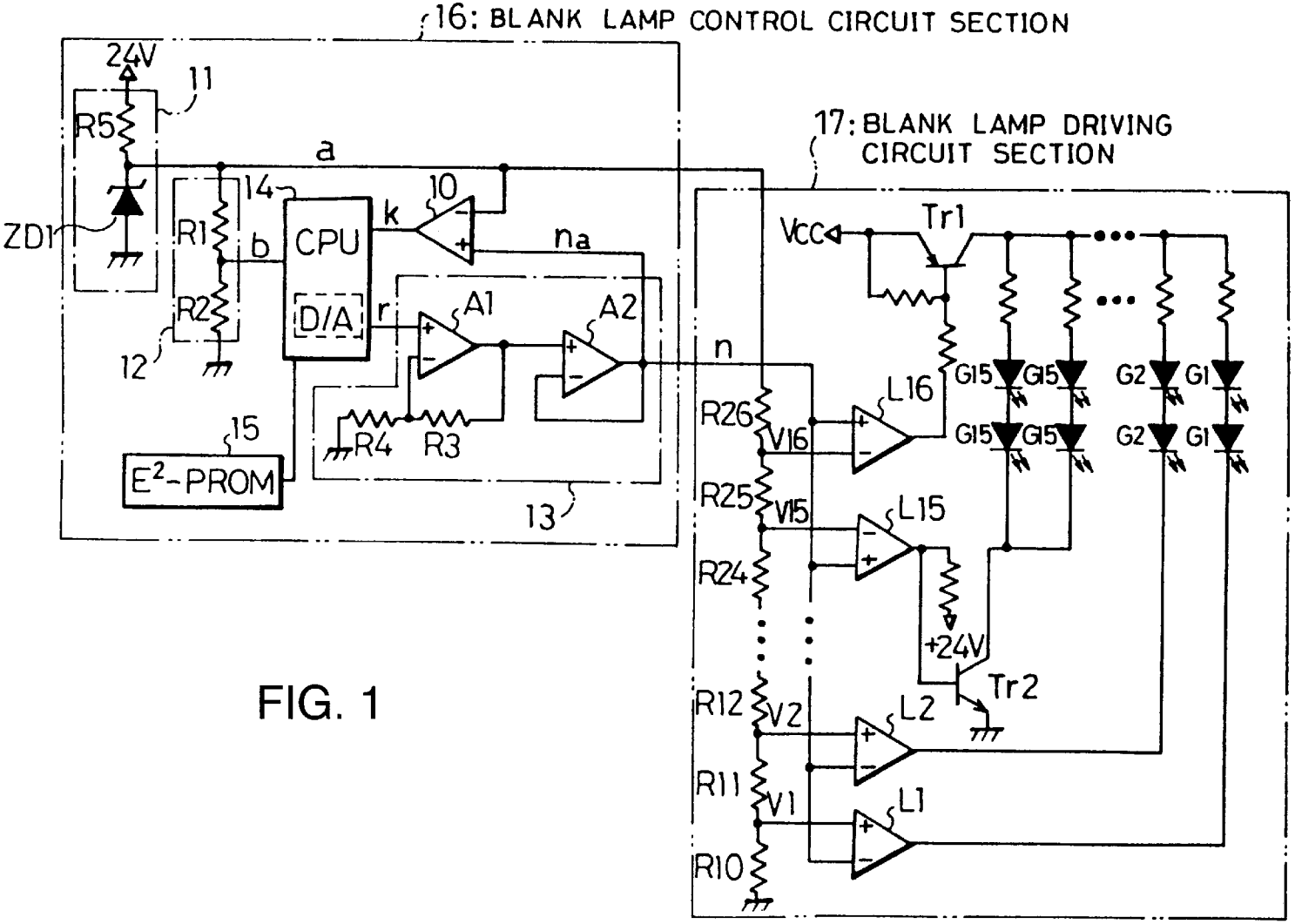
FIG. 1 which shows one embodiment of the present invention is a circuit diagram illustrating a blank lamp control circuit section for controlling a lighting of a blank lamp and a blank lamp driving circuit section in a copying machine.

As shown in FIG. 1, the circuit for lighting on the blank lamps G includes a blank lamp control circuit section 16 (hereinafter simply referred to as a control circuit section), and a blank lamp driving circuit section 17 (hereinafter simply referred to as a driving circuit section).

The control circuit section 16 generates a blank lamp control voltage signal (hereinafter simply referred to as a control signal) n having a voltage value in multiple gradation. The control signal n is output from the control circuit section 16 to the driving circuit section 17. The driving circuit section 17 lights on the blank lamps G of the group corresponding to the voltage value (having a range of from 0 to 25 V) of the control signal n.

To begin with, the control circuit section 16 will be explained. The control circuit section 16 includes a reference voltage generating circuit 11, an attenuating circuit 12, a CPU (control means) 14 with a D/A converter, an amplifying circuit 13, a comparator 10 and an $E^2$PROM 15 (memory means).

The reference voltage generating circuit 11 is composed of a resistor R5 and a voltage regulating diode ZD1, and generates a blank lamp reference voltage a by adjusting the power source voltage (24V in this case). Here, the reference voltage a is set to 18 (V).

The attenuating circuit 12 is composed of two voltage dividing resistors R1 and R2, and generates an analog circuit reference voltage (CPU reference voltage) b obtained by attenuating the reference voltage a generated by the reference voltage generating circuit 11 to be output to the CPU 14. Here, the resistors rated at 7.5 kΩ and 2.4 kΩ are used respectively for the resistors R1 and R2. The attenuating circuit 12 attenuates the reference voltage a to 1/4.125.

The CPU 14 stores the D/A converter, and divides the reference voltage b to be inputted from the attenuating circuit 12 into 255 according to the resolution, and outputs an output signal r of the voltage value of b/255×m according to the number of ranges m set with respect to the D/A converter based on the digital value (0 through 255). In this case, the available output signal r ranges from 0 to 4.125 (V). The CPU 14 has a function of controlling the feedback control of the output signal r. The feedback control will be explained in detail later.

The $E^2$PROM (memory means) 15 is a non-volatile memory, and stores therein data such as the number of ranges m required for outputting an output signal r, i.e., a control signal n having a required voltage according to the light-on state of the blank lamp G. The content in the $E^2$PROM 15 is renewed according to the adjustment of the voltage adjustment by the feedback control of the CPU 14.

The amplifying circuit 13 includes two operational amplifiers A1 and A2, and the voltage dividing resistors R4·R3. The amplifying circuit 13 is provided for amplifying the output signal r from the CPU 14 at a predetermined magnification factor to be output to the driving circuit section 17. Here, the resulting amplified output is the control signal n.

For the resistors R3 and R4, those rated at 7.5 kΩ and 1.5 kΩ are adopted respectively. The amplifying circuit 13 6-times amplifies the output signal r from the CPU 14.

The comparator 10 is provided for adjusting the voltage of the output signal r from the CPU 14, and comparing the control signal n from the amplifying circuit 13 with the reference voltage a from the reference voltage generating circuit 11 so as to generate a comparative output k to be fed back to the CPU 14.

Figure 4:
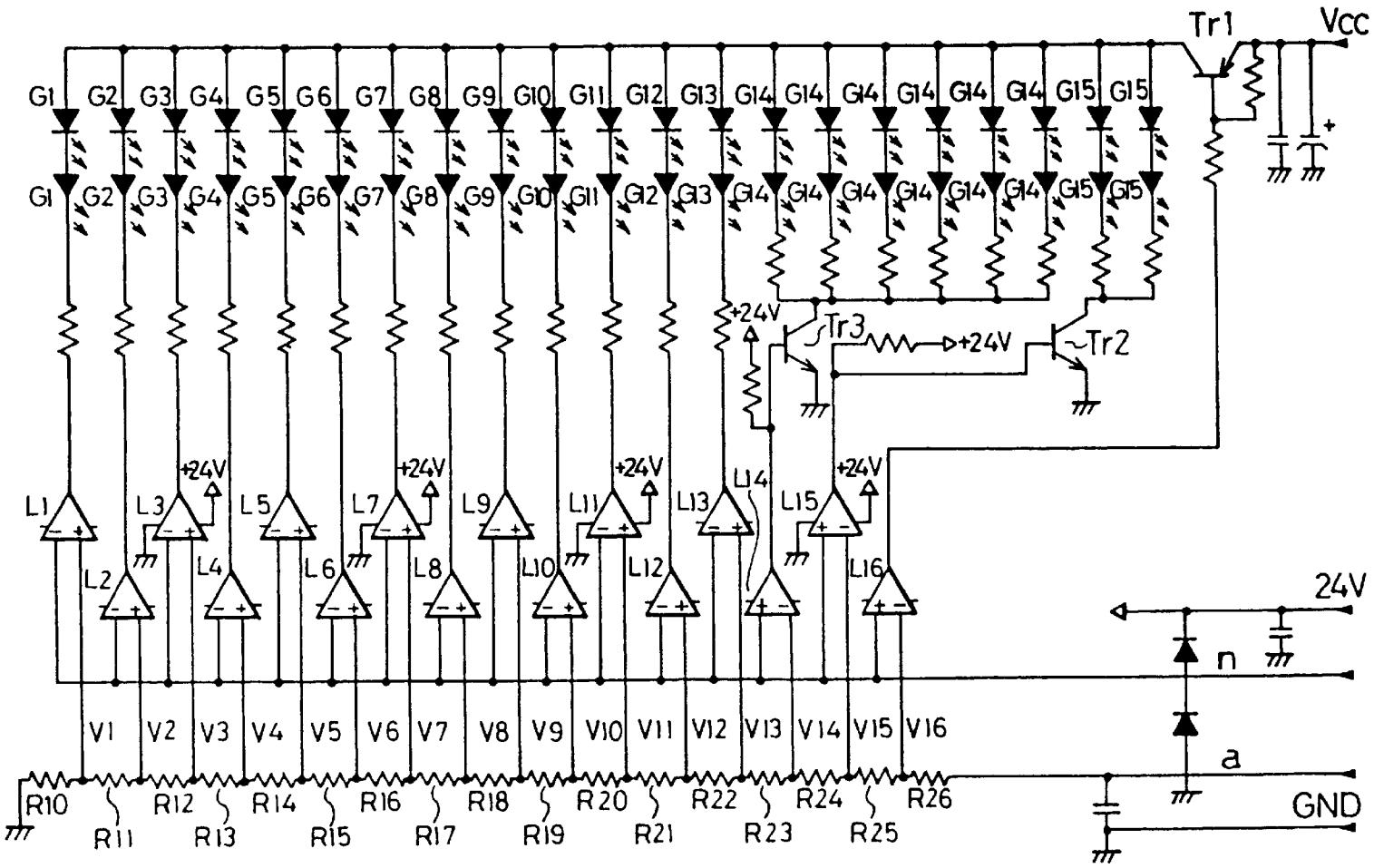
FIG. 4 is a circuit diagram illustrating a circuit structure of the blank lamp driving circuit section in detail.
Figure 7:
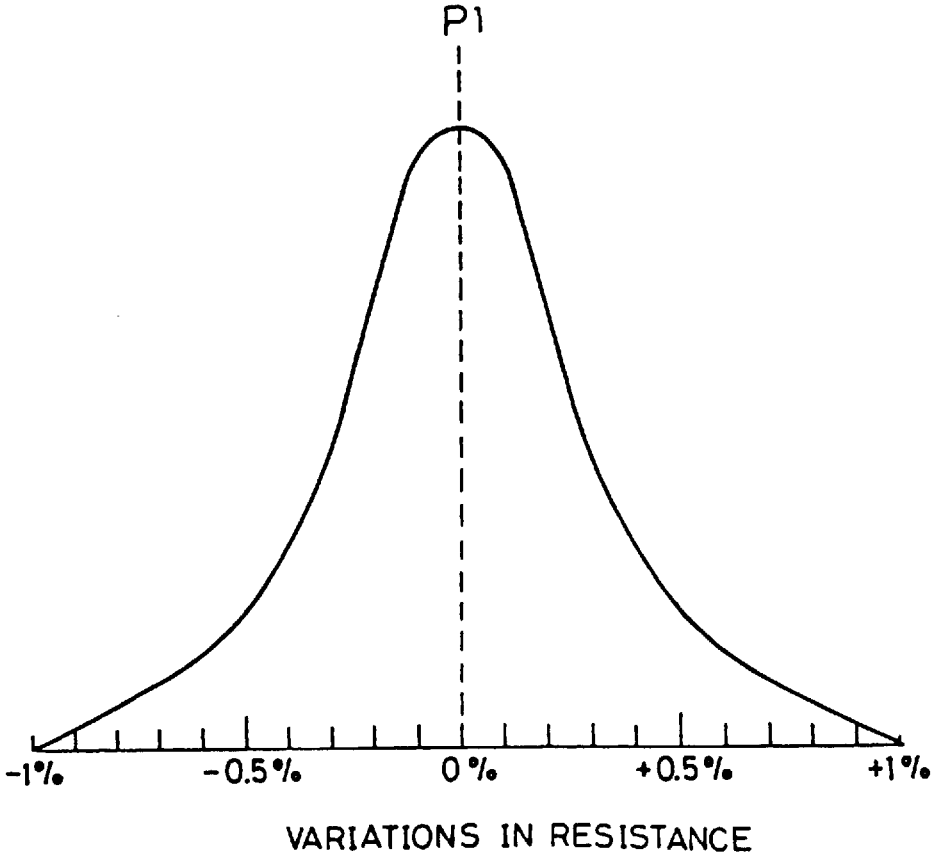
FIG. 7 is a graph of normal distribution which shows resistor variations (estimated value) when a resistance tolerance is ±1 percent.

Next, the driving circuit section 17 will be explained in reference to the detailed diagram of FIG. 4. The driving circuit section 17 is provided for comparing the divided reference voltages V (V1 through V16) obtained by dividing the reference voltage a the resistors R10 through R26 required for lighting on the blank lamps G with the voltage of the control signal n. In the driving circuit section 17, 16 driving-use comparators L for driving the blank lamps G based on a comparative output (L1 through L16) are formed in parallel.

To the output terminals of the comparators L1 through L13, the blank lamps G1 through G13 are connected in series respectively. To the positive terminals of the comparators L1 through L13, the divided reference voltages V1 through V13 are inputted respectively, while to the negative terminals of the comparators L1 through L13, control signals n are inputted respectively. These comparators L1 through L13 output a low level signal when the voltage of the control signal n is larger than the divided reference voltages V1 through V13 so as to light on the blank lamps G1 through G13.

To the output terminals of the comparators L14 and L15, six pairs of the blank lamps G14 and two pairs of blank lamps G15 are connected through NPN type transistors Tr3 and Tr2 in parallel. Each pair of the blank lamps G14 and each pair of the blank lamps G15 have two resisters respectively which are connected in series. To the positive terminals of the comparators V14 and V15, control signals n are inputted, and to the negative terminal, the divided reference voltages V14 and V15 are respectively inputted. The respective emitters of the transistors Tr3 and Tr2 are connected to ground, while to the respective collectors, the blank lamps G14 and G15 are connected. The comparators L14 and L15 output high level signals to respective bases of the transistors Tr3 and Tr2 when the voltage of the control signal n is larger than the respective reference voltages V14 and V15 to turn on the transistors Tr3 and Tr2, thereby lighting on the blank lamps G14 and G15.

To the output terminal of the comparator L16, all the blank lamps G are connected through the PNP type transistor Tr1. To the positive terminal of the comparator L16, the control signal n is inputted to the positive terminal of the comparator, and to the negative terminal, the divided reference voltage V16 is inputted. The emitter of the transistor Tr1 is connected to the power source Vcc, and the collector is connected to all the blank lamps G. The comparator L16 outputs a low level signal to the base of the transistor Tr1 when the voltage of the control signal n is smaller than the divided reference voltage V16, the transistor Tr1 is turned on, and all the blank lamps G are set in the light on state. On the other hand, when the voltage of the control signal n becomes larger, a high level signal is output, and the transistor Tr1 is turned off, and all the blank lamps G are set in the light off state.

Here, resistors of 1 kΩ are adopted for respective resistors R10 through R26 for generating respective divided reference voltages V1 through V16, and thus respective reference voltages V1 through V16 are obtained through the following equations:

$$V1 = 18/17 \times 1 = 1.06\ (V), \quad (1)$$

$$V2 = 18/17 \times 2 = 2.12\ (V), \quad (2)$$

$$V3 = 18/17 \times 3 = 3.18\ (V)$$

$$\vdots$$

$$V14 = 18/17 \times 14 = 14.8\ (V)$$

$$V15 = 18/17 \times 15 = 15.9\ (V)$$

$$V16 = 18/17 \times 16 = 16.9\ (V).$$

In the described driving circuit 17, the voltage of the control signal n for lighting on the blank lamps G is set in the following manner. For example, when turning on only the blank lamp G1, the voltage $n_1$ of the control signal n is set to $V2>n_1>V1$. As a result, only the outputs of the comparators L1 and L16 are set in the low level, and only the blank lamp G1 lights on. Namely, in the case of lighting on only the blank lamp G1, the set voltage $n_1$ is given through the following equation:

$$n_1=(V2+V1)/2 \quad (3)$$

Similarly, the set voltage $n_2$ of the control signal n for lighting on the blank lamps G1 and G2 is given through the following equation:

$$n_2=(V3+V2)/2.$$

The number of ranges m to be set by the D/A converter of the CPU 14 for outputting the set voltage thus obtained is determined as follows.

In the circuit shown in FIG. 1, assumed that the reference voltage a=18 (V), the resistors R1 and R3 are 7.5 kΩ, the resistor R2=2.4 kΩ, and the resistor R4=1.5 kΩ, and the resistors R10 through R26 are set to 1 kΩ.

Then, from the equations (1) and (2), the reference voltage $V_2$ is given as:

$$V2=18/17\times2=2.12\ (V), \text{ and}$$

the reference voltage $V_1$ is given as:

$$V1=18/17\times1=1.06\ (V).$$

Thus, by substituting the respective values into the equation (3), the set voltage $n_1$ is given through the following equation:

$$\begin{aligned} n_1 &= (V2 + V1)/2 \\ &= (2.12 + 1.06)/2 = 1.59\ (V). \end{aligned}$$

Before amplification, the voltage $r_1$ of the output signal r of the CPU 14 required for outputting the set voltage $n_1$ is given through the following equation.

$$\begin{aligned} r_1 &= n_1/((R3 + R4)/R4) \\ &= 1.59/((7.5k + 1.5K)/1.5k) = 0.265\ (V). \end{aligned}$$

On the other hand, the reference voltage b for carrying out the D/A conversion in the CPU 14 is given through the following equation:

$$b = a/(R1 + R2) \times R2$$
$$= 18/(7.5k + 2.4k) \times 2.4k = 4.36 \text{ (V)}.$$

The number of ranges $m_1$ in the CPU 14 required for outputting the set voltage $n_1$ for lighting on only the blank lamp G1 is given through the following equation:

$$m_1 = r_1/(b/255)$$
$$= 0.265/(4.36/255) = 15.49.$$

Therefore, when lighting on only the blank lamp G1, the number of ranges is set to 15 in the CPU 14. Subsequently, the number of ranges $m_2$ through $m_{16}$ is set according to the light on state of the blank lamps G. The number of ranges $m_{16}$ corresponds to the light-off mode in which all the blank lamps G light off by turning off the transistor Tr1 shown in FIG. 1 and FIG. 4.

Here, when m=1, the voltage $r_{m1}$ of the output signal r is given through the following equation:

$$r_{m1}=b/255=4.36/255=0.0171 \text{ (V)}.$$

When $m_1$=15 for lighting on only the blank lamp G1 the voltage $r_1$ of the output signal r is given through the following equation:

$$r_1=0.0171\times15=0.257 \text{ (V)}.$$

With respect to the circuit shown FIG. 1, the table of FIG. 5 shows divided reference voltages at respective points, voltages of the control signal n, voltages of the output signal r, the number of ranges m at respective points and the light on states of the corresponding blank lamps G. Here, the table indicates the state where there is no variation in precision among the resistors R1 through R4 in the amplifying circuit 13 and the attenuating circuit 12.

Referring to the table of FIG. 5, an example of the lighting control of the blank lamp G will be explained in detail by showing specific numeral values. For example, when the blank lamps G1 through G5 light on, the number of ranges m=57 ($m_5$) is set to the D/A converter of the CPU 14. As a result, the output signal r of 0.971 (V) is output from the CPU 14, and the output signal is amplified by the amplifying circuit 13, and the voltage value 5.824 (V) of the control signal n is inputted to the driving-use comparators L1 through L16 of the driving circuit section 17. In the comparators L1 through L16, the voltage value 5.824 (V) of the control signal n is compared with divided reference voltages V1 through V16, and the low level signal is output from the comparator L1 through L5 and L16 respectively, and the high level signal is output from the comparators L6 through L15 respectively.

Next, the described feedback control by the described CPU 14 will be explained in detail.

In the circuit structure shown in FIG. 1, in order to light on the blank lamps G with accuracy, accurate voltages $n_1$ and $n_{16}$ of the control signal n to be output from the control circuit section 16 are required. Therefore, high precision resistors R1 through R4 are required for the attenuating circuit 12 and the amplifying circuit.

Namely, if the precision differs among the resistors R1 and R2 of the attenuating circuit 12, the attenuation factor varies, and this causes a reference voltage b of the CPU 14 to vary. As a result, the voltages $r_1$ through $r_{16}$ of the output signal r of the CPU 14 vary, and respective voltages $n_1$ through $n_{16}$ of the control signal n also become inaccurate. Furthermore, variations in the resistors R3 and R4 in the amplifying circuit 13 result in variations in amplification factor. Therefore, even if the voltage value of the output signal r is accurate, the voltages $n_1$ through $n_{16}$ of the control signal n become inaccurate.

Moreover, as described in the copying machine of the present embodiment, when considering the blank lamps G in 15 groups and the light off mode of the respective blank lamps in 15 groups, it is required that the control circuit section 16 outputs voltages corresponding to 16 gradation with accuracy. As this causes a smaller value between voltages, the high precision resistor is required in the control circuit section 16. However, in order to employ the resistors R1 through R4 of high precision in the attenuating circuit 12 and the amplifying circuit 13, a very high cost is required.

In order to counteract the described problem, the copying machine of the present embodiment is arranged such that the control circuit section 16 of FIG. 1 includes the comparator 10 for use in controlling feedback. The comparator 10 compares a voltage of the control signal n resulting from amplifying the output signal r from the CPU 14 in the amplifying circuit 13 with the reference voltage a to generate a binary comparative output k to be fed back to the CPU 14. The CPU 14 varies a voltage of the output signal r depending on a binary feedback input, so as to adjust the voltage of the output signal r, i.e., the basic voltage $r_a$, which gives the control signal n having a voltage equivalent to the reference voltage a. Then, the CPU 14 resets the voltages $r_1$ through $r_{16}$ of the output signal r, i.e., the voltages $n_1$ through $n_{16}$ of the control signal n based on the adjusted basic voltage $r_a$. In a practical operation, the output signal r is varied by switching the number of ranges m, and the basic voltage $r_a$ is set by the number of ranges $m_a$ which allows the signal having the voltage to be output. The voltage of the output signal r is readjusted by the CPU 14 when the power of the copying machine is turned on.

Here, according to variations in precision of the resistors R1 through R4 of the attenuating circuit 12 and the amplifying circuit 13, the CPU 14 readjusts the basic voltage $r_a$ of the output signal r to reset the voltages $r_1$ through $r_{16}$ of the output signal r, i.e., the voltages $n_1$ through $n_{16}$ of the control signal n. Therefore, it is required that the control circuit section 16 is arranged such that the amplification factor of the amplifying circuit 13 is set higher than the attenuation factor of the attenuating circuit 12 beforehand.

Namely, the control circuit section 16 of FIG. 1 is arranged such that the reference voltage a is set to the reference voltage b of the CPU 14 by lowering it to 1/4.125, and the reference voltage b is divided by the CPU 14 into 255 to output the output voltage r corresponding to the number of ranges m respectively. Therefore, for example, when the number of ranges m=10, the voltage value $r_{m10}$ of the output signal r is given through the following equation:

$$r_{m10}=(18/4.125)/255\times10=0.171 \text{ (V)}.$$

Then, the output signal r is amplified by the amplifying circuit 13. However, for example, in the case where the amplification factor of the amplifying circuit 13 is 4.125 that is equivalent to the attenuation factor, when m=255, the voltage $n_{m255}$ of the control signal n is given through the following equation:

$$n_{m255} = ((18/4.125)/255) \times 255 \times 4.125$$
$$= 18 \text{ (V)}.$$

The resulting voltage $n_{m255}$ is equivalent to the reference voltage a at a maximum range MAX. As described, by setting the attenuation factor of the attenuating circuit 12 equivalent to the amplification factor of the amplifying circuit 13, the control circuit section 16 can adjust the voltage of the control signal n when it is greater than the reference voltage a. However, when the voltage of the control signal n is smaller than the reference voltage a, the voltage of the output signal r of the CPU 14 cannot be adjusted as it cannot be increased. As aforementioned, the copying machine of the present embodiment, the amplification factor is set to 6 times with respect to the attenuation factor of 4,125.

The variable range of the voltage of the output signal r for use in adjusting the basic voltage $r_a$, i.e., the variable range of the number of ranges $m_a$ is determined based on the precision of the resistors R1 through R4 in the attenuating circuit 12 and the amplifying circuit 13. Therefore, the variable range of the number of ranges $m_a$ for use in resetting the basic voltage $r_a$ may be set based on the precision of the resistors R1 through R4.

The table in FIG. 6 shows the tolerance of the resistor, respective variable ranges of the reference voltage b of the CPU 14 according to the precision of the resistor, the variable range of the number of ranges $m_a$, and variable range of the basic voltage $r_a$. As shown in the table, at a tolerance of 0 percent, m is 175, and at respective tolerances of ±1 percent, ±5 percent and ±10 percent, the respective numbers of ranges m ranges from 170 to 181, from 150 to 206, and from 128 to 241 respectively.

The precision of the resistors R1 through R4 generally shows a normal distribution, and thus the time required for setting the basic voltage $r_a$ can be shortened by setting the voltage of the output signal r to be output first to be a voltage corresponding to the midpoint value of the resistor, thereby shortening a time required for resetting the output signal r. Namely, by setting the resistance value at the point P1 in the normal distribution graph (estimated value) shown in FIG. 7 for the voltage of the output signal r to be output first from the CPU 14 as the resistance values of R1 through R4, then the basic voltage $r_1$ in the described FIG. 6 can be set to TYP of the basic voltage $r_a$.

Next, the operations of the control circuit section 16 for adjusting the basic voltage $r_a$ of the output signal r and resetting the voltages $r_1$ through $r_{16}$ of the output signal r will be explained in reference to the flowchart of FIG. 8.

Here, in the circuit structure of FIG. 1, explanations will be given through the case where the reference voltage a=18 (V), and the amplification factor of the amplifying circuit 13 is actually 5.5 times although rated at 6 times. Additionally, the output condition of the control signal n of the voltage $n_a$ equivalent to the reference voltage a (18V) stored in the $E^2$(PROM)15 is $m_a$=175.

When m=1, the voltage $r_{m1}$ of the output signal r is given through the following equation:

$$r_{m1} = (\text{reference voltage } a/\text{attenuation factor of the attenuating circuit 12})/(\text{resolution of CPU}) = (18/4.125)/255 = 0.0171 \text{ (V)}.$$

When the power is turned on (S1), the CPU 14 reads out an initial value of the number of ranges $m_a$ from the $E^2$PROM 15 (S2). As $m_a$ that is initially read out is 175, the output signal r of the voltage value according to $m_a$=175 is output from the CPU 14 (S3). Here, the voltage $r_a$ of the output signal r is set to $r_a$=0.0171×175=2.99 (V). 55. The output signal r to be output from the CPU 14 becomes the control signal n resulting from the amplification by the amplifying circuit 13, and the voltage $n_a$ of the control signal n is compared with the reference voltage a in the comparator 10 so that the comparative output k is fed back to the CPU 14 (S4). In the CPU 14, it is determined whether the comparative output k is in the low level signal or the high level signal (S5). When the comparative output k is determined to be low level, the sequence goes to (S6), while when the comparative output k is determined to be high level, the sequence goes to (S7). Here, as the output voltage $n_a$ of the control signal n is $n_a$=$r_a$ (2.99)×5.5=16.45 (V), the voltage $n_a$ is smaller than 18 (V) of the reference voltage a, and the comparative output k is set to low level, and the sequence goes to (S6).

In (S6), 1 is added to $m_a$, which gives $m_a$=$m_a$ (175)+1=176. Again, the voltage $n_a$ of the control signal n at $m_a$=176 is compared with the reference voltage a (S8), and it is determined if the comparative output k is in the low level or the high level (S10). When it is determined to be low level, the sequence goes to (S6), while when it is determined to be high level, the sequence goes to (S12). In this case also, the voltage $r_a$ of the output signal r is $r_a$=0.0171×176=3.01 (V), and the voltage $n_a$ of the output signal n is $n_a$=$r_a$(3.01)×5.5=16.45 (V), which is smaller than 18 (V) of the reference voltage a, and the comparative output k is set to the low level. Then, the sequence goes back to (S6), and 1 is added to $m_a$ in (S6).

Thereafter, until the comparative output k becomes high level, the processes in (S6)→(S8)→(S10)→(S6) . . . are repeated, so as to increase the value of $m_a$ one by one. Upon reaching the condition of $m_a$=192, the voltage $r_a$ of the control signal r is $r_a$=0.0171×192=3.28 (V), and the voltage $n_a$ of the control signal n is set to $n_a$=$r_a$ (3.28)×5.5=18.04 (V). Then, the sequence goes to (S12) where the number of ranges $m_a$ is set to 192 in the CPU 14.

After the setting, $m_a$=192 is stored in the $E^2$PROM 15, and the number of ranges $m_a$ is renewed (S13). By the described process in (S13), the renewed output $m_a$ is output from the CPU 14 in and after the next adjusting operation of the basic voltage $r_a$. Next, based on the reset range $m_a$, the respective ranges $m_1$ through $m_{16}$ set according to the light on state of the blank lamps G are reset, and the data stored in the $E^2$PROM 15 is rewritten (S14). Here, as the number of ranges $m_a$, which permits the basic voltage $r_a$ to be output, is 192, the multiplier A for resetting respective ranges $m_1$ through $m_{16}$ is given through the following equation:

$$A=192/175=1.097, \text{ and}$$

respective values $m_1$ through $m_{16}$ are multiplied by 1.097 times.

Thereafter, a normal copying operation is performed (S15), and the copying operation is stopped by turning off the power (S16).

Thereafter, at the reference voltage a=18 (V), an explanation will be given through the case where the amplification factor of the amplifying circuit 13 is actually 6.5 times although rated at 6.0 times. The output conditions of the control signal n of the voltage $n_a$ that is equivalent to the reference voltage a (18V) stored in the $E^2$PROM 15 is $m_a$=175. The voltage $r_{m1}$ of the output signal r at m=1 is similarly set to 0.0171 (V).

The processes in (S1) through (S5) are performed in the above manner. Namely, the voltage $r_a$ in accordance with $m_a$=175 is output from the CPU 14. Then, the voltage $n_a$ of the control signal n resulting from 6.5 times amplifying the voltage $r_a$ is compared with the reference voltage a, and the comparative output k is fed back to be inputted to the CPU 14. In the CPU 14, it is determined whether the comparative output k is in the low level or high level. If the comparative output k is determined to be low level, the sequence goes to (S6). If it is determined to be high level, the sequence goes to (S7). In this case, as the voltage $n_a$ is given as $n_a=r_a(2.99)\times 6.5=19.44$ (V), it becomes larger than the reference voltage a of 18 (V). As a result, the comparative output k becomes high level, and the sequence goes to (S7).

In (S7), (−1) is added to $m_a$, which gives $m_a=m_a(175)-1=174$. Again, when the number of ranges $m_a=174$, the voltage $n_a$ of the control signal n is compared with the reference voltage a (S9). In the CPU 14, it is determined whether the comparative output k is in the low level or high level (S11). When the comparative signal is determined to be high level, the sequence goes to (S7), while when the comparative output k is determined to be low level, the sequence goes to (S12). Again, the voltage $r_a$ of the output signal r is set to $r_a=0.0171\times 174=2.98$ (V), and the voltage $n_a$ of the control signal n is set to $n_a=r_a(2.98)\times 6.5=19.37$ (V). Thus, the voltage $r_a$ is larger than the reference voltage a (18 (V)), and the comparative output k is high level. Therefore, the sequence returns to (S7), and (−1) is added to $m_a$ again.

Thereafter, until the comparative output k is set to low level, the processes of (S7)→(S9)→(S11)→(S7) . . . are repeated, and the number of ranges $m_a$ is counted down one by one. Then, upon reaching the condition of $m_a=161$, the voltage $r_a$ of the output signal r is $r_a=0.0171\times 161=2.75$ (V), and the voltage $n_a$ of the control signal n is $n_a=r_a(2.75)\times 6.5=17.88$ (V). Here, as the comparative output k is set to low level, the sequence goes to (S12), and $m_a$ is set to 161 in the CPU 14. The respective operations in (S13) through (S16) are as described earlier. Here, the number of ranges $m_a$ at which the voltage $r_a$ can be output is 161, and the multiplier A for resetting respective numbers of ranges $m_1$ through $m_{16}$ is given as:

$$A=161/175=0.92.$$

With respect to conditions shown in the table of FIG. 5 (all of the resistors R1 through R4 in the amplifying circuit 13 and the attenuating circuit 12 are rated without variations among them), the table of FIG. 9 shows the voltage of the control signal n, the voltage of the output signal r and the number of ranges m of respective points in the case where the resistors R1 and R2 in the attenuating circuit 12 respectively have an error of 5 percent, and the reference voltage b of the CPU 14 is increased.

With respect to the conditions shown in the table of FIG. 5. The table in FIG. 10 shows the state where the resistors R1 and R2 of the attenuating circuit 12 have an error of 5 percent, and the reference voltage b of the CPU 14 is dropped.

With respect to the conditions shown in the table of FIG. 5, the table of FIG. 11 shows the case where the resistors R3 and R4 in the amplifying circuit 13 respectively have an error of 5 percent, and a voltage of the control signal n is increased.

With respect to the conditions shown in the table of FIG. 5, the table of FIG. 12 shows the case where the resistors R3 and R4 of the amplifying circuit 13 respectively have an error of 5 percent, and a voltage of the control signal is dropped.

With respect to the conditions shown in the table of FIG. 5, the table of FIG. 13 shows the case where a reference voltage output from the reference voltage generating circuit 11 is increased by 10 percent.

With respect to the conditions shown in the table of FIG. 5, the table of FIG. 14 shows the case where the reference voltage output from the reference voltage generating circuit 11 is dropped by 10 percent.

With respect to the conditions shown in the table of FIG. 5, the table of FIG. 15 shows the case where the reference voltage output from the reference voltage generating circuit 11 is increased by 10 percent, and the resistors R1 and R2 in the attenuating circuit 12 and the resistors R3 and R4 in the amplifying circuit 13 respectively have an error of 5 percent, and which causes an increase in not only the reference voltage b of the CPU 14 but also an increase in the voltage of the control signal n.

With respect to the conditions shown in the table of FIG. 5, the table of FIG. 16 shows the case where the reference voltage a from the reference voltage generating circuit 11 is dropped by 10 percent, and the resistors R1 and R2 in the attenuating circuit 12 and the resistors R3 and R4 of the amplifying circuit 13 respectively have an error of 5 percent, which causes a drop in not only the reference voltage b of the CPU 14 but also in the voltage of the control signal n.

As described, the copying machine of the present embodiment is arranged so as to include a feedback control use comparator 10 provided in a control circuit section 16. The comparator 10 compares a voltage of the control signal n resulting from amplifying the output signal r from the CPU 14 in an amplifier circuit 13 with the reference voltage a so as to generate a binary comparative output k which is fed back to the CPU 14. The CPU 14 adjusts the basic voltage $r_a$ by varying the output value of the output signal r depending on binary feedback inputs. Based on the adjusted basic voltage $r_a$, the control circuit section 16 resets respective voltages $r_1$ through $r_{16}$ of the output signal r.

Therefore, even when adopting low grade resistors for the resistors R1 through R4 in the attenuating circuit 12 and the amplifying circuit 13, the respective voltages $r_1$ through $r_{16}$ of the output signal r can be reset in accordance with respective resistors R1 through R4, thereby permitting the blank lamps G1 through G15 in 15 groups to be controlled with accuracy.

According to the described table of FIG. 6, when adopting low grade resistors having a tolerance of around ±10 percent for the resistors R1 through R4, the variable range of the reference voltage b of the CPU 14 becomes large, i.e., ranging from 3.735 to 5.061 (V). However, by altering the range $m_a$ which permits the basic voltage $r_a$ to be output in a range of from 127 to 241, the basic voltage $r_a$ in a range of from 2.531 to 3.536 (V) is output. This proves that the low grade resistors can be adopted for the resistors R1 through R4.

Figure 8:
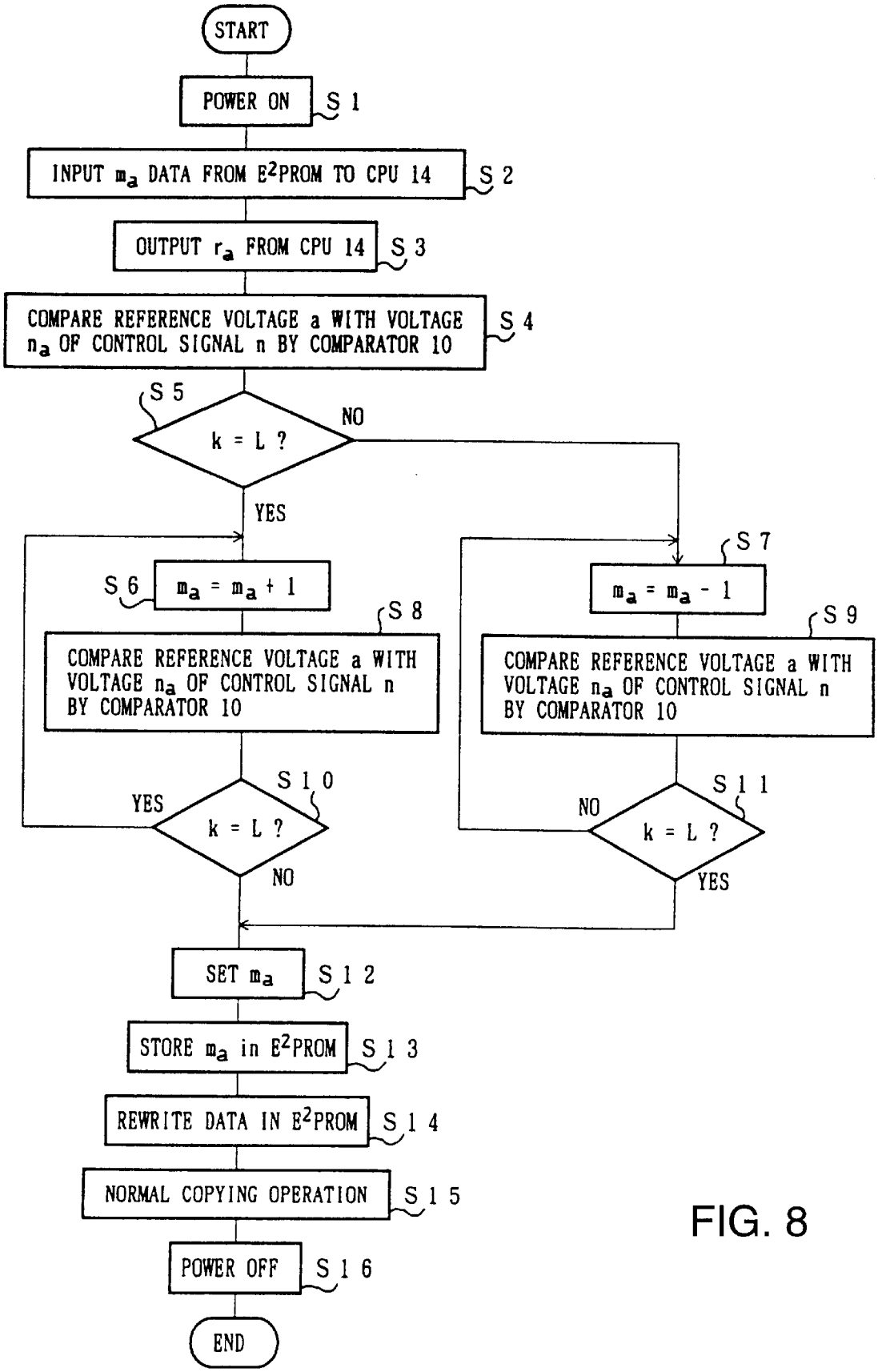
FIG. 8 is a flowchart which shows a process of correcting a reference voltage of a CPU output signal and resetting a voltage of the control signal.

In (S13) of the flowchart of FIG. 8, the CPU 14 stores a newly adjusted $m_a$ in the $E^2$PROM 15 to renew the number of ranges $m_a$. Therefore, when the power source is turned on next time, in (S2), not the initial value of 175 but the newly set value $m_a$ is read to be inputted to the CPU 14. Namely, when the amplification factor is smaller than the designed value, 192 is read to be inputted to the CPU 14, while when the amplification factor is larger than the designed value, 161 is read to be inputted to the CPU 14. As a result, compared with the case of second starting with the initially set number of ranges $m_a=175$, the CPU 14 can significantly reduce the time required for resetting the basic voltage $r_a$.

For example, if the CPU 14 is not arranged so as to store the reset value $m_a$ in the $E^2$PROM 15, when the number of ranges $m_a$, which satisfies the condition of $a=n_a$ is 160, the first comparison is started with the initial value of 175, and thus it is required to carry out a comparison around 15 times in (S6) to (S11). However, by storing $m_a=160$ into the $E^2$PROM 15 in (S13), the first comparison can be started with $m_a=160$, and $m_a$ can be reset by carrying out a comparison only once or twice.

While the described operation of resetting (adjusting) the basic voltage $r_a$ is being carried out by the driving comparator L16 and the transistor Tr1, in the driving circuit section 17, the transistor Tr1 is turned off, to light off all the blank lamps G. Even if the low grade resistors are adopted for the resistors R1 through R4 which have a smaller voltage than the divided reference voltage V16, all the blank lamps G light off. Therefore, while the resetting operation is being carried out, either all the blank lamps G light off, or all the blank lamps G light on, thereby preventing the pre-exposure of the photoreceptor drum 1. Here, all light-off means is constituted by the comparator 16 and the transistor Tr1.

Furthermore, in the control circuit section 16, the CPU reference voltage b is generated from the blank lamp reference voltage a to be output from the reference voltage generating circuit 11 by the attenuating circuit 12. Therefore, the reference voltage b varies in sync with the variations in the reference voltage a, and it is not required to correct the output signal r of the CPU 14 with respect to the variations in the reference voltage a. Needless to mention, it is permitted to input the CPU reference voltage b from the external section. In such case, to compensate for variations in external voltage, the output signal of the CPU 14 is required to be adjusted.

With respect to the conditions shown in Table 5 (all of the resistors R1 through R4 in the amplifying circuit 13 and the attenuating circuit 12 are rated without variations among them), the table of FIG. 17 shows voltages of the control signal n at respective points, voltages of the output signal r and the number of ranges m in the case where the CPU reference voltage b is externally applied.

With respect to the conditions shown in Table 13, the table of FIG. 18 shows voltages of the control signal n at respective points, voltages of the output signal r and the number of ranges m in the case where the CPU reference voltage b is externally applied.

With respect to the conditions shown in Table 14, the table of FIG. 19 shows voltages of the control signal n at respective points, voltages of the output signal r and the number of ranges m in the case where the CPU reference voltage b is externally applied.

EMBODIMENT 2

The following descriptions will explain another embodiment of the present invention with reference to FIGS. 1, and 20 through 24. Here, members having the same functions as those of the aforementioned embodiment will be designated by the same reference numerals, and thus the descriptions thereof shall be omitted here.

A copying machine in accordance with the present embodiment has the same structure as that of the first embodiment except for the arrangement for adjusting a basic voltage $r_a$ by a CPU 14.

According to the copying machine of the first embodiment, in the operation shown in the flowchart of FIG. 8, an output signal r, a voltage corresponding to the rated value of resistors is output. Thereafter, an increase in voltage of the output signal r is adjusted in accordance with a adjustable minimum change in voltage (m=1). Thus, a long time is required for adjusting the basic voltage $r_a$. To eliminate the described problem, the copying machine of the present embodiment is arranged so as to adjust an increase in the output signal r in two stages, i.e., a coarse adjustment and a small adjustment so as to reduce the required operation time.

Figure 20:
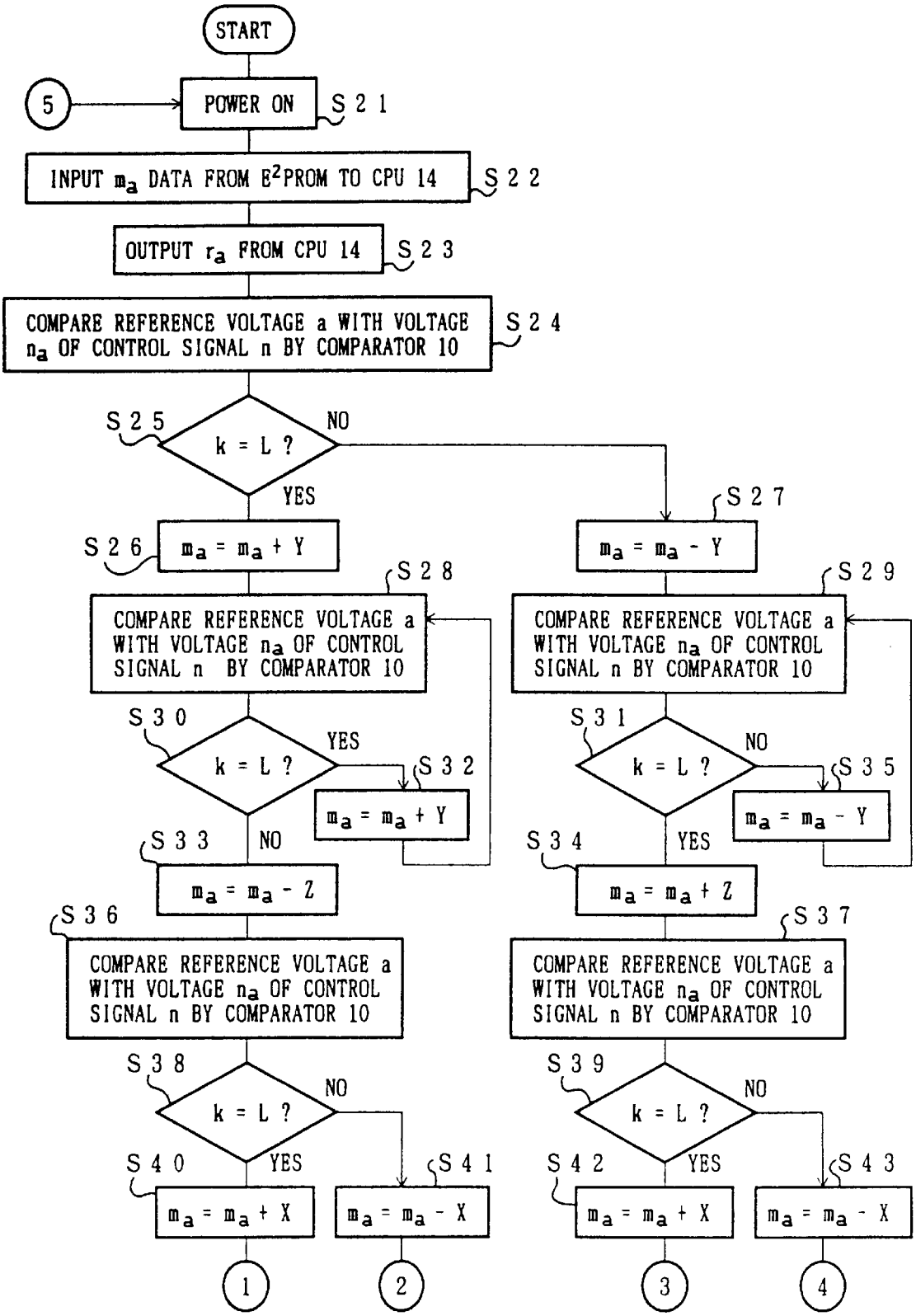
FIG. 20 which explains another embodiment of the present invention is a flowchart showing a process of adjusting a basic voltage of the CPU output signal and resetting a voltage of a control signal.
Figure 21:
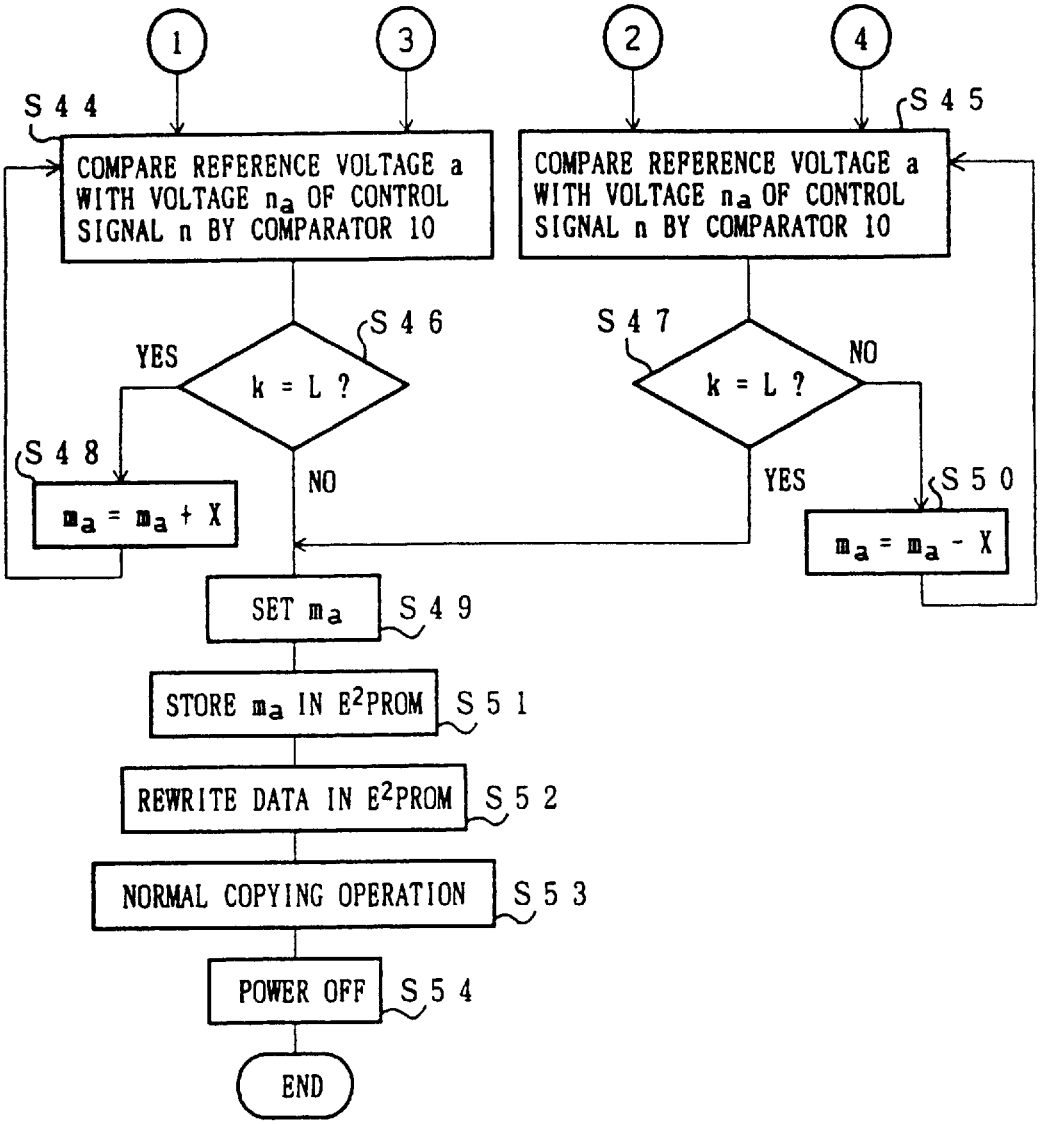
FIG. 21 is a flowchart which shows a process for adjusting a basic voltage of an output signal of the CPU and resetting a voltage of the control signal.

Hereinafter, an operation of adjusting the basic voltage $r_a$ in the copying machine of the present embodiment will be explained in reference to the flowcharts of FIG. 20 and FIG. 21. Here, the conditions of the adjusting operation are the same as the conditions explained in reference to the flowchart of FIG. 8. Specifically, in the circuit structure of FIG. 1, explanations will be given through the cases where the amplification factors of the amplifying circuit 13 are respectively 5.5 times and 6.5 times although rated at 6 times the reference voltage a=18 (V). The output condition of the control signal n of the voltage $n_a$ equivalent to the reference voltage a (18 V) stored in the $E^2$PROM 15 is set to $m_a$=175. The voltage $r_{m1}$ of the output signal r at m=1 is set to 0.0171 (V) in the described manner.

As in the described case, it is assumed that the first coarse increase Y is m=10, the second coarse increase Z is m=5, and a small increase X is m=1 as in the described manner.

First, processes in (S21) through (S25) are carried out in the same manner as the processes in (S1) through (S5) shown in the flowchart of FIG. 8. Namely, from the CPU 14, the voltage $r_a$ in accordance with $m_a$=175 is output, and a voltage $n_a$ of the control signal n resulting from 5.5 times amplifying the voltage $r_a$ is compared with the reference voltage a, and a resulting comparative output k is fed back to the CPU 14. Then, it is determined whether the comparative output k is in the low level or the high level by the CPU 14. If the comparative output k is determined to be low level in S25, the sequence goes to (S26). On the other hand, if the comparative output k is determined to be high level in (S25), the sequence goes to (S27). In this case, the voltage $n_a$ is $n_a=r_a$ (2.99)×5.5=16.45 (V), which is smaller than the reference voltage a (18 (V)). Thus, the comparison output k is in the low level, and the sequence goes to (S26).

In (S26), the first coarse increase Y(10) is added to $m_a$, which gives $m_a=m_a$ (175)+Y(10)=185. Then, at $m_a$=185, the voltage $n_0$ of the control signal n is compared with the reference voltage a (S28). Then, it is determined if the comparison output k is in the low level or the high level by the CPU 14 (S30). If the comparative output k is determined to be high level in (S30), the sequence goes to (S33). On the other hand, if the comparative output k is determined to be low level in (S30), the sequence goes to (S32). In this case, the voltage $r_a$ of the output signal r is $r_a$=0.0171×185=3.16 (V), and the voltage $n_a$ of the control signal n is $n_a=r_a$(3.16) ×5.5=17.38(V). Thus, the comparative output k is in the low level, and the sequence goes to (S32).

In (S32), the first coarse increase Y(10) is further added to $m_a$, which gives $m_a=m_a$(185)+Y(10)=195. Then, at $m_a$=195, the voltage $n_a$ of the control signal n is compared with the reference voltage a (S28). Then, it is determined if the comparative output k is in the low level or the high level in the CPU 14 (S30). In this case, the voltage $r_a$ of the output signal r is $r_a$=0.0171×195=3.33 (V), and the voltage $n_a$ of the control signal n is $n_a=r_a$(3.33)×5.5=18.32 (V). Thus, the comparison output k is in the high level, and the sequence goes to (S33).

In (S33), the second coarse increase Z(5) is subtracted from $m_a$, which gives $m_a=m_a$(195)−Z(5)=190. Then, at $m_a$=190, the voltage $n_a$ of the control signal n is compared with the reference voltage a (S36). Then, it is determined if the comparative output k is the low level or the high level by the CPU 14 (S38). If the comparative output k is determined to be high level, the sequence goes to (S41) (or in the case of FIG. 21 to (S50). On the other hand, if the comparative output k is determined to be low level, the sequence goes to (S40). In this case, the voltage $r_a$ of the output signal r is $r_a$=0.0171×190=3.25(V), and the voltage $n_a$ of the control signal n is $n_a=r_a$(3.25)×5.5=17.88 (V). Thus, the comparison output k is in the low level, and the sequence goes to (S40).

In (S40), a small increase X(1) is added to $m_a$, which gives $m_a=m_a$(190)+X(1)=191. Then, at $m_a$=191, a voltage $n_a$ of the control signal n is compared with a reference voltage a (S44). Then, it is determined if the comparative output k is in the low level or the high level by the CPU 14 (S46). If the comparative output k is determined to be high level, the sequence goes to (S49). On the other hand, if it is determined to be low level, the sequence goes to (S48). In this case, the voltage $r_a$ of the output signal r is $r_a$=0.171×191=3.27(V), and the voltage $n_a$ of the control signal n is $n_a$=$r_a$(3.27)×5.5=17.99 (V). Thus, the comparison output k is in the low level, and the sequence goes to (S48).

In (S48), a small increase X(1) is further added to $m_a$, which gives $m_a$=$m_a$(191)+X(1)=192. Again, at $m_a$=192, the voltage $n_a$ of the control signal n is compared with the reference voltage a (S44). Then, it is determined if the comparative output k is in the low level or the high level by the CPU 14 (S46). In this case, the voltage $r_a$ of the output signal r is $r_a$=0.0171×192=3.28 (V), and the voltage $n_a$ of the control signal n is $n_a$=$r_a$(3.28)×5.5=18.04 (V). Thus, the comparison output k is in the high level, the sequence goes to (S49), and $m_a$ is set to 192.

The processes in (S51) through (S54) after setting the range are the same as the processes in (S13) through (S16) shown in the flowchart of FIG. 8.

Next, an example will be given through the case where the amplification factor of the amplifying circuit 13 is actually 6.5 times although rated at 6.0 times.

The processes in (S21) through (S25) are performed in the manner described earlier. Namely, from the CPU 14, the voltage $r_a$ in accordance with $m_a$=175 is output, and the voltage $n_a$ of the control signal n resulting from 6.5 times amplifying the voltage $r_a$ is compared with the reference voltage a, and the resulting comparative output k is fed back to the CPU 14. Then, it is determined whether the comparative output k is in the low level or high level by the CPU 14. If the comparative output k is determined to be low level in (S25), the sequence goes to (S26). On the other hand, if the comparative output k is determined to be high level, the sequence goes to (S27). In this case, the voltage $n_a$ of the control signal n is $n_a$=$r_a$(2.99)×6.5=19.43 (V). Thus, the comparison output k is in the high level, and the sequence goes to (S27).

In (S27), the first coarse increase Y(10) is subtracted from $m_a$, which gives $m_a$=$m_a$(175)−Y(10)=165. Then, at $m_a$=165, the voltage $n_a$ of the control signal n is compared with the reference voltage a (S29). Then, it is determined whether the comparative output k is in the low level or high level by the CPU 14 (S31). If the comparative output k is determined to be high level, the sequence goes to (S35). On the other hand, if the comparative output k is determined to be low level, the sequence goes to (S34). In this case, the voltage $r_a$ of the output signal r is $r_a$=0.0171×165=2.82 (V), and the voltage $n_a$ of the control signal n is $n_a$=$r_a$(2.82)×6.5=18.33 (V). Thus, the comparison output k is in the high level, and the sequence goes to (S35).

In (S35), the first coarse increase Y(10) is further subtracted from $m_a$, which gives $m_a$=$m_a$(165)−Y(10)=155. Again, at $m_a$=155, the voltage $n_a$ of the control signal n is compared with the reference voltage a (S29). Then, it is determined whether the comparative output k is in the low level or the high level by the CPU 14 (S31). In this case, the voltage $r_a$ of the output signal r is $r_a$=0.0171×155=2.65 (V), and the voltage $n_a$ of the control signal n is $n_a$=$r_a$(2.65)×6.5=17.23 (V). Thus, the comparison output k is in the low level, and the sequence goes to (S34).

In (S34), the second coarse increase Z(5) is added to $m_a$, which gives $m_a$=$m_a$(155)+Z(5)=160. Again, at $m_a$=160, the voltage $n_a$ of the control signal n is compared with the reference voltage a (S37). Then, it is determined whether the comparative output k is in the low level or the high level by the CPU 14 (S39). If the comparative voltage is determined to be high level, the sequence goes to (S43). On the other hand, if it is determined to be low level, the sequence goes to (S42). In this case, the voltage $r_a$ of the output signal r is $r_a$=0.0171×160=2.74 (V), and the voltage $n_a$ of the control signal n is $n_a$=$r_a$(2.74)×6.5=17.81 (V). Thus, the comparative output k is in the low level, and the sequence goes to (S42).

In (S42), a small increase X(1) is added to $m_a$, which gives $m_a$=$m_a$(160)+X(1)=161. Then, at $m_a$=161, the voltage $n_a$ of the control signal n is compared with the reference voltage a (S44). Then, it is determined whether the comparative output k is in the low level or the high level by the CPU 14 (S46). If the comparative voltage k is determined to be high level, the sequence goes to (S49). On the other hand, if it is determined to be low level, the sequence goes to (S48). In this case, the voltage $r_a$ of the output signal r is $r_a$=0.0171×161=2.75 (V), and the voltage $n_a$ of the control signal n is $n_a$=$r_a$(2.75)×6.5=17.89 (V). Thus, the comparative output k is in the low level, and the sequence goes to (S48).

In (S48), a small increase X(1) is further added to $m_a$, which gives $m_a$=$m_a$(161)+X(1)=162. Again, at $m_a$=162, the voltage $n_a$ of the control signal n is compared with the reference voltage a (S44). Then, it is determined whether the comparative output k is in the low level or the high level by the CPU 14 (S46). In this case, the voltage $r_a$ of the output signal r is $r_a$=0.0171×162=2.77 (V), and the voltage $n_a$ of the control signal n is $n_a$=$r_a$(2.77)×6.5=18.01 (V). Then, the comparative output k is in the high level, and the sequence goes to (S49), and $m_a$ is set to 162.

The processes in (S51) through (S54) after the number of ranges have been set are the same as the described processes in (S13) through (S16) in the flowchart of FIG. 8.

In the above explanation, the process in (S44) is added; however, the processes in (S45) through (S47) may be added depending on the condition.

In the above explanations, the first coarse increase is set to m=10, the second coarse increase is set to m=5, and a small increase is set to m=1. These values are determined based on a resistance tolerance in the resistors R1 through R4 of the attenuating circuit 12 and the amplifying circuit 13, and by the adjusting precision as shown in the following examples.

EXAMPLE 1

Figure 22:
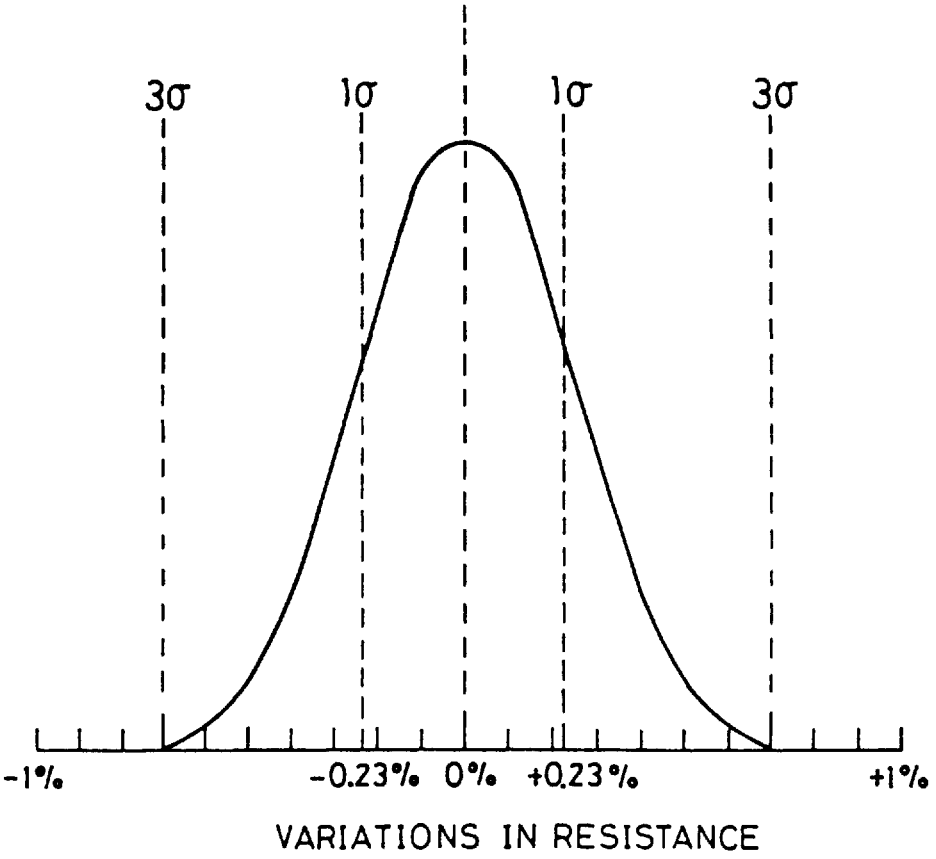
FIG. 22 is a graph of a normal distribution which shows resistance variations (effective value) when a resistance tolerance is ±1 percent resistance.

As shown in FIG. 22, in this example, in the resistors R1 through R4 in the attenuating circuit 12 and the amplifying circuit 13, the voltage corresponding to 1 sigma (σ) resistance obtained from the probability of the measured values of the variations in precision is used.

Namely, in the circuit of FIG. 1, the reference voltage a=18(V), the target value of the control signal n is 18(V), and the resistances of the resistors R1, R2, R3, and R4 are set to 7.5 kΩ, 2.4 kΩ, 7.5 kΩ, and 1.5 kΩ respectively. If all of the resistors R1 through R4 are rated, the respective outputs of the control signal n, the number of ranges m and the output signal r are given through the following formulae:

$$m = (18/((R3+R4)/R4))/(18/((R1+R2)/R2))/255 = 18((7.5k+1.5k)/1.5k))/(18/((7.5k+2.4k)/2.4k))/255 = 175.313$$

$$n = (18/((R1+R2)/R2))/255 \times m \times ((R3+R4)/R4) = (18/((7.5k+2.4k)/2.4k))/255 \times m \times ((7.5k+1.5k)/1.5k) = 18$$

$$r = (18/((R1+R2)/R2))/255 \times m = (18/(7.5k+2.4k)/2.4k)255 \times m = 3.$$

On the other hand, in the case where the resistance tolerance of the resistors R1 through R4 is ±1 percent, and the attenuation factor of the attenuating circuit 12 and the amplification factor of the amplifying circuit 13 are respectively increased by a shift of 1 sigma (0.23 percent), the respective outputs of the control signal n, the number of ranges m and the output signal r are given through the following formulae:

$$m = (18((7.5k \times 1.0023 + 1.5K \times 0.9977)/1.5k \times 0.9977))/(18/((7.5k \times 0.9977 + 2.4k \times 1.0023)/2.4k \times 1.0023))/255 = 174.034$$

$$n = (18/((7.5k \times 0.9977 + 2.4k \times 1.0023)/2.4k \times 1.0023))/255 \times m \times (18((7.5k \times 1.0023 + 1.5k \times 0.9977)/1.5k \times 0.9977)) = 18$$

$$r = (18/((7.5k \times 0.9977 + 2.4k + 1.0023)/2.4k \times 1.0023))/255 \times m = 2.9885.$$

On the other hand, in the case where the attenuation factor of the attenuating circuit 12 and the amplification factor of the amplifying circuit 13 are respectively dropped by a shift of 1 sigma (0.23 percent), the respective outputs of the control signal n, the number of ranges m and the output signal r are given through the following formulae:

$$m = ((18(7.5k \times 0.9977 + 1.5K \times 1.0023)/1.5k \times 1.0023))/(18/((7.5k \times 1.0023 + 2.4k \times 0.9977)/2.4k \times 0.9977))/255 = 176.6$$

$$n = (18/((7.5k \times 1.0023 + 2.4k \times 0.9977)/2.4k \times 0.9977))/255 \times m \times (18((7.5k \times 0.9977 + 1.5k \times 1.0023)/1.5k \times 1.0023)) = 18$$

$$r = (18/((7.5k \times 1.0023 + 2.4k + 0.9977)/2.4k \times 0.9977))/255 \times m = 3.0115.$$

Therefore, as the voltage corresponding to the resistance value of 1 sigma, a coarse increase is set to m=2 (difference between 174.034 and 176.6), and an amount of change of the output signal $r_a$ is set to 0.01 (V) (difference between 2.9885 and 3.0115). In this case, when a small adjustment is set to m=1, it is not required to set the second coarse increase.

The explanations will be given through the flowcharts of FIG. 20 and FIG. 21. In (S21) through (S25), processes are carried out in the aforementioned manner. In the case where the coarse increase is Y(2) in (S26) and (S27), and a comparative output k is determined to be high level by the CPU 14 in (S30), the sequence goes to (S41) by skipping (S33), (S36) and (S38). On the other hand, when the comparative output k is determined to be low level, the sequence goes to (S42) by skipping (S34), (S37) and (S39).

In the case where the reference voltage a=18 (V), and the resistors having a resistance tolerance of ±5% are adopted for the resistors R1 through R4, when a voltage corresponding to a resistance value of 1 sigma is applied as a coarse increase, the coarse increase is m=7. Further, an amount of the output signal $r_a$ changes by a coarse increase m=7 by 0.06 (V) each time. In this case, assumed that the fine adjustment is m=1, then it is preferable that the second coarse increase be set in the described manner. In such case, an intermediate value m=3 (or 4) may be set as the second coarse increase.

The explanations will be given through the flow charts of FIG. 20 and FIG. 21. In (S21) through (S25), processes are carried out in the aforementioned manner. In this case, the first coarse increase is set to Y(7) in (S26) and (S27), and the second coarse increase is set to Z(3) in (S33) and (S34).

As described, by carrying out a comparison by outputting the output signal r based on 1 sigma, the time required for resetting the basic voltage $r_a$ can be effectively shortened.

EXAMPLE 2

Figure 23:
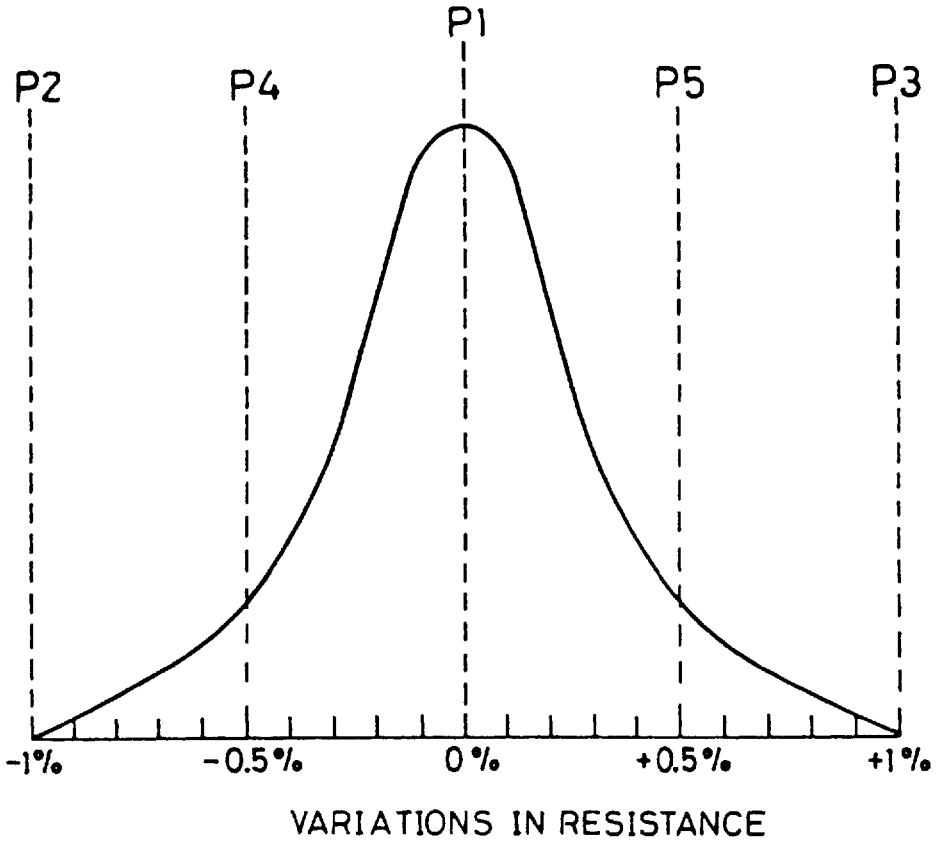
FIG. 23 is a graph of a normal distribution which shows resistance variations (estimated value) when a resistance tolerance is ±1 percent resistance.

In the present example, as shown in FIG. 23, with respect to the resistors R1 through R4 in the attenuating circuit 12 and the amplifying circuit 13, the voltages corresponding to the maximum and minimum resistance values in the precision distribution and the voltage of midpoints between the maximum resistance or minimum resistance and the rated value are used.

Specifically, as the first coarse increase, an output signal r is output based on the voltage corresponding to the minimum resistance P2 or the maximum resistance P3 of the resistors R1 through R4, so as to compare the reference voltage a with the voltage $n_a$ of the control signal n.

Then, as the second coarse component, the midpoint P4 between the minimum value P2 of the resistors R1 through R3 and the rated value P1, or the midpoint P5 between the maximum value P3 of the resistors R1 through R4, and the rated value P1 is used. Thereafter, a midpoint between P4 or P5 and a rated value P1 and further a midpoint between the above midpoint and P4 or P5 may be used if necessary.

As described, a time required for the adjusting operation can be shortened also by adjusting the output value r based on the minimum value, the maximum value, the midpoint value, and further the midpoint value therebetween.

EXAMPLE 3

Figure 24:
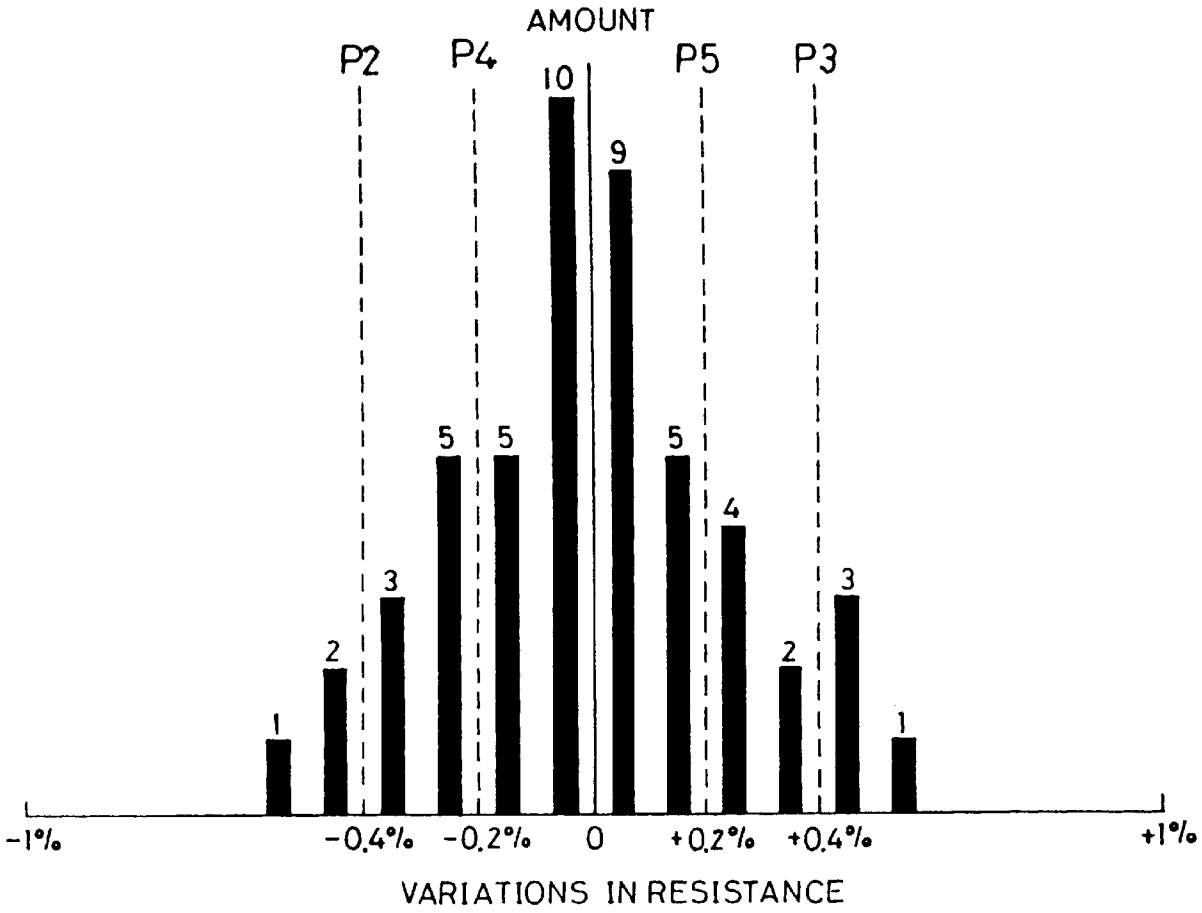
FIG. 24 is a graph of a normal distribution which shows resistance variations (measured value) when a resistance tolerance is ±1 percent resistance.

In this example, as shown in FIG. 24, the distribution in precision in the resistors R1 through R4 in the attenuating circuit 12 and the amplifying circuit 13 are measured, and values which cover around 70 percent are used based on the measured values.

Namely, as the first coarse increases, the output signal r of the voltage corresponding to the resistance P2 or P3 (±0.4 percent) which covers 70 percent of the measured values with respect to the resistors R1 through R4 is output so as to compare the reference voltage a with the voltage $n_a$ of the control signal n by the comparator 10.

Further, as the second coarse increases, the midpoint P4 or P5 (±0.2 percent) between P2 or P3 and the rated value P1, or subsequently, a further midpoint between P4 or P5 and the rated value P1, or a still further midpoint may be used if necessary.

As described, a time required for the adjusting operation can be shortened also by adjusting the output of the output signal r based on resistance values which cover a large number of measured values. In this example, it is especially effective to adopt the distribution which does not show a normal distribution.

EMBODIMENT 3

The third embodiment of the present invention will be described in reference to FIGS. 24–27. Here, members having the same function as those of the aforementioned embodiment will be designated by the same reference numerals, and thus the descriptions thereof shall be omitted here.

As described, each voltage of the control signal n in multiple gradation is required to be controlled between the maximum value and the minimum value of the terminal voltage (difference in voltage of the divided reference voltages) of the dividing resistors R10 through R26 for setting the divided reference voltages V1 through V16 of the driving comparators L1 through L16 of the driving circuit section 17. In the copying machine of the first and second embodiments, a resistor rated at 1 kΩ is used for all of the dividing resistors R10 through R26. Therefore, as shown in the table of FIG. 25, a difference between the maximum value and the minimum value of the terminal voltages of the resistors R10 through R26 is set substantially constant (in a range of from 0.9 to 1.0 (V) (see column under "difference" in the table)).

Figure 27:
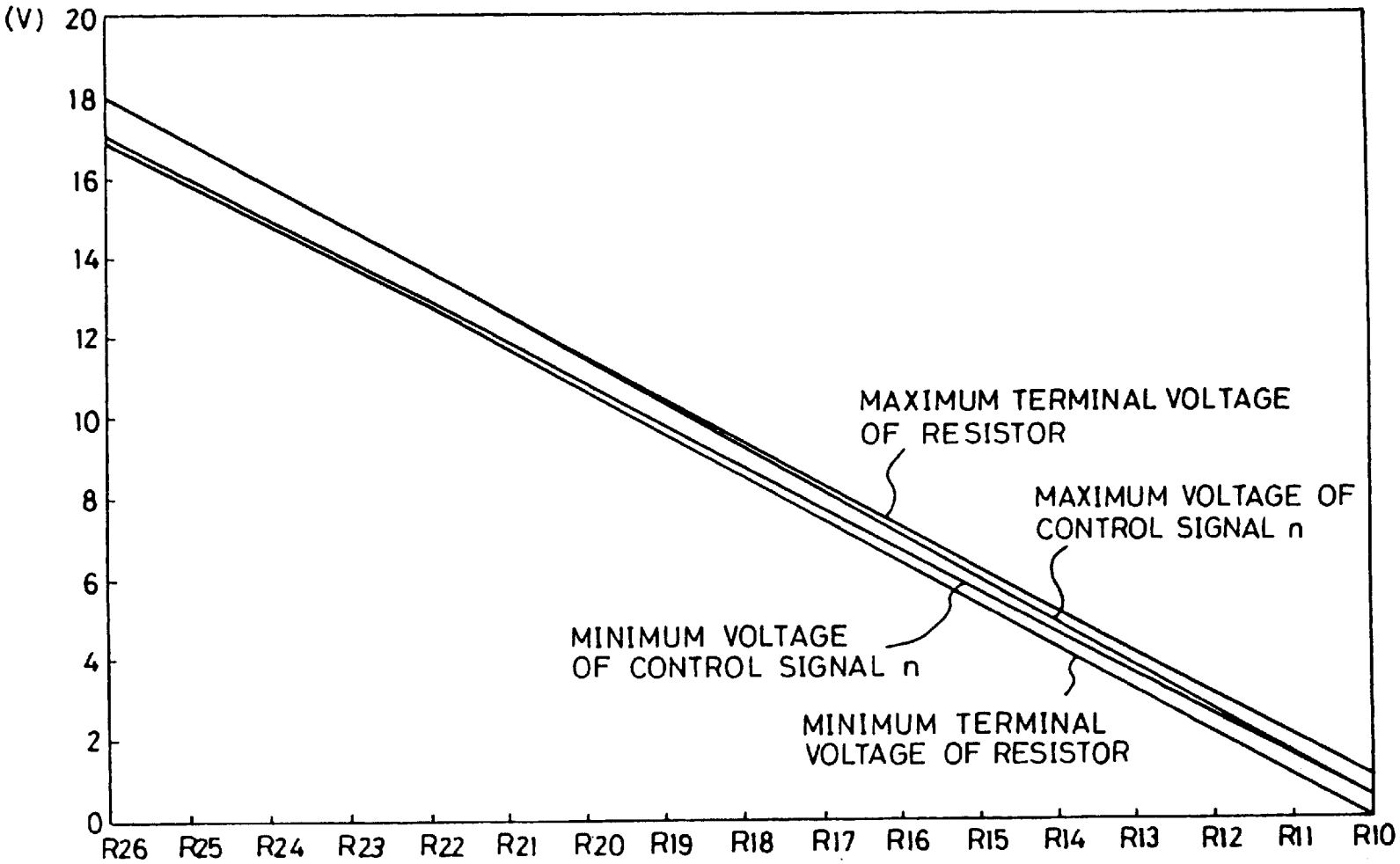
FIG. 27 is a graph showing characteristics of a voltage across the resistor terminals and a voltage of the control signal based on conditions shown in the table shown in FIG. 25.

In the described condition, the control signal n shows a greater change as the voltage set thereto becomes greater. Therefore, as shown in FIG. 27 (see column of the table in FIG. 25 under the width of n), there is a point where the maximum value of the terminal voltage of the resistor and the maximum value of the control signal n are aligned on the same line, which causes the lighting of the blank lamp G inaccurately.

Figure 28:
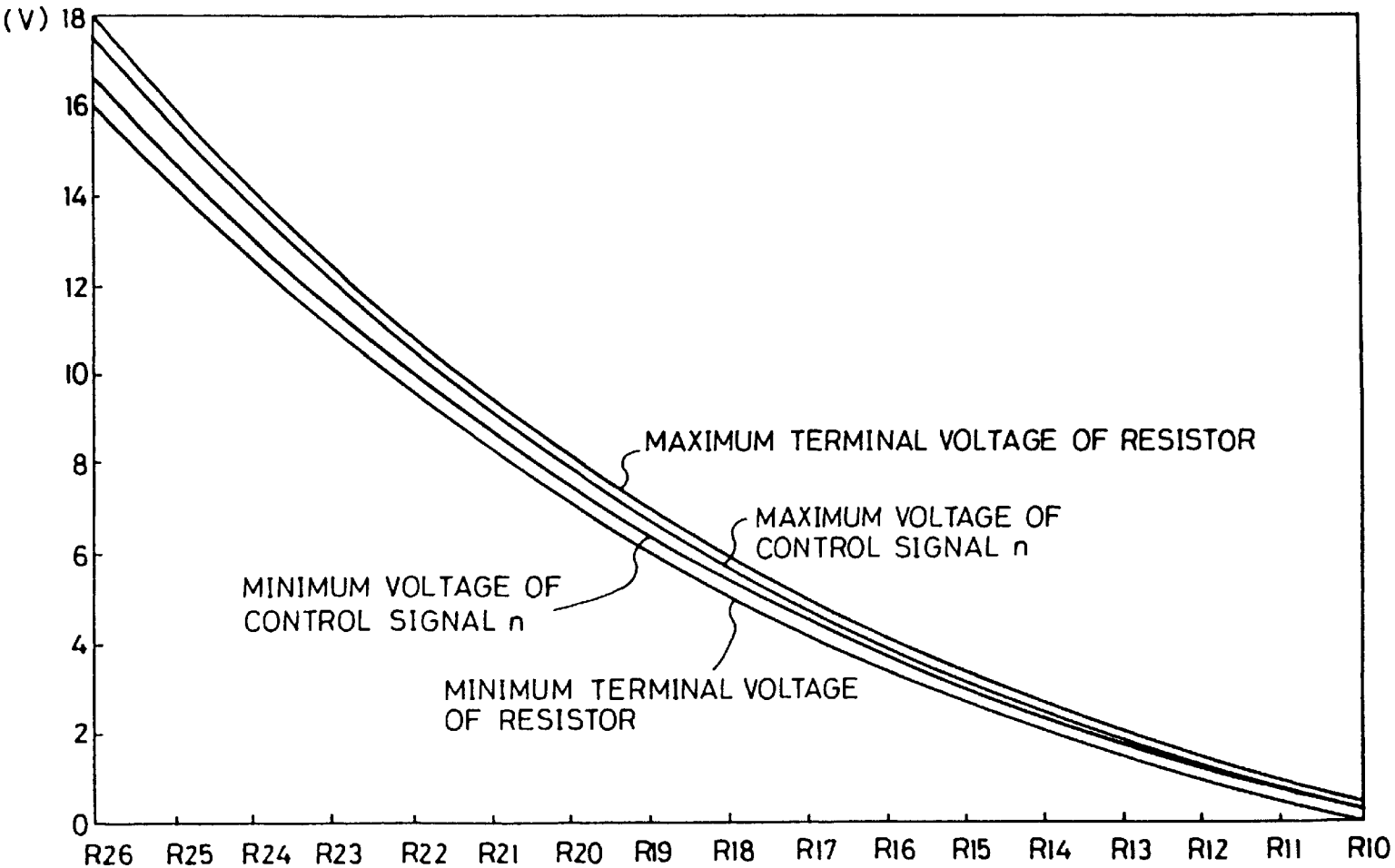
FIG. 28 is a graph showing characteristics of a voltage across the resistor terminals and the voltage of the control signal based on conditions shown in the table of FIG. 26.

In order to counteract the described problem, the copying machine of the present embodiment adopts resistors of different rated values for the dividing resistors R10 through R26 in the driving circuit section 17. Specifically, as shown in FIG. 26, it is designed such that a resistance value becomes larger from R10 to R26. This makes the terminal voltage of the resistor larger as the divided reference voltages V1 through V16 increase. This permits a control signal n to be controlled between the maximum value and the minimum value of the terminal voltage of the resistor as shown in FIG. 28 even at a point where the maximum value of the terminal voltage of the resistor shown in FIG. 27 is aligned on the same line as the maximum value of the voltage of the control signal n.

As described, the resistors R10 through R26 of the driving circuit section 17 are not set to the same resistance value but to the resistance in consideration of variations in voltage and resistance. For example, as the divided reference voltages V1 through V16 increase, by expanding the range of the terminal voltage of the resistor, an available range in variation of the voltage of the control signal n with respect to the divided reference voltages V1 through V16 increases, thereby permitting a stable control.

EMBODIMENT 4

The fourth embodiment of the present invention will be described in reference to FIGS. 2, 29(*a*), 29(*b*) and 30. In the present embodiment, explanations will be given through the case of adopting a light emitting element control device to an optical sensor control device. For convenience in explanations, members having the same function as those of the aforementioned embodiment will be designated by the same reference numerals, and thus the descriptions thereof shall be omitted here.

As explained in the first embodiment, around the outer surface of the photoreceptor drum 1 of the copying machine of the present embodiment, as shown in FIG. 2, the light emitting/receiving sensor (optical sensor) 9 for detecting marks (not shown) formed on the surface of the photoreceptor drum 1. The light emitting/receiving sensor 9 is provided for detecting whether or not the photoreceptor drum 1 is properly mounted. This prevents such problem that the quality of the image is lowered due to an improper installation of the photoreceptor drum 1 being mounted in a slanted way, etc.

Figure 30:
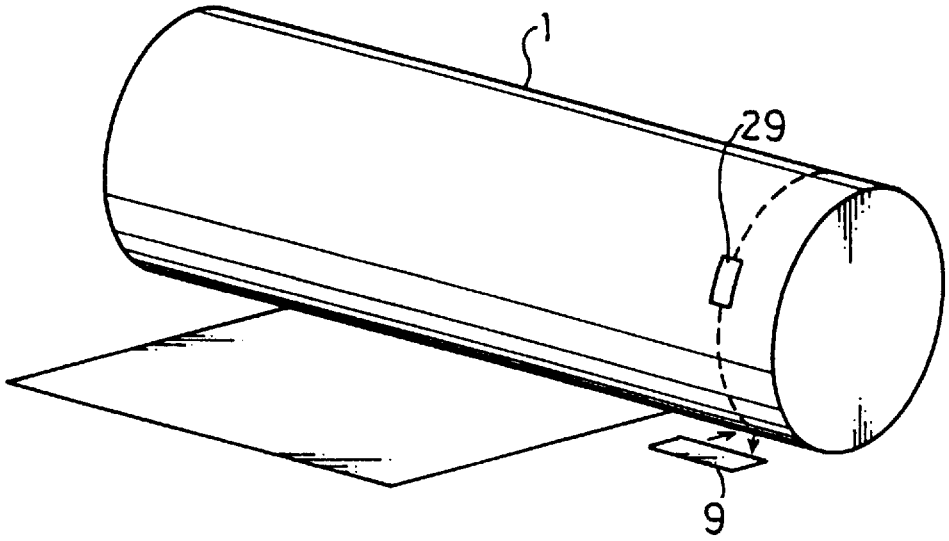
FIG. 30 is an explanatory view which shows a relationship between a photoreceptor drum and a light emitting and receiving sensor.

FIG. 30 shows a photoreceptor drum 1 taken from the side, and a light emitting/receiving sensor 9 is mounted to the outside the maximum sheet width (the width of the A-3 size: 297 mm taking the center of the drum as a center).

As shown in FIG. 30, a drum mark 29 is formed on the outer surface of the photoreceptor drum 1 to a portion subjected to an irradiation with light from the light emitting/receiving sensor 9 to the photoreceptor drum 1 (dashed line in the figure). The drum mark 29 is a non-mirror-reflecting portion (for example, 10 mm×10 mm) having a width of not less than the portion subjected to the irradiation with light from the light emitting/receiving sensor 9.

For example, with respect to the reflectance of the surface of the photoreceptor drum 1 other than the drum mark 29 of 100 percent, the drum mark 29 is formed on the drum surface so as to have a reflectance of 50 percent.

Figures 29A, 29B:
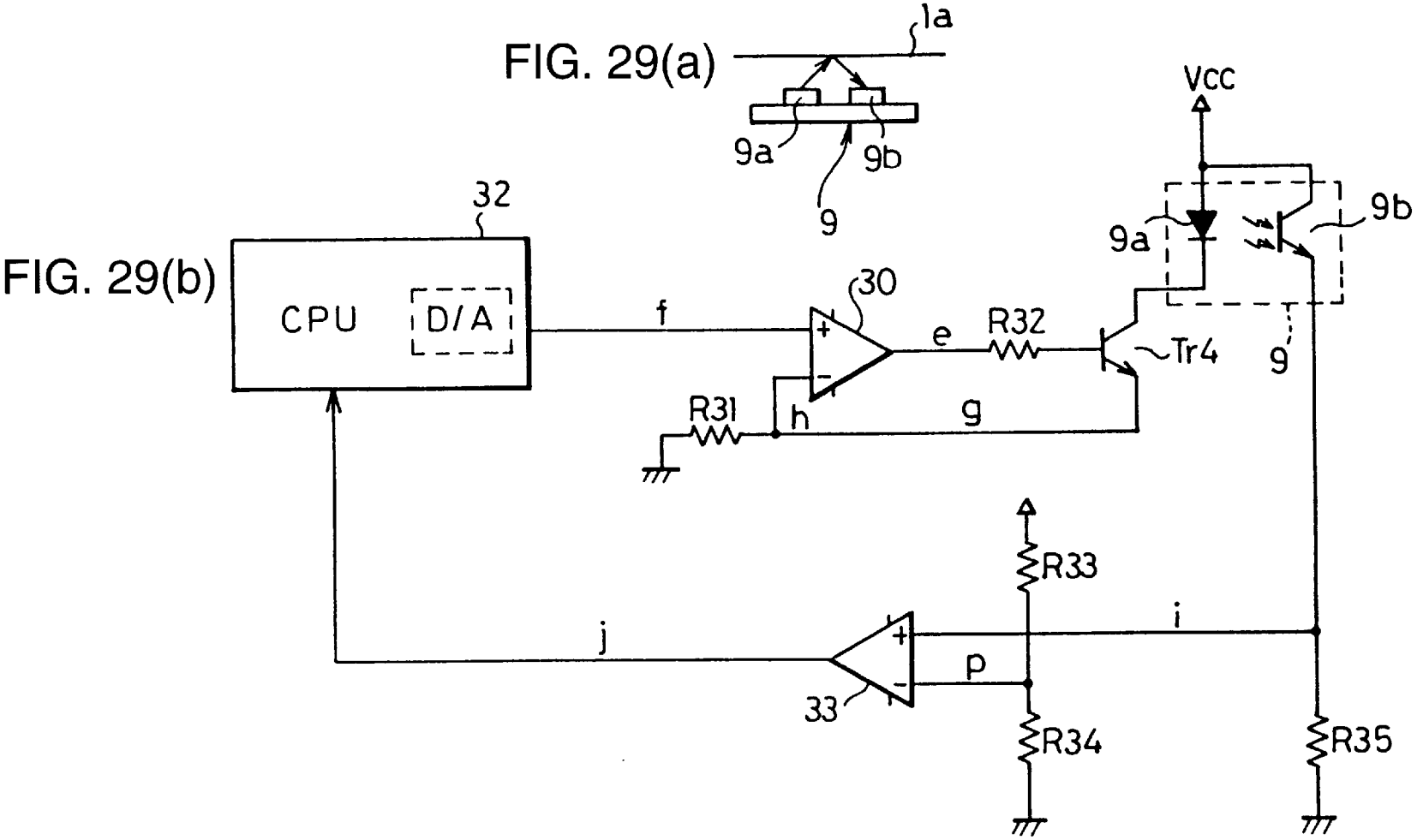
FIG. 29(*a*) is an explanatory view showing a structure of the light emitting/receiving sensor in accordance with another embodiment of the present invention.

As shown in FIG. 29(*a*), the light emitting/receiving sensor 9 serving as a reflective sensor is composed of a light emitting element 9*a* and a light receiving element 9*b*. The light emitting/receiving sensor 9 is arranged such that the light emitted from the light emitting element 9*a* is reflected from a drum surface la and is received by the light receiving element 9*b*. The light emitting element 9*a* is composed of a LED (Light Emitting Diode), etc.

As shown in FIG. 29(*b*), the control device of the light emitting/receiving sensor 9 includes the light emitting/receiving sensor 9, a CPU 32 which stores a D/A converter, an operational amplifier 30, a transistor Tr4, a comparator 33 and five resistors R31 through R35.

The CPU 32 is provided for controlling an amount of light emitted from the light emitting element 9*a* of the light emitting/receiving sensor 9. The amount of light emitted from the light emitting element 9*a* is determined based on the voltage of a D/A converted CPU output signal f from the CPU 32. Upon inputting the output signal f from the CPU 32 to the operation amplifier 30, an amplified output e is output therefrom. Then, the transistor Tr4 is turned on, and a light emitting section current g flows in the light emitting element 9*a* of the light emitting/receiving sensor 9, which causes a voltage h to be generated across the resistor R31. The voltage h is the light control voltage which becomes greater in proportion to the light emitting section current g.

① When the light emitting section current g becomes larger, and the light emitting control voltage h becomes higher than the voltage of the output signal f from the CPU 32, the output e of the operational amplifier 30 is set off, and the transistor Tr4 is turned off, thereby reducing the light emitting section current g which in turn reduces the light emitting control voltage h; and ② When the light emitting control voltage h becomes lower than the voltage of the output signal f, the output e of the operational amplifier 30 is output, and the transistor Tr4 is turned on, thereby increasing the light emitting section current g which in turn increases the light emitting control voltage h.

Thereafter, by repeating the described ① and ②, the light emitting control voltage h becomes equivalent to the voltage of the output signal f from the CPU 32, and the light emitting section current g flows according to the light emission control voltage h, and the amount of light emitted from the light emitting element 9*a* of the light emitting/receiving sensor 9 is determined.

Figure 31:
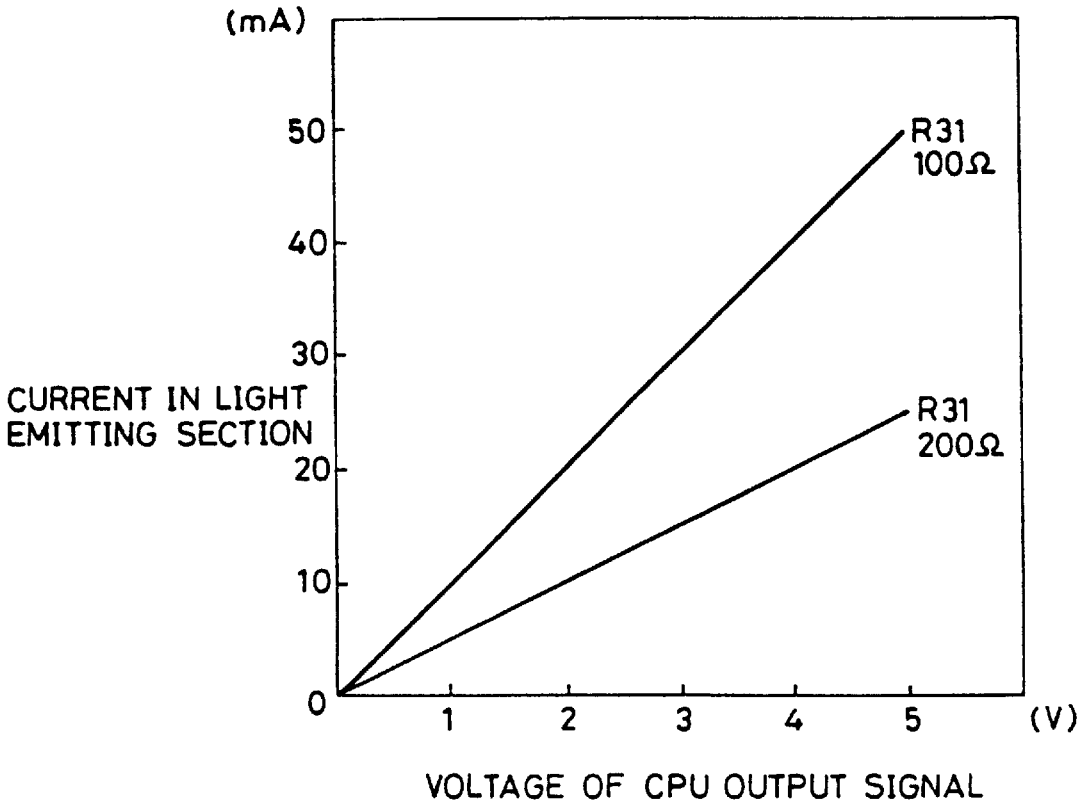
FIG. 31 is a graph which shows a relationship between the light emitting section current and the voltage of the CPU output signal.

In the described circuit, by altering the resistance value of the resistor R31, as shown in FIG. 31, the current g with respect to the voltage of the CPU output signal f varies. In the figure, both the cases where the resistors R31 of 100 Ω and 200 Ω are adopted respectively are shown.

When the output signal f of the CPU 32 outputs the reference output 2(V), 20 mA flows as the light emitting section current g, and by the reflected light from the mirror of the photoreceptor drum 1, a sensor voltage i of the light emitting/receiving sensor is 2.5 (V). The reference voltage p generated from the resistors R33 and R34 of the comparator 33 is set to 2.5(V), and the comparative output j from the comparator 33 is set to 5(V) if the sensor voltage i is not less than 2.5(V), and to 0(V) if the sensor voltage i is not more than 2.5(V).

Figure 32:
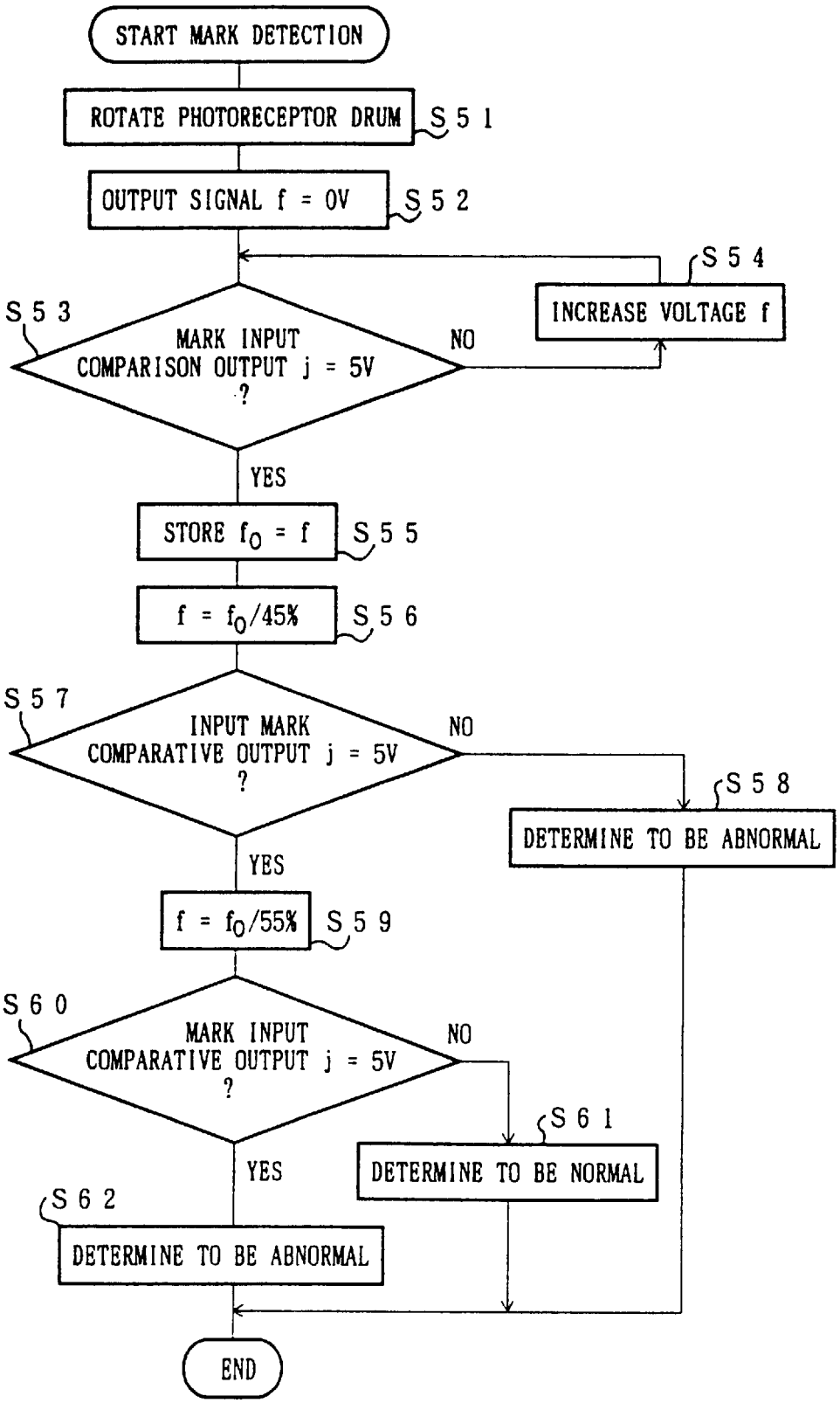
FIG. 32 is a flowchart showing a process of detecting an installation error of the photoreceptor drum.
Figure 33:
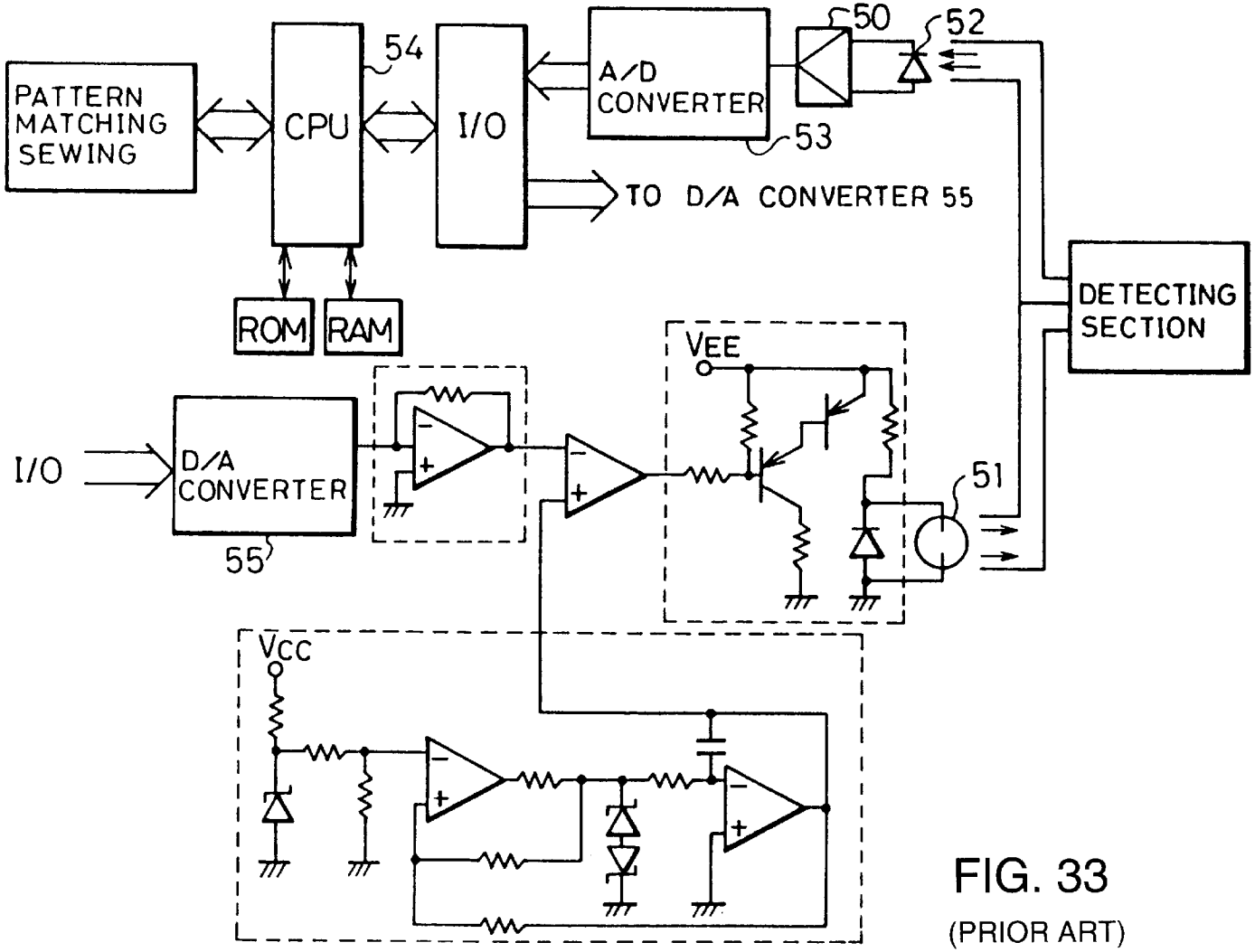
FIG. 33 (PRIOR ART)
FIG. 33 is a conventional circuit diagram of a control circuit of an optical sensor composed of a light emitting element and a light receiving element.
Figure 34:
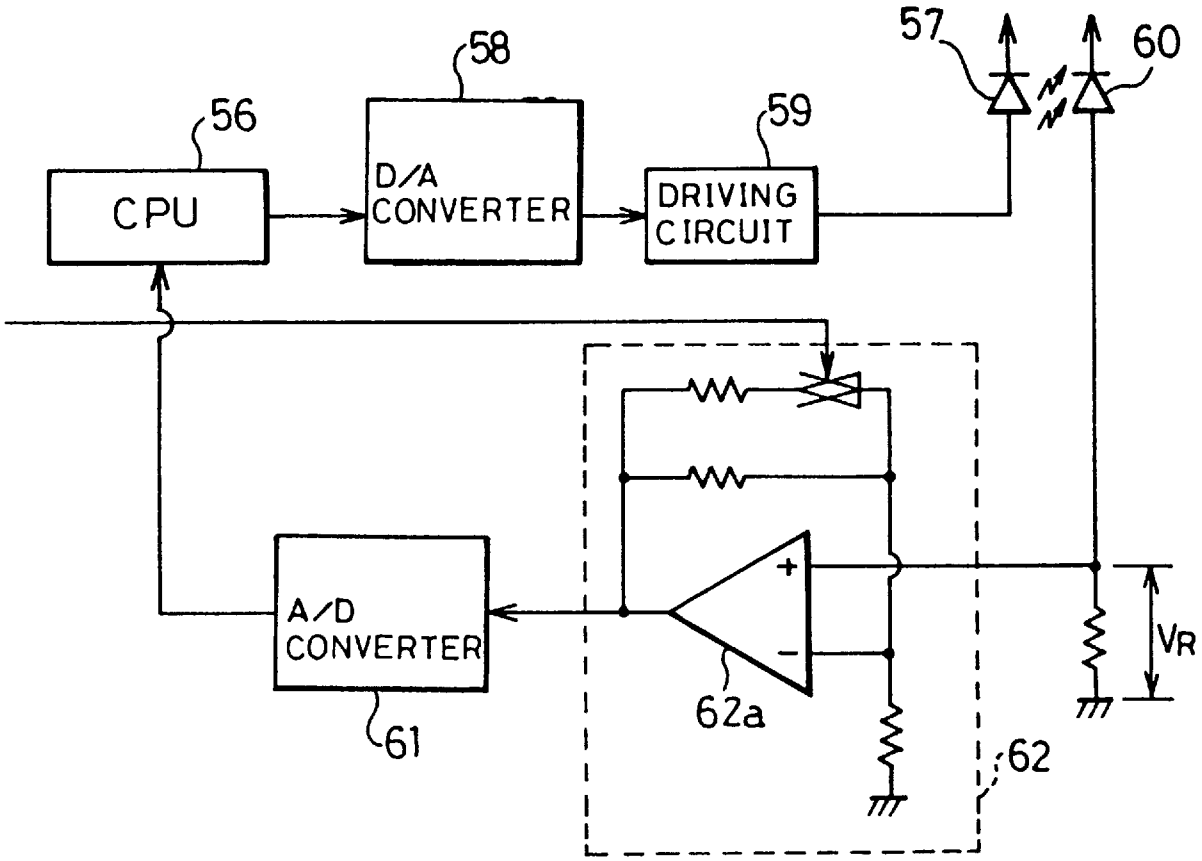
FIG. 34 (PRIOR ART)
FIG. 34 is a conventional circuit diagram of an APC circuit for controlling an amount of light emitted from the light emitting element.
Figure 35:
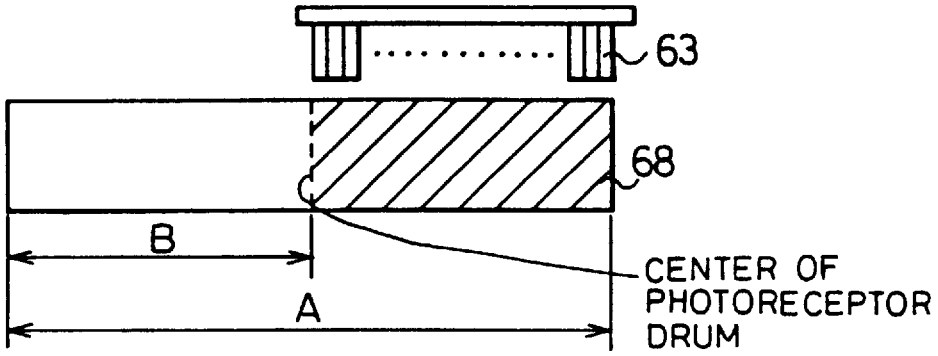
FIG. 35 (PRIOR ART)
FIG. 35 is an explanatory view which shows a charge removing in a maximum non-image-forming area on a photoreceptor drum.
Figure 36:
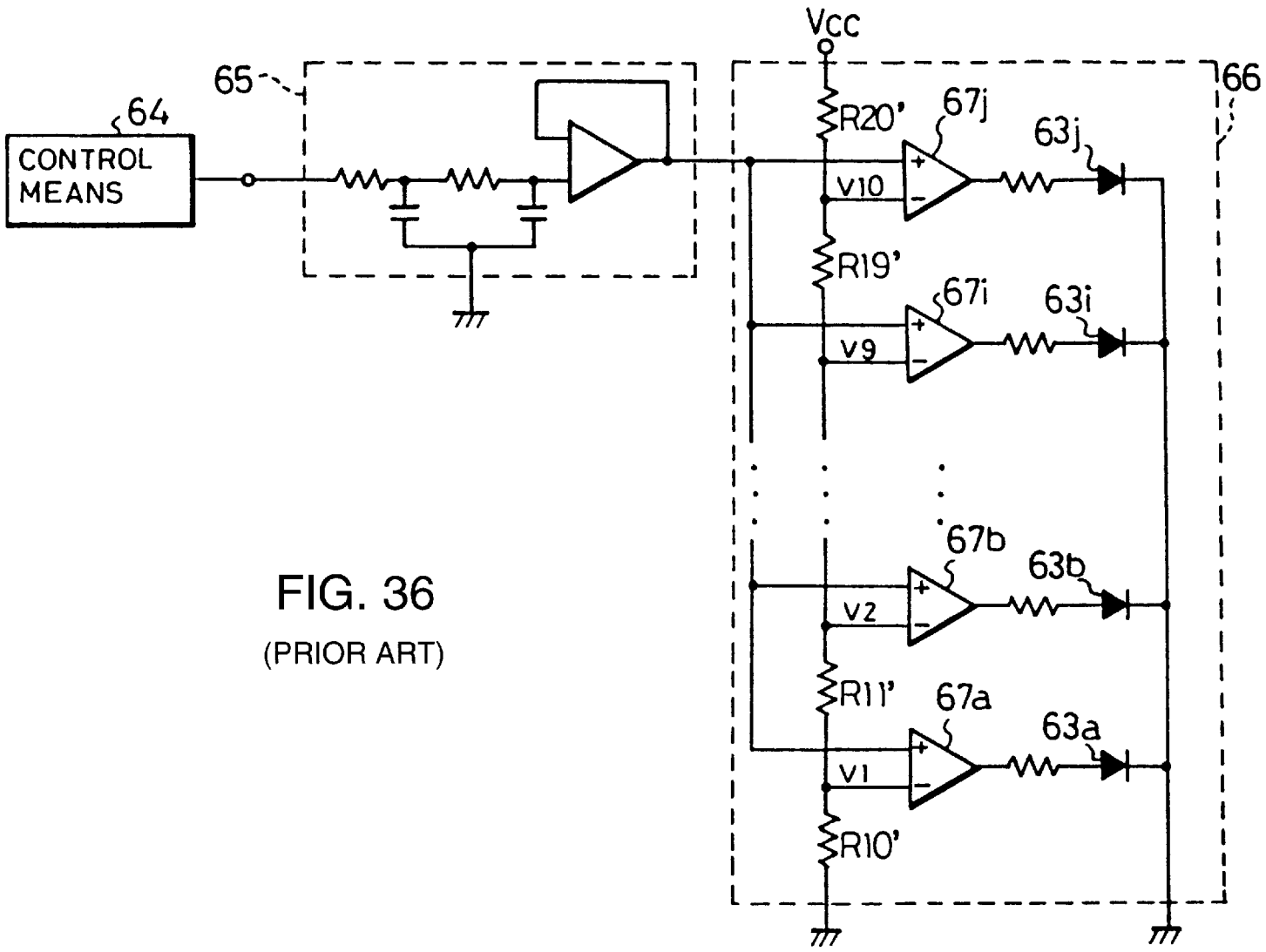
FIG. 36 (PRIOR ART)
FIG. 36 is a conventional circuit diagram of the blank lamp control circuit.
Figure 37:
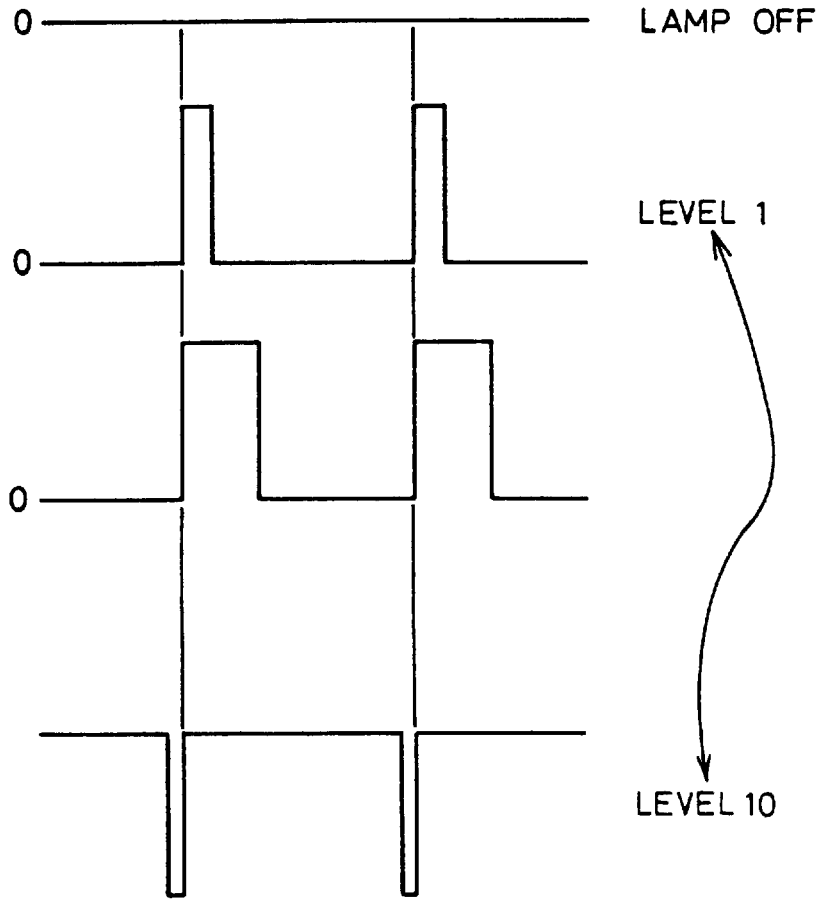
FIG. 37 (PRIOR ART)
FIG. 37 is an explanatory view which shows a conventional blank lamp PWM signal.
Figure 38:
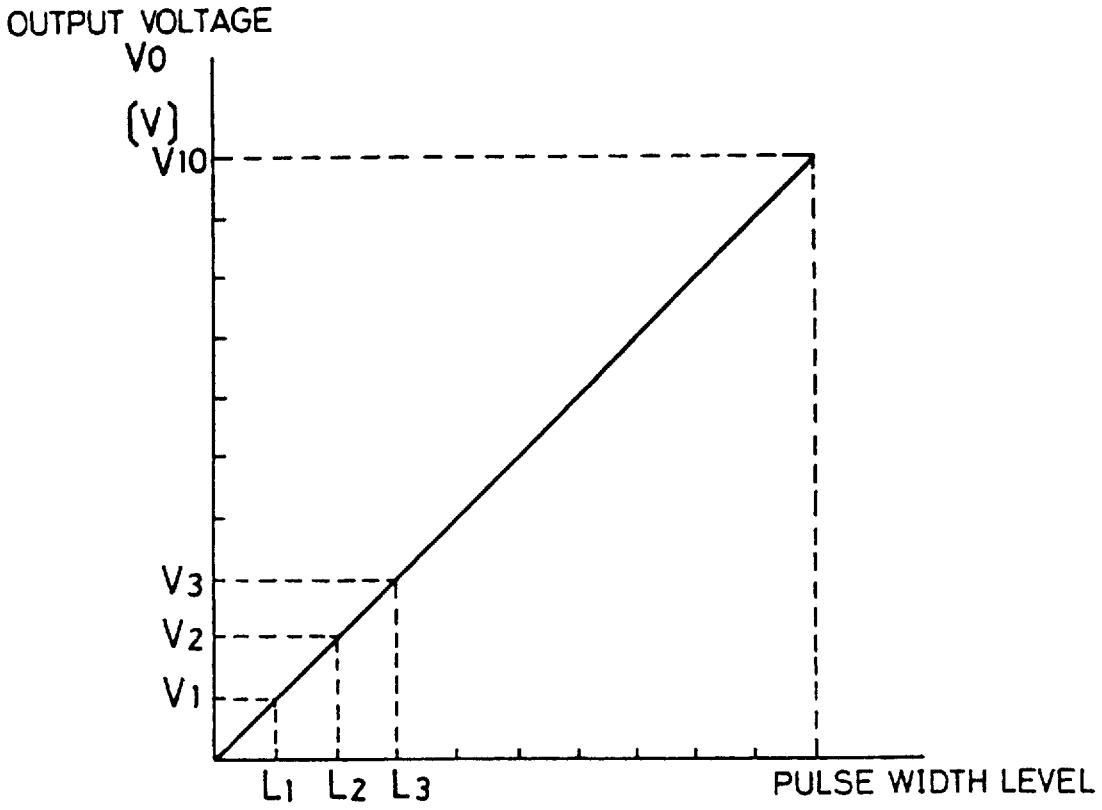
FIG. 38 (PRIOR ART)
FIG. 38 is a graph which shows a conventional relationship between PWM pulse width for a blank lamp and an output voltage V of a control voltage signal.

Thereafter, in reference to the flowchart of FIG. 32, an operation of determining the installation state of the photoreceptor drum 1 is determined by the detection of a mark will be explained.

First, the photoreceptor drum 1 is rotated (S51). Then, the CPU 32 gradually increases the voltage of the output signal f from 0(V), and when the comparative output j from the comparator 33 to be fed back is increased from 0(V) to 5(V), the voltage $f_0$ of the output signal f is stored ((S52 through S55)). Here, by setting the voltage $f_0$ of the output signal f, variations in functions among light emitting/receiving sensors 9, such as a light emitting/receiving efficiency, a reflectance from the mirror of the photoreceptor drum 1, etc., are adjusted. Here, if there is no variations in the light emitting/receiving sensors, and reflectance from the mirror of the photoreceptor drum 1, when the voltage of the output signal f reaches 2(V), the output from the comparator 33 is reversed, and a comparative output j of 5(V) is inputted to the CPU 32.

For example, when the reflectance of the photoreceptor drum 1 is 10 percent lower than the standard reference, in the described operation, the voltage $f_0$ of the output signal f of the CPU 32 is set as follows:

$$f_0=2(V)/90 \text{ percent}=2.22 (V).$$

On the other hand, the drum mark 29 is detected based on the reflectance from the non-mirror-reflective portion (50 percent of the reflected light amount from the mirror of the photoreceptor drum). Therefore, when the voltage 2(V) of the output signal f corresponds to the reflected light amount from the mirror, for example, in the case where the drum mark 29 is detected when the reflected light amount from the non-mirror-reflective portion is in a range of from 45 to 55 percent of the reflectance from the mirror, the upper and lower limit voltages are obtained respectively through the following formulae:

$$2(V)/45 \text{ percent}=4.4 (V), \text{ and}$$

$$2(V)/55 \text{ percent}=3.6 (V).$$

If the drum mark 29 is detected when the output signal f having the voltage in the described range is output, it is determined that the photoreceptor drum 1 is installed properly ((S56–S62)).

Namely, in the case where the reflected light amount from the non-mirror reflective portion is detected to be 40 percent of the reflected light amount from the mirror, even if the output signal f from the CPU 32 is 4.4 (V), the sensor voltage i to be inputted to the comparator 33 is only 2.2 (V), and the input (comparative output j) of the CPU 32 remains 0 (V) as shown in the following formulae:

$$(4.4 (V)/2(V))\times 2.5 (V)\times 50 \text{ percent}=2.8 (V)$$

$$(4.4 (V)/2(V))\times 2.5 (V)\times 40 \text{ percent}=2.2 (V).$$

Therefore, the CPU 32 determines an abnormality based on the determination depending on the comparative output j in (S57) (S58).

For example, when the reflected light amount from the non-mirror reflective portion is detected to be 60 percent of the reflected light amount from the mirror, even if the output signal f from the CPU 32 is only 3.6(V), the input (comparative output j) of the CPU 32 is set to 5(V), and from the determination of the comparative output j of (S60) as shown in the following formulae.

$$(3.6 (V)/2(V))\times 2.5 (V)\times 50 \text{ percent}=2.2 (V)$$

$$(3.6 (V)/2(V))\times 2.5 (V)\times 60 \text{ percent}=2.8 (V).$$

Therefore, the CPU 32 determines an abnormality based on the determination depending on the comparative output j in (S60) (S62).

When the comparative output j is 5(V) in (S57), and the comparative output j is 0(V) in (S60), the CPU 32 is determined that the photoreceptor drum 1 is installed properly (S61).

As described, the arrangement of the present embodiment permits the effect of adjusting the amount of light emitted from the light emitting element 9*a* to be appropriate for the reflected light amount from the mirror of the photoreceptor drum 1 to be achieved without providing the A/D converter in the path of feeding back the amount of detection into the CPU 32. The comparative output j to be output from the comparator 33 is not affected by the power source voltage (5V) of the CPU 32, and the output of the direct light receiving element 9*b* can be determined without a special increasing/attenuating circuit. Furthermore, like the light emitting/receiving sensor 9, in the case of the optical sensor in which the light emitting element 9*a* and the light receiving element 9*b* are integrated, a single power source (10 V) may be adopted, and this offers an additional effect of reducing the number of connecting lines.

As described, the light emitting element control device of the present invention is arranged so as to control light emitted from the light emitting element by outputting a signal for controlling the light emitted from the light emitting element from the control device which stores the D/A converter. The control device includes a comparator for comparing the voltage of the output signal from the control means with the reference voltage and generating a binary comparative output to be fed back to the control means, and the control means sets the output voltage to a voltage for appropriately emitting light from the light emitting element in accordance with any of the binary output.

The control device for an optical sensor, a blank lamp, etc., having the described arrangement offers the solution to the problems associated with the conventional arrangement.

The optical sensor control device including the light emitting element and the light receiving element adopting the described arrangement wherein a signal for controlling the amount of light emitted from the light emitting element is output from the control device storing the D/A converter is arranged so as to include a comparator for comparing the sensor voltage and the reference voltage based on the amount of received light from the light receiving element from the optical sensor and generating a binary comparative output to be fed back to the control device. The control means is arranged such that the voltage of the output signal is set to the voltage obtained by emitting the light emitting element with an appropriate light amount in accordance with any of the binary comparative output.

According to the described arrangement, the comparator compares the sensor voltage with the reference voltage and generates the binary comparative output of the low level or high level to be fed back to, for example, the CPU (control means). In the CPU, based on any of the binary comparative output, the output value is adjusted by repetitively increasing and dropping it, to be the voltage which sets the amount of light emitted from the light emitting element to be appropriate.

Therefore, using the binary comparative output by the comparator, as described in the conventional arrangement, the A/D converter is not required in the path for feeding back the detected output to the CPU. Additionally, as the comparative output from the comparator is not affected by the power source voltage (5V) of the CPU, without providing a special amplifying/attenuating circuit on the light receiving side, a sensor voltage can be directly determined.

The blank lamp control device having the described arrangement wherein a signal for setting the voltage value in accordance with the lighting state of the blank lamps in multiple gradation is output from the control means storing the D/A converter, the control voltage signal is generated by amplifying the output signal in the amplifying circuit having an error element, and a lighting of the blank lamp is controlled by comparing the control voltage signal with the blank lamp reference voltage by inputting the control voltage signal to the blank lamp driving circuit, is arranged so as to include a comparator for generating a binary comparative output by comparing the voltage value of the control voltage signal with the blank lamp reference voltage to be fed back to the control means. The control means adjusts the basic voltage of the output signal at which the voltage of the control voltage signal is equivalent to the blank lamp reference voltage based on any of a binary comparative output, and resets each voltage value in multiple gradation.

According to the described arrangement, the comparator generates a binary comparative output of low level or high level by comparing the voltage of the blank lamp reference voltage with the control voltage signal which results from amplifying the output signal, for example, from the CPU as the control means, to be fed back to the CPU. In the CPU, the output value is adjusted by repeating the adjustment of increasing or dropping the output value based on any of the binary output value, and the basic voltage of the output signal at which the voltage of the control voltage signal becomes equivalent to the blank lamp reference voltage is adjusted so as to reset each voltage value in multiple gradation for controlling the lighting of the blank lamp based on the adjusted basic voltage.

Therefore, in the arrangement of the conventional blank lamp control device, in order to stably control the lighting of the blank lamps in 15 groups, high precision members are required, for example, for dividing resistances in the amplifying circuit. However, the described arrangement of the present invention permits each voltage in multiple gradation to be set as desired, with an inexpensive arrangement using low precision resistors, thereby permitting a stable control of the blank lamps in a large groups which cannot be achieved with the conventional arrangement.

It is preferable that the blank lamp control device is arranged such that the reference voltage of the control means is generated by attenuating the blank lamp reference voltage by the attenuating circuit having the error element.

According to the described arrangement, as the reference voltage of the control means, for example, the CPU shifts in sync with the shift of the reference voltage of the blank lamp, the adjustment of the voltage with respect to the variations in reference voltage of the blank lamp is not needed.

In the blank lamp control device, it is preferable that the error element be the voltage dividing resistor in the circuit, and the range of the voltage of the output signal to be output from the control means when adjusting the basic voltage be determined in accordance with the precision distribution of the dividing resistor.

According to the described arrangement, for example, when the output value from the CPU (control means) is adjusted by increasing or dropping in accordance with a binary comparative output from the comparator, the basic voltage can be adjusted by adjusting an output value in an earlier stage, and this permits an output voltage to be reset to each voltage in multiple gradation in accordance with the lighting state of the blank lamps.

Further, the blank lamp control device may be arranged such that when adjusting the basic voltage, the control means adjusts beforehand an output value by outputting an output signal of the voltage corresponding to a rated value of the dividing resistor.

As the precision distribution of the dividing resistor shows a normal distribution, most of the resistors have a rated value. Therefore, by adjusting an output value by outputting the output signal of the voltage corresponding to the rated value, the basic voltage is adjusted in an early stage, and each voltage in multiple gradation corresponding to the lighting of the blank lamp can be reset to each voltage in an early stage.

It is also preferable that the blank lamp control device be adjusted such that the control means outputs an output signal of the voltage corresponding to the rated value of the dividing resistor first, and then outputs the output signal of the voltage corresponding to the maximum or minimum resistance value of the dividing resistor, and further outputs an output signal of the voltage corresponding to a midpoint value between the maximum or minimum resistance value and a rated value of the dividing resistor so as to adjust the output value.

As described, by adjusting an output voltage by using the voltage corresponding to the rated value of the highest likelihood in the distribution for the initial comparison (first comparison), and the voltage corresponding to the maximum or minimum resistance value of the dividing resistor for the next comparison (second comparison), and further by using the voltage corresponding to a midpoint resistance value between the maximum resistance value or minimum resistance value and the rated value of the dividing resistor for the third comparison if necessary, the basic value can be adjusted in an early stage, and each voltage in multiple gradation can be reset in accordance with the lighting of the blank lamp in an early stage.

It is further preferable that the blank lamp control device be arranged such that when adjusting the basic voltage, the control device outputs an output signal of the voltage corresponding to the rated value of the dividing resistor, and then outputs an output signal of the voltage corresponding to the maximum resistance value or the minimum resistance value in the range which covers around 70 percent of resistors based on the measurement. If necessary, the voltage can be adjusted by outputting the output signal of the voltage corresponding to the midpoint resistance between the maximum or minimum resistance value and the rated value in the described range, in order to adjust the output value.

As described, by adjusting the output voltage using the voltage corresponding to the rated values of the distribution of the highest likelihood for the initial comparison (first comparison), and the voltage corresponding to the maximum or minimum resistance value in the range which covers around 70 percent of the resistors based on the measured values for next comparison (second comparison), and further by using the voltage corresponding to the intermediate resistance value between the maximum or minimum resistance value and the rated value in the described range for the third comparison, if necessary, the basic voltage can be adjusted in an early state, thereby permitting each voltage in multiple gradation to be reset in accordance with the lighting of the blank lamp in an early stage. The described arrangement is especially effective when adopting the resistors whose distribution does not show a normal distribution.

It is also preferable that the blank lamp control device be arranged such that when adjusting the basic voltage, the control device outputs an output signal of the voltage corresponding to the rated value of the dividing resistor first, and then outputs an output signal of the voltage value corresponding to the resistance value of the dividing resistor of 1 sigma, in order to adjust the output value.

As described, by adjusting the output voltage by using the voltage corresponding to the rated value of the highest likelihood in the distribution for the first comparison, and using the voltage value corresponding to the resistance value of the dividing resistor of 1 sigma for the next comparison, the basic voltage can be adjusted in an earlier state, thereby permitting each voltage in multiple gradation to be reset in accordance with the lighting of the blank lamp in an earlier stage. The arrangement is effective as the measured values are used, and a still more accurate adjustment can be expected in an early stage.

It is also preferable that the blank lamp control device be arranged so as to include a non-volatile memory means which stores an adjusted basic voltage, and that the control means may output the output signal of the adjusted basic voltage that is stored in the memory means first instead of using the output signal of the voltage corresponding to the rated value for the second comparison.

According to the described arrangement, to the non-volatile memory means, the adjusted basic voltage is stored, and for the subsequent comparison, instead of using the output signal of the voltage corresponding to the rated value, the previously adjusted output signal of the basic voltage stored in the memory means is output first. This permits the subsequent adjustment of the basic voltage to be carried out in an early stage, thereby permitting the subsequent resetting of each voltage in multiple gradation to be performed in an earlier stage.

It is further preferable that the blank lamp control device be arranged such that all light-off means for lighting off all the blank lamps when the control voltage signal of the voltage substantially equivalent to the blank lamp reference voltage is inputted is provided in the blank lamp driving circuit.

According to the described arrangement, when the voltage equivalent to the blank lamp reference voltage is inputted, all light-off means lights off all the blank lamps. This prevents a pre-exposure of the photoreceptor without lighting the blank lamps even when the control voltage signal of the voltage substantially equivalent to the blank lamp reference voltage is inputted to the blank lamp driving circuit in the adjustment of the basic voltage.

Additionally, it is preferable that the blank lamp control device includes a plurality of driving comparators for comparing a voltage of a control voltage signal to be output from the control device with a divided reference voltage resulting from voltage-dividing the blank lamp reference voltage in accordance with the level of the voltage required for lighting on a plurality of blank lamps in the blank lamp driving circuit. It is preferable that the divided reference voltage to be inputted to the driving comparator be set such that the higher is the voltage level, the greater is the difference in voltage.

According to the described arrangement, as each divided reference voltage is set such that the higher is the level of the voltage, the larger is the difference in voltage, a margin of the range of the variation in voltage of the control voltage signal with respect to the divided reference voltage is increased, thereby permitting a still more stable lighting control of the blank lamps.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A light emitting element control device, comprising:

control means having a D/A converter stored therein;

an amplifying circuit for amplifying an output of said D/A converter and outputting an amplified output as a control signal for emitting each light emitting element;

a reference voltage generating circuit for generating a reference voltage; and a comparator for comparing the control signal with the reference voltage, wherein said control means varies an output of said D/A converter based on a result of comparison by said comparator, adjusts an output of said D/A converter in such a manner that the control signal is equivalent to the reference voltage, and resets each output of said D/A converter so as to permit each light emitting element to appropriately emit light based on the output thus adjusted.

2. An optical sensor control device designed for an optical sensor including a light emitting element and a light receiving element for outputting a sensor voltage that varies according to an amount of light received wherein an output signal for controlling an amount of light emitted from the light emitting element is output from control means having a D/A converter stored therein, said optical sensor control device comprising:

a reference voltage generating circuit for generating a reference voltage; and a comparator for comparing the sensor voltage with the reference voltage, wherein said control means resets a voltage of the output signal based on a result of comparison by said comparator so as to permit the light emitting element to emit an appropriate amount of light.

3. The blank lamp control device of claim 2 configured in a copy machine comprising a photoreceptor drum having a mark formed thereon, said mark having a lower reflectance than a reflectance on a surface of an irradiated part; and an optical sensor for detecting the mark.

4. A blank lamp control means comprising:

control means having a D/A converter stored therein for outputting an output signal for use in setting a voltage in multiple gradation based on a reference voltage in accordance with a lighting state of blank lamps;

an amplifying circuit for amplifying an output of said D/A converter and outputting an amplified output as a control voltage signal;

a reference voltage generating circuit for generating a blank lamp reference voltage; and a comparator for comparing the control voltage signal with the blank lamp reference voltage, wherein said control means varies an output of said D/A converter based on a result of comparison by said comparator, and adjusts a basic voltage that is the output of said D/A converter in such a manner that the control voltage signal is equivalent to the blank lamp reference voltage and resets each voltage in multiple gradation based on the basic voltage.

5. The blank lamp control device as set forth in claim 4, further comprising:

an attenuating circuit for attenuating the blank lamp reference voltage, wherein the reference voltage of said control means is an output of said attenuating circuit.

6. The blank lamp control device as set forth in claim 5, wherein:

said attenuating circuit is composed of a plurality of voltage dividing resistors, and a range of a voltage of the output signal to be output from said control means when adjusting the basic voltage is determined in accordance with a precision distribution of said plurality of voltage dividing resistors.

7. The blank lamp control device as set forth in claim 5, wherein:

said attenuating circuit is composed of a plurality of voltage dividing resistors, and a range of a voltage of the output signal to be output from said control means when adjusting the basic voltage is determined in accordance with a precision distribution of said voltage dividing resistors.

8. The blank lamp control device as set forth in claim 7, wherein:

an amplification factor of said amplifying circuit is larger than an attenuation factor of said attenuating circuit.

9. The blank lamp control device as set forth in claim 7, wherein:

when adjusting the basic voltage, said control means adjusts a value of the output signal by first outputting a signal output of a voltage corresponding to a rated value of the voltage dividing resistors.

10. The blank lamp control device as set forth in claim 7, wherein:

when adjusting the basic voltage, said control means first outputs an output signal of a voltage corresponding to a rated value of the voltage dividing resistors and then outputs a signal output of a voltage corresponding to a maximum or minimum resistance value of the voltage dividing resistors so as to adjust the signal output.

11. The blank lamp control device as set forth in claim 7, wherein:

when adjusting the basic voltage, said control means first outputs an output signal of a voltage corresponding to a rated value of the voltage dividing resistors and then outputs a signal output of a voltage corresponding to a maximum or minimum resistance value of the voltage dividing resistors and further outputs a signal output of a voltage corresponding to an intermediate resistance value between the maximum or minimum resistance value and the rated value of the voltage dividing resistors as occasion demands so as to adjust the output signal.

12. The blank lamp control device as set forth in claim 11, further comprising:

non-volatile memory means for storing an adjusted basic voltage, wherein said control means first outputs an output signal of a previously adjusted basic voltage stored in said memory means in replace of the output signal of the voltage corresponding to the rated value from a second adjustment of the basic voltage.

13. The blank lamp control device as set forth in claim 7, wherein:

when adjusting the basic voltage, said control means first outputs an output signal of a voltage corresponding to a rated value of the voltage dividing resistors and then outputs a signal of a voltage corresponding to a maximum or minimum resistance value of the voltage dividing resistors in a range which covers substantially 70 percent of sample resistors based on measurement and further outputs an output signal of a voltage corresponding to a midpoint resistance value between the maximum or minimum resistance value and the rated value of the voltage dividing resistors as occasion demands so as to adjust the output signal.

14. The blank lamp control device as set forth in claim 13, further comprising:

non-volatile memory means for storing an adjusted basic voltage, wherein said control means first outputs an output signal of a previously adjusted basic voltage stored in said memory means in replace of the output signal of the voltage corresponding to the rated value from a second adjustment of the basic voltage.

15. The blank lamp control device as set forth in claim 7, further comprising:

when adjusting the basic voltage, said control means first outputs an output signal of a voltage corresponding to a rated value of the voltage dividing resistors and then outputs a signal output of a voltage corresponding to a resistance value of 1 sigma of the voltage dividing resistors so as to adjust the output signal.

16. The blank lamp control device as set forth in claim 15, further comprising:

non-volatile memory means for storing an adjusted basic voltage, wherein said control means first outputs an output signal of a previously adjusted basic voltage stored in said memory means in replace of the output signal of the voltage corresponding to the rated value from a second adjustment of the basic voltage.

17. The blank lamp control device as set forth in claim 7, further comprising:

all light-off means for turning off all the blank lamps by inputting the control voltage signal of the voltage substantially equivalent to the blank lamp reference voltage.

18. The blank lamp control device as set forth in claim 7, wherein:

said control voltage signal is sent to said a blank lamp driving circuit;

said blank lamp driving circuit includes a plurality of driving-use comparators for comparing a voltage of the control voltage signal from said control means with a divided reference voltage obtained by resistance-dividing the blank lamp reference voltage in accordance with a voltage level required for lighting a plurality of blank lamps, wherein a difference in voltage of the divided reference voltage is set so as to increase in accordance with the voltage level.

19. The blank lamp control device of claim 14 configured in a copy machine.

20. The blank lamp control device, as set forth in claim 7, wherein:

the reference voltage of said control means is externally supplied, and said control means adjusts an output value of the output signal in accordance with variations in the reference voltage.

* * * * *

UNITED STATES PATENT AND TRADEMARK OFFICE

CERTIFICATE OF CORRECTION

PATENT NO : 5,884,125

DATED : March 16, 1999

INVENTOR(S) : Hideo Taniguchi, Akihiko Taniguchi, Tamaki Mashiba, and Masanori Mori It is certified that error appears in the above-identified patent and that said Letters Patent are hereby corrected as shown below:

On title page, item 30 Foreign App Priority Data
replace "8-068118"
with --8-068778--.

Signed and Sealed this

Twenty-first Day of September, 1999

*Attest:*

Q. TODD DICKINSON

*Attesting Officer*

*Acting Commissioner of Patents and Trademarks*